US011851239B2

(12) United States Patent
Lopez Uran et al.

(10) Patent No.: US 11,851,239 B2
(45) Date of Patent: Dec. 26, 2023

(54) PALLET BEARING STRUCTURES

(71) Applicant: CHEP Technology Pty Limited, Sydney (AU)

(72) Inventors: Daniel Lopez Uran, London (GB); Christophe Loiseau, Saint Pryvé Saint Mesmin (FR); Malcolm Charles Cant, Wokingham (GB)

(73) Assignee: CHEP Technology Pty Limited, Sydney (AU)

( * ) Notice: Subject to any disclaimer, the term of this patent is extended or adjusted under 35 U.S.C. 154(b) by 518 days.

(21) Appl. No.: 17/047,454

(22) PCT Filed: Apr. 16, 2019

(86) PCT No.: PCT/IB2019/053128
§ 371 (c)(1),
(2) Date: Nov. 20, 2020

(87) PCT Pub. No.: WO2019/202500
PCT Pub. Date: Oct. 24, 2019

(65) Prior Publication Data

US 2021/0147111 A1 May 20, 2021

(30) Foreign Application Priority Data

Apr. 17, 2018 (GB) ..... 1806264

(51) Int. Cl.
*B65D 19/18* (2006.01)
*B65D 19/08* (2006.01)
(Continued)

(52) U.S. Cl.
CPC ..... *B65D 19/18* (2013.01); *B65D 19/08* (2013.01); *B65D 19/20* (2013.01); *B65D 19/385* (2013.01);
(Continued)

(58) Field of Classification Search
CPC .. B65D 19/20; B65D 19/0095; B65D 19/385; B65D 2519/00955; B65D 2519/0097;
(Continued)

(56) References Cited

U.S. PATENT DOCUMENTS 2,700,520 A * 1/1955 Skubic ..... B65D 19/385 403/219
3,099,891 A * 8/1963 Handler ..... A47B 91/06 248/188.9
(Continued)

FOREIGN PATENT DOCUMENTS

CH 653306 A5 * 12/1985
FR 2581972 A2 * 11/1986
(Continued)

OTHER PUBLICATIONS

International Search Report and Written Opinion for International Application No. PCT/IB2019/053128, dated Aug. 2, 2019, (16 pages), Australian Patent Office, Woden ACT, Australia.

*Primary Examiner* — Jose V Chen
(74) *Attorney, Agent, or Firm* — Alston & Bird LLP

(57) ABSTRACT

A pallet comprises a deck. The deck comprises a product supporting surface and one or more load bearing features. The load bearing features are configured to receive lateral projections of support members.

19 Claims, 53 Drawing Sheets

(51) Int. Cl.
*B65D 19/20* (2006.01)
*B65D 19/38* (2006.01)
*B65D 19/42* (2006.01)

(52) U.S. Cl.
CPC .... *B65D 19/42* (2013.01); *B65D 2519/00019* (2013.01); *B65D 2519/00024* (2013.01); *B65D 2519/00034* (2013.01); *B65D 2519/0086* (2013.01); *B65D 2519/00492* (2013.01); *B65D 2519/00567* (2013.01); *B65D 2519/00572* (2013.01); *B65D 2519/00771* (2013.01); *B65D 2519/00781* (2013.01); *B65D 2519/00975* (2013.01)

(58) Field of Classification Search
CPC .. B65D 2519/00975; B65D 2519/0096; B65D 2519/00965
USPC ..... 108/53.1, 53.3, 53.5; 211/188
See application file for complete search history.

(56) References Cited

U.S. PATENT DOCUMENTS 3,400,671 A * 9/1968 Erismann ..... B65D 19/40 108/53.5
3,672,515 A * 6/1972 Rous ..... A47B 57/402 108/53.1
3,807,581 A * 4/1974 Nichols ..... B65D 88/005 108/53.5
3,994,241 A 11/1976 Evans
4,002,126 A * 1/1977 Bell ..... B65D 19/0075 108/53.5
4,344,368 A * 8/1982 Remington ..... B65D 19/44 108/55.3
4,673,092 A * 6/1987 Lamson ..... A47B 47/021 211/186
4,703,702 A * 11/1987 Speicher ..... B65D 19/385 108/52.1
4,756,138 A * 7/1988 Karpisek ..... B65B 9/135 108/53.5
4,955,490 A * 9/1990 Schafer ..... A47B 96/02 211/187
5,345,879 A * 9/1994 Maillard ..... B65D 19/12 108/55.1
5,553,549 A * 9/1996 Nilsson ..... A47B 9/00 108/147.11
5,598,787 A * 2/1997 Pronk ..... B65D 19/385 108/53.1
5,671,854 A * 9/1997 Thomas ..... B65D 88/12 220/625
5,918,551 A * 7/1999 Liu ..... B65D 19/10 108/55.3
6,244,194 B1 * 6/2001 Salmanson ..... A47B 57/22 108/107
6,343,555 B1 * 2/2002 Arai ..... B65D 19/385 108/53.5
6,402,167 B1 * 6/2002 Calleja ..... B65D 19/44 280/47.35
6,463,863 B1 * 10/2002 Ishikawa ..... B65D 19/385 108/55.1
6,602,032 B2 * 8/2003 Arai ..... B65D 19/385 108/55.3
7,066,342 B2 * 6/2006 Baechle ..... B65D 71/0096 206/600
7,491,024 B2 * 2/2009 Heinrichs ..... B65D 19/12 410/32
7,673,569 B2 * 3/2010 Ishikawa ..... B65D 19/44 108/55.1
7,997,213 B1 * 8/2011 Gauthier ..... B65D 88/022 294/67.1
8,833,573 B2 * 9/2014 Tomaszewski ..... B65D 19/385 206/509
9,227,758 B2 * 1/2016 Maiworm ..... B65D 19/385
10,189,601 B2 * 1/2019 Grutt ..... B65D 19/40
D953,854 S * 6/2022 Yoon ..... D8/403
11,420,790 B2 * 8/2022 Neeld ..... B65D 19/385
2005/0109723 A1 * 5/2005 Czerwinski ..... A47B 47/0083 211/183
2006/0032412 A1 * 2/2006 Harner ..... B65D 19/42 108/55.1
2009/0057191 A1 * 3/2009 Temple, Jr. ..... B65D 19/12 206/600
2011/0303129 A1 * 12/2011 Harris ..... B65D 19/385 108/51.11
2015/0158629 A1 * 6/2015 Harris ..... A47B 87/0215 108/51.11
2016/0257446 A1 * 9/2016 Sperling ..... B65D 19/0026
2016/0264291 A1 * 9/2016 Hansen ..... B65D 19/40
2019/0135487 A1 * 5/2019 Ramon ..... B65D 19/385
2020/0062450 A1 * 2/2020 Rølund ..... B65G 1/04

FOREIGN PATENT DOCUMENTS

JP H0826281 A 1/1996
KR 20060094143 8/2006
NL 7601579 A 8/1997
WO WO9743186 A1 11/1997
WO WO2012062381 5/2012
WO WO-2012062381 A1 * 5/2012 ..... B65D 19/385
WO WO2014013230 A1 1/2014
WO WO-2015180870 A1 * 12/2015 ..... B65D 19/0095
WO WO2017130167 8/2017

* cited by examiner

PALLET BEARING STRUCTURES

The present invention relates to a pallet, and support members therefor.

Pallets for distributing products from one location to another are well known. Such pallets can be provided in a range of sizes. Examples of such pallets may comprise platforms provided with supports, which can include feet or wheels. The wheels may be fixed wheels or swivel wheels, such as swivel caster wheels. Fixed wheels and swivel wheels are incorporated in dollies, which may otherwise be referred to as wheeled pallets.

Pallets, and products stacked on such pallets, are typically transported by road. Pallets with products stacked on them may be referred to as loaded pallets. Typically, loaded pallets are transported in a trailer of a lorry.

Pallets can provide the functionality that, rather than requiring the unloading of products from the pallet, the entire loaded pallet is displayed on a shop floor. As such, a loaded pallet may be moved from the trailer of the lorry directly to the shop floor in order to replenish stock on the shop floor.

In order to improve the efficiency of the transportation of loaded pallets, it is desirable to fill, to the extent possible, the trailer with loaded pallets. However, locating loaded pallets on the shop floor presents certain limitations as to the allowable dimensions of the loaded pallet and, more specifically, the goods forming the loaded pallet. As such, presently, a compromise must be struck between filling the trailer and keeping the loaded pallet to within allowable dimensional limits for placement on the shop floor. A loaded pallet may be limited to between around 800 mm to 1200 mm in height on a shop floor. This may be due to shelving limitations.

There exists a need to overcome one or more of the disadvantages associated with existing pallets.

According to a first aspect of the invention there is provided a pallet comprising:

a deck comprising a product supporting surface and one or more load bearing features;

wherein the one or more load bearing features are configured to receive lateral projections of support members.

The product supporting surface is adapted to receive goods or products thereon. In some arrangements, the product supporting surface is adapter to receive, or configured to receive, other pallets thereon. The product supporting surface may be flat, or substantially flat. However, the product supporting surface may incorporate features to assist in securing the goods or products thereon.

The load bearing features provide an elevated stacking functionality between pallets. Elevated stacking is intended to mean one pallet raised above another pallet, wherein both pallets can be loaded with goods. The load bearing features are features adapted to receive lateral projections. This may be by way of being a recess, or a supporting slot. The product supporting surface is not considered to be a load bearing feature according to the above definition, in that it is not configured to receive a lateral projection of a support member.

The load bearing features being configured to receive lateral projections is advantageous because the support members can be inserted from an edge of the deck. As such, the support members can be inserted both when the pallet is loaded and when the pallet is unloaded with goods. Furthermore, the support members can be removed independently of whether or not the pallets are still loaded with goods.

Recesses, such as upper and lower recesses, and supporting slots, are all examples of load bearing features. Pallet supports, such as feet, wheels and skids, are also examples of load bearing features.

The one or more load bearing features may not always receive lateral projections. For example, the deck corners may comprise two load bearing features each, and only one load bearing feature may receive a lateral projection if the pallet is an upper pallet of an elevated stacked arrangement. The claim language is intended to mean that, in use, at least one of the load bearing features may receive a lateral projection. The load bearing features, or a selection thereof, may receive lateral projections of, specifically, a corner body, the corner body forming part of a support member. As already mentioned, this may mean that a selection of the load bearing features receives one lateral projection per load bearing feature.

Elevated stacking allows loaded pallets to be positioned on top of one another to thereby improve the utilisation of space in the transportation of goods. In particular, space which is otherwise wasted in a trailer of a lorry, for example, may be utilised by elevated stacking a loaded pallet on top of another loaded pallet. This provides the benefit that the dimensions of each individual pallet, with goods loaded thereon, remain unchanged. As such, the pallets with goods loaded thereon, or loaded pallets, can still be placed directly on a shop floor because the loaded pallets remain within the dimensional constraints imposed by their placement on the shop floor. This can be achieved whilst utilising more available space in the trailer of the lorry, thereby increasing the efficiency of the supply chain. Reduced emissions and transports costs are resulting benefits.

As well as the improvement of utilisation of space in transporting goods, the space required for storage of goods when in an elevated stacking arrangement is also reduced. Elevated stacking can allow for twice as many replenishment pallets, for example, to be stored in a given floor space. This reduction of the footprint required for storing the pallets means that less space is required in warehouses, freezers, and other industrial applications where space is at a premium.

The deck may be generally cuboidal and said one or more load bearing features, which are configured to receive the lateral projections of support members, are positioned at each corner of the deck.

Positioning load bearing features in at least four of the corners is advantageous because a load can be transmitted between the at least four corners. That is to say load bearing features in each of the corners may transmit a share of the overall load. The pallet is therefore stronger as a result.

The product supporting surface may be generally rectangular. The deck may comprise two short sides and two long sides. The deck may be generally cuboidal in that the deck is substantially the same outer geometry as the product supporting surface, the deck having a thickness equivalent to a height of the sides of the deck. Corners of the deck may be filleted. That is to say, the corners may be rounded. Load bearing features may be located at each of the four corners of a rectangular deck.

Positioning the load bearing features at each of at least four corners may be beneficial because the corners are accessible. That is to say, the support members may easily be inserted and removed. Positioning the load bearing features at each of at least four corners may also be beneficial because deflection of the deck due to products loaded thereon is reduced in comparison to the load bearing features being positioned, for example, halfway along each of the sides. Reducing deflection of the deck is desirable for reasons of improved strength of the pallet.

In some arrangements, the deck may not be generally cuboidal. That is to say, the deck being cuboidal is an optional feature.

One or more of the one or more load bearing features may be a supporting slot.

The supporting slot is simple to manufacture. The supporting slot also does not affect the geometry of the product supporting surface. That is to say, the supporting slot does not reduce the area available on the product supporting surface for the supporting of products.

The supporting slot may be located in a side wall of the deck, i.e. in a portion of the deck which depends from a periphery of the product supporting surface of the deck. The supporting slot may be at least around 3 mm in depth. Preferably, the supporting slot is around 5 mm in depth. That is to say, the supporting slot may receive a lateral projection which is up to around 5 mm thick. The supporting slot may span a diagonal of a corner of the deck. The supporting slot may define a cavity which is generally triangular. The supporting slots may be at least about 30 mm in height and width (when viewed in plan). Preferably the supporting slots are around 40 mm in height and width. The supporting slot may be said to be letterbox-shaped.

The supporting slot may be defined, at least in part, by two opposing faces. Preferably the supporting slot is defined by two parallel faces. A lowermost face of the supporting slot may be disposed around 25 mm below the product supporting surface, when viewed from the side.

One or more of the one or more load bearing features may be an upper recess.

The upper recess is recessed relative to the product supporting surface. The upper recess therefore provides a surface which can abut, or be abutted by, a lateral projection of a support member.

The upper recess may be recessed by a depth of at least around 1 mm. Preferably the upper recess is recessed by a depth of around 2 mm. The upper recess may be at least around 30 mm in width and height (when viewed in plan). Preferably the upper recess is around 40 mm in width and height.

The upper recess is particularly beneficial for a lower pallet in an elevated stacked arrangement. In particular, the upper recess is particularly well suited to exerting a reaction force in the direction of the upper pallet i.e. upwards. This is due, at least in part, to the upper recess being supported by most of the thickness of the deck beneath it, including the rib structure which runs through the deck.

Each of the corners may comprise the upper recess and each of the corners may further comprise a further load bearing feature in the form of a lower recess.

The lower recess may have the same dimensions as the upper recess. Alternatively, the lower recess may have different dimensions to the upper recess.

The lower recess may be at least around 25 mm in height and width (when viewed in plan). Preferably, the lower recess is around 35 mm in height and width. The lower recess may span a diagonal of the corner. That is to say, the lower recess may be generally triangular. The lower recess may be recessed relative to an underside of the deck by at least around 1 mm. Preferably the lower recess is recessed by around 2 mm.

One or more of the lower recesses may be defined, at least in part, by one or more feet of the pallet. The feet may be configured to support the deck of the pallet so that, in use, the deck is raised from a surface which the feet of the pallet contact. In particular, two of the lower recesses may be defined at least in part by two rear feet of the pallet. A chamfered edge of the foot or feet may define, at least in part, the lower recess.

The lower recess may be wing-shaped. That is to say, the lower recess may be generally triangular and have two end portions which extend outwardly. The end portions increase the surface area available for abutment of, or by, a lateral projection of a support member. The end portions may be around 8 mm by around 13 mm in size.

The lower recess may be said to be in an underside of the deck which opposes the product supporting surface in which the upper recess is located.

Each of the lower recesses may comprise one or more projections which extend therefrom, the one or more projections being configured to engage a corresponding recess of the support member.

The one or more projections may be in the form of pins. The one or more projections may penetrate corresponding recesses, or apertures, in a corner body of the support member, a lateral projection of which is received by the lower recess. The one or more projections may provide location features. The one or more projections may more securely couple the corner body to the pallet. The one or more projections may protrude from the lower recess in a direction which is substantially away from (e.g. perpendicular to) the product supporting surface.

In a preferred arrangement, the lower recess comprises two pins. The two pins may be located in the lower recess. Preferably the pins project in a direction opposite the product supporting surface. The pins may be between around 2 mm and around 10 mm in radius, preferably around 4 mm radius. The pins may be separated by a distance of between around 10 mm and around 40 mm. A separation of the pins, or offset, of around 25 mm is preferred. In preferred arrangements, the pins are received by corresponding recesses, or openings, in a lateral projection of a corner body. The corner body may be a constituent part of a support member. The pins may protrude from the lower recess to an extent that end faces of the pins extend to the same extent as the underside of the deck. In other words, outer ends of the pins may align with or be coplanar with the underside of the deck. The pins preferably extend by at least around 1 mm, preferably around 2 mm. The above features are equally applicable to any geometry of projection, and are therefore not limited to pins.

In some embodiments, the projections may be disposed in a substantially symmetrical arrangement about the corner. That is to say, the projections may be disposed at substantially the same distance from an apex of the corner in a triangular, or arrowhead, arrangement. The projections may otherwise be described as defining vertexes of a right-angled triangle, where the apex of the corner of the pallet forms the third vertex. In such embodiments, the projections may be said to form a pair.

In alternative embodiments, the projections may not be disposed in a symmetrical arrangement. One of the projections may be disposed at, or adjacent to, the apex of the corner. The other of the projections may be offset from the corner. The other of the projections, i.e. the offset projection, is preferably disposed in the same position as the corresponding projection of the triangular arrangement described above. In other words, a corner bracket, or support member, could have a single feature which can engage the offset projection and the corresponding projection of the triangular arrangement. This is desirable for reasons of compatibility.

In preferred embodiments, the lower recess comprises two projections, one in each of two of three possible positions (e.g. vertexes of a right-angled triangle). This allows a corner bracket, or support member, having corresponding projection-receiving features in all three positions to be used with either variant of lower recess. The projection-receiving features may be recesses or openings. The recesses or openings may be disposed in a lateral projection.

Each of the corners may further comprise a tip support.

The tip supports are beneficial because the tip supports form a separate portion of a product supporting surface in the at least four of the corners. This has the effect that the upper recess is in the form of a trench, with one of the sides of the trench being defined by the tip support. The trench may be at least around 10 mm wide, preferably around 14 mm wide. A long side of the trench, when viewed in plan, may be at least around 30 mm, and preferably around 55 mm. Products loaded on the pallet are supported by the tip supports in the outermost points of the corners, which could otherwise sag. The presence of the tip supports therefore means that the risk of products loaded on the product supporting surface sagging, or deflecting excessively, due to the presence of the upper recess is reduced. This is achieved whilst still incorporating the upper recess in the pallet, the upper recess being configured to receive a lateral projection of a support member in an elevated stacked arrangement.

For some POS displays, the corners are the strongest point of the assembly. As such, the tip supports provide a ledge upon which the corners of the display can rest when the POS display is located on the pallet. This means that the display is supported in its strongest region, which improves the overall strength of the POS display on the pallet. Where tip supports are not incorporated, further components or features may otherwise be required to support the corners of the POS display, or goods stacked thereon. Incorporation of the tip supports is therefore preferable for reasons of simpler use, fewer components and likely reduced cost.

The tip support may be around 1.5 mm in height. Said height may be measured relative to a base of the upper recess.

Two or more upper recesses at rear corners may open into cut-outs in the product supporting surface.

The cut-outs may be defined by cavities of feet of the pallet. Alternatively, the cut-outs may be defined by wheel-receiving recesses in the deck, in the case of a dolly. The upper recesses open into cut-outs due to the proximity of the cut-outs to the corners at which the two or more upper recesses are located. For a quarter pallet, each of the two upper recesses nearest the rear feet open into cut-outs defined by the rear feet.

Cut-out is intended to mean a two-dimensional aperture. Cavity is intended to mean a three-dimensional volume. As such, a cut-out which is recessed to a depth may define a cavity.

Each of the lower recesses at the rear corners may comprise a triangular recess defined by an inner face of a lowermost rib of the rear corner and a chamfered edge of one of the respective rear feet.

When the pallet is viewed from underneath, said inner face may define the perpendicular sides of a triangle, whilst the chamfered edge defines the hypotenuse. The lowermost rib may correspond with a lowermost surface of the deck, which traverses the outermost perimeter of an underside of the deck.

Each of the corners may further comprise a slot array.

The slot array may be located in a side wall of the deck, i.e. in a portion of the deck which depends from a periphery of the product supporting surface of the deck. The slot array comprises one or more slots. The slots may be shallow slots. The shallow slots are so called because they are not intended to be load bearing, and they are dimensionally smaller than a supporting slot. The shallow slots may assist in locating the support member. This may be achieved by the one or more shallow slots receiving a locating projection therein. The locating projection is not load bearing per se, but is instead intended to assist in the alignment of the support member, or lateral projection forming part of the support member, into the corresponding load bearing features. Alternatively, the shallow slots may be used as gripping features for, for example, securing a wrapping film to the pallet.

The supporting slot is larger than the shallow slots.

The supporting slots of at least two rear corners may open into cavities defined by two rear feet.

The supporting slots may open into the cavities via an orifice. As such, each of one or more supporting slots may open into respective cavities via an orifice. The orifice may be letterbox-shaped. In other words, the orifice may be generally rectangular in geometry. The orifice may be penetrable by a lateral projection. The orifice may therefore further stabilise the lateral projection received in the respective supporting slot.

The pallet may be a fractional pallet. The pallet may be a half pallet. The pallet may be a quarter pallet. The pallet may be a dolly. The dolly may be a quarter dolly.

According to a second aspect of the invention there is provided an adjustable elevated stacking pallet support member, the support member comprising:

a first portion and a second portion;

the first and second portions each comprising one or more lateral projections projecting therefrom; and wherein the first portion and second portion each comprise a respective coupling portion, the coupling portions being couplable at a plurality of different relative positions, each different relative position resulting in a different separation between the one or more lateral projections of the first portion and the one or more lateral projections of the second portion.

The adjustable support member is advantageous because it can be used in the elevated stacking of pallets.

The adjustability of the support member (which may also be referred to as adjusting the length of the support member or adjusting the separation between the one or more lateral projections of the first portion and the one or more lateral projections of the second portion) is advantageous because it can be used in the elevated stacking of a range of different pallet and product combinations. For example, for products which are taller, the support member can be extended to ensure an upper pallet does not damage the products at the top of the lower, loaded pallet.

The adjustability of the support member is also beneficial because, when not in use, the support member can be reduced in size. The support member will therefore occupy less space in, for example, a trailer of a lorry. This is particularly beneficial for a pooled solution, whereby the adjustable support member may be transported and reused with the same pallet, or a different pallet.

The lateral projections are receivable by load bearing features of a pallet. The lateral projections allow the adjustable support member to be inserted laterally. As such, the support member can be inserted into a pallet which is already loaded with products. The support member can also therefore also be removed laterally.

The adjustable support members offer a low cost, simple solution to elevated stacking of pallets. There are few moving parts and the adjustable support member is entirely passive in operation.

Couplable is intended to mean that the first and second portions can be temporarily fixed in position relative to one another, secured, and then adjusted if desired. The first and second portions may be couplable by a variety of means including, but not limited to, a slot and pin arrangement, a locking pin arrangement, and a screw arrangement.

The first and second portions may be directly couplable to one another. For example the first portion may be in contact with the second portion. However, an interposing body may be present between the first and second portions, such that the first and second portions are still couplable at a plurality of different positions, but that the first and second portions are not directly couplable to one another. Put another way, the first and second portions are adjustable relative to one another. Alternatively, the first and second portions are vertically offsetable relative to one another. The interposing body may be an upright portion. The first and second portions may be couplable directly to the upright portion. The position at which the first and second portions couple to the upright portion may give rise to the relative adjustability between the first and second portions.

The first and second portions may be manufactured from cardboard, plastic or metal. The cardboard may be reinforced cardboard, such as corrugated cardboard. Where manufactured from metal, the first and second portions may be manufactured from aluminium. The first and second portions may comprise a number of different materials. For example, the lateral projections may be plastic whilst the rest of the portion is reinforced cardboard. Cardboard may offer low cost, low weight and recyclability, which are all beneficial characteristics. Plastic may offer similar characteristics, as well as durability. Metal may offer improved strength and durability.

One or more of the one or more lateral projections may extend along a length of either of the first and second portions. One or more of the one or more lateral projections may project from either of the first and second portions.

Either or both of the first and second portions may be elongate.

The first and second portions may be angular portions.

Angular portions is intended to mean that the first and second portions resemble an L-shape in cross-section (i.e. along their length). In other words, the first and second portions are formed at least in part from angle beam (when manufactured from metal). The angle beam may be formed by, for example, taking a metal plate and bending half of the plate such that it is perpendicular to the non-bent half. L-shaped is intended to mean that two sides meet at a right angle. L-shaped is not intended to mean that one side is longer than the other. However, in practice, this may be the case.

Angular portions are advantageous because they have desirable load bearing characteristics. This is due in part to a favourable second moment of area. Due to the angled nature of the angular portions, the likelihood of the angular portions buckling is reduced.

A further advantage of the first and second portions being angular portions is that they can fit neatly within one another. A further still advantage of the first and second portions being angular portions is that they can surround the corners of the pallet. The adjustable support member therefore does not excessively increase a footprint of an elevated stacked arrangement of pallets when in use, when the first and second portions are angular portions. By surrounding the corners of the pallet the angular portions may protect the corners of the pallet and any goods supported by the lower pallet. Angular portions are also readily available as standard metal beams, and so it is not difficult to obtain stock.

The one or more lateral projections may span at least some of an included area of the respective first or second portion of which the one or more lateral projections form part.

Included area is intended to mean the area between internal faces of the angular portion. For example, where the angular portion is generally perpendicular, the included area would be the triangle defined between the two internal faces of the portion.

By spanning at least some of an included area of the respective portion, the lateral projection defines a shelf in the respective portion.

In some arrangements, the lateral projection may not extend beyond an included area. In such arrangements, the lateral projection will not increase the overall cross-sectional area of the portion, making it easier to store and transport the support member.

One or more of the one or more lateral projections may be generally triangular.

The lateral projections being generally triangular permits the largest possible surface area for the lateral projections whilst remaining within the included angle of the angular portions. As such, the load which can be transmitted by the lateral projections will be increased.

The lateral projections being generally triangular also allows the lateral projections to be attached to the angular portions along two edges, or portions thereof, further increasing the load which can be transmitted by the lateral projections.

Optionally, the generally triangular projections may be of the form of a triangle with a recessed portion along part of the hypotenuse. That is to say, the projection may be wing-like in geometry. In other words, part of the hypotenuse of the triangle may be closer to the generally right angled corner than the rest of the hypotenuse. The recessed portion may allow the adjustable support member to more closely abut a corner of the pallet whilst avoiding clashing, for example, a foot of the pallet.

One or more of the one or more lateral projections may be of the form of a strap.

Strap is intended to mean a diagonal portion. The strap defines a triangular area between the first or second portion of which it forms part and a portion-facing edge of the strap. That is to say, the strap can be received by a trench, such as that disclosed in connection with the third embodiment of the first aspect of the invention. The strap geometry, specifically the triangular area, or cavity, which it defines, allows a projecting body, such as a tip support, to be received therein.

One or more of the first and second portions may comprise a plurality of lateral projections.

The plurality of lateral projections being present means that the angular portion engages multiple load bearing features. As such, the stability of an elevated stacked arrangement is improved. The plurality of lateral projections may also improve the stress distribution in the pallet corner by spreading the load across multiple load bearing features or surface, instead of concentrating the load through only one load bearing feature or surface.

The coupling portions of the first and second portions may comprise a slotted guide and pin.

The slotted guide and pin is a simple mechanism for providing adjustability of the support member. A slot and pin constituting the slotted guide and pin may form part of either of the first and second portions.

The coupling portions of the first and second portions may comprise hooks and grabs or, more broadly, projections and apertures.

The coupling portions of the first and second portions may comprise one or more locking pins.

The one or more locking pins may pass through aligned apertures of both the first and second portions to couple the first and second portions relative to one another and thereby fix the height of the adjustable support member (i.e. the separation between the one or more lateral projections of the first portion and the one or more lateral projections of the second portion).

The support member may extends along a longitudinal axis and the distance between opposing faces of the longitudinally innermost lateral projection of the first and the longitudinally innermost lateral projection of the second portion is adjustable within a range of between around 400 mm to around 1400 mm.

Preferably the distance between opposing faces of the lateral projections is adjustable within a range of between around 400 mm to around 1200 mm.

The first and second portions may be made of one or more of plastic, aluminium or steel.

Plastic, aluminium and steel are readily available, recyclable and low cost materials.

According to a third aspect of the invention there is provided a combination of:

- two adjustable support members according to the second aspect of the invention; and
- first and second support bodies, each comprising a first end and a second end; wherein
- the first portions of the adjustable support members are disposed at each of the first and second ends of the first support body; and wherein
- the second portions of the adjustable support members are disposed at each of the first and second ends of the second support body.

The first portions may be integrally formed at ends of the first support body. The second portions may be integrally formed at ends of the second support body. Ends may mean absolute ends, or end or portions. For example, if the support bodies are 'C' or 'U' shaped when viewed in plan, the lateral projections may be disposed at the internal corners.

Two such combinations defined above may form a framework for an elevated stacking arrangement. That is to say, the combination defined above may form one side of a two-sided framework. The two sides may be connected together by way of a plurality of side supports. The side supports may otherwise be referred to as crossbeams or tie-bars.

In some interpretations, a combination of an upright, or upright portion, and a first end of the first support body may be said to constitute a first portion. In some interpretations, a first end of the second support body may be said to constitute a second portion.

In some embodiments, an upright, or upright portion, may interpose respective first and second portions. That is to say, the first and second portions may connect, directly or indirectly, to the upright. The connection may be via the respective support bodies. The connection between support body and upright may be by way of hooks and grabs. For example, hooks or other projections in the support body may engage apertures in the upright. The hooks may be upwardly or downwardly facing, depending upon their function. For example, outer corner hooks of the first support body, which engage apertures in a base portion of the upright, and thereby support the upright, may be upwardly facing. The outer corner hooks are thereby able to exert an upwards, supporting force to secure the upright. The inner corner hooks of the second support body, which engage apertures in the non-base portion of the upright, may be downwardly facing. The inner corner hooks are thereby able to exert a downwards, securing force which locks the upper pallet in position.

The first and second support bodies may further comprise at least one laterally projecting tab, the at least one laterally projecting tab being configured to abut a deck of a pallet.

In an alternative embodiment, only one of the first and second support bodies may comprise at least one laterally projecting tab. The abutment of the deck of a pallet may mean that the tab abuts a product supporting surface, or an underside of the deck, to name two specific examples. The tab may be integrally formed with the support body, or may be a separate component connected thereto.

The first support body may comprise a plurality of laterally projecting tabs, the plurality of laterally projecting tabs being configured to abut a product supporting surface of the deck.

The above arrangement is particularly useful for a lower pallet of an elevated stacked arrangement. Alternatively, the first support body may comprise a single laterally projecting tab. Said tab may either abut a product supporting surface, or an underside, of a deck of a pallet.

The second support body may comprise a single laterally projecting tab, the single laterally projecting tab being configured to abut an underside of the deck.

The above arrangement is particularly useful for an upper pallet of an elevated stacked arrangement. Alternatively, the second support body may comprise a plurality of laterally projecting tabs. Said tabs may either abut a product supporting surface, or an underside, or a deck of a pallet.

According to a fourth aspect of the invention there is provided a laterally insertable elevated stacking pallet support member corner body, the corner body comprising:

- one or more lateral projections; and
- a receiving portion configured to receive an end portion of an elongate member.

Laterally insertable corner body is intended to mean a corner body which can be inserted from the side. In other words, the laterally insertable corner body can be inserted in a direction generally parallel to a product supporting surface of a pallet. Some rotation, manipulation or pivoting of the corner body may be required for the one or more lateral projections to be received by load bearing features of a pallet. The laterally insertable corner body may otherwise be referred to as an externally insertable corner body. That is to say, the laterally insertable corner body may be inserted when a pallet is already loaded with goods or products.

The one or more lateral projections are configured to be received by load bearing features of a pallet. In practice, and in some orientations, this may mean that not all load bearing features each receive a lateral projection. For example, only some of the load bearing features, maybe one, may receive a lateral projection. This is with particular relevance to an upper pallet of an elevated stacked arrangement.

A combination of two laterally insertable corner bodies, each of which having an end of the same elongate member received therein, can be said to constitute a support member. The support member may facilitate the elevated stacking of two pallets.

End portion may otherwise be referred to as an end. In other words, a portion of the elongate member, in the vicinity of an end of the elongate member, is configured to be received by the receiving portion.

One or more of the one or more lateral projections may be generally triangular.

Preferably the generally triangular projection is not disposed at an extreme, or outer, end of the laterally insertable corner body. As a result, a wall of material exists around two sides of the generally triangular projection. The wall can be abutted by a load bearing feature or, more generally, a corner of the pallet, to better secure an elevated stacked pallet. Furthermore, the wall may merge with a tapering portion, or a second region, which forms a funnel of sorts. The tapering portion acts as a guide, and may align the laterally insertable corner body with the corner of the pallet in use.

Optionally, the generally triangular projections may be of the form of a triangle with a recessed portion along part of the hypotenuse. That is to say, the projection may be wing-like in geometry. In other words, part of the hypotenuse of the triangle may be closer to the right angled corner than the rest of the hypotenuse. Put another way, two portions may extend from a generally triangular main section.

A generally triangular lateral projection may be referred to as a first lateral projection. When the laterally insertable corner body is in a first orientation, the first lateral projection may be received by a supporting slot of a pallet. When the laterally insertable corner body is in a second orientation, the first lateral projection may be received by a lower recess of a pallet. In use, the first orientation corresponds with the corner body attaching to a lower pallet of an elevated stacked arrangement. The second orientation corresponds with the corner body attaching to an upper pallet of an elevated stacked arrangement. In other words, the corner body may be said to be reversible. The corner body can therefore be used in combination with either of a lower of upper pallet in an elevated stacked arrangement.

The first lateral projection may be at least around 2 mm thick. Preferably the first lateral projection is at least around 3 mm thick. The first lateral projection may be around 4 mm thick.

One or more of the one or more lateral projections may be of the form of a strap.

Strap is intended to mean a diagonal portion. The strap defines a triangular area, or cavity, between an internal corner of the corner body and a body-facing edge of the strap. That is to say, the strap can be received by a trench, such as that disclosed in connection with the third embodiment of the first aspect of the invention. The strap geometry, specifically the triangular area which it defines, allows a projecting body, such as a tip support, to be received in the triangular area. This can provide the functionality that goods or products loaded on the product supporting surface "lock" the strap in position. This is due to the goods or products being disposed above, and covering, the trench in which the strap is received. The goods or products can therefore be said to form a lid, or covering, of the trench. This more securely retains the strap in position, which in turn more securely retains the laterally insertable corner body, or support member which it constitutes.

When viewed from above, a height of the triangular cavity defined by the second lateral projection may be at least around 10 mm, preferably around 14 mm. In this instance, height refers to the distance between the midpoint of the hypotenuse and the opposing corner. In other words, a height of a right-angled triangle when resting on its hypotenuse.

A strap, or strap-like projection, may be referred to as a second lateral projection. The second lateral projection may only be received by an upper recess of a pallet when the corner body is attached to a lower pallet of an elevated stacked arrangement. When the corner body is attached to an upper pallet of an elevated stacked arrangement, the second lateral projection may not provide any functional effect with respect to the load bearing features of the pallet.

Supporting ribs may interpose the strap and an internal face of the corner body to which the strap is connected. As such, the face, supporting rib and strap form a shelf of sorts. The supporting ribs increase the load which the strap can support, owing to the extra material in a region where the strap is connected to the internal face.

The second lateral projection may be at least around 1.5 mm thick. Preferably the second lateral projection is around 2.5 mm thick, and more preferably around 4 mm thick. The thickness is measured in a direction generally parallel to the longitudinal axis of the elongate member when inserted. The second lateral projection may be sized to be received in, or by, a trench. For example, when viewed in plan the second lateral projection may be less than around 14 mm wide, for example around 13.5 mm wide.

The laterally insertable corner body may comprise one generally triangular lateral projection and one strap.

A vertical offset of around 20 mm between opposing faces of the generally triangular lateral projection and the strap may be present. In other words, opposing faces of the first and second lateral projections may be separated by a distance of at least 10 mm, preferably around 20 mm.

The receiving portion may be a slot.

The slot may otherwise be referred to as an L-shaped cavity. The slot receives, and thereby guides, the end portion of the elongate member.

The slot may comprise a plurality of ribs, or other projections. These features are configured to grip, or retain, the elongate member therein. In other words, the inserted portion of the elongate member may be engaged by a plurality of ribs, or other projections, disposed in the slot. This may assist in more securely retaining the elongate member in the slot, thereby improving the structural integrity of the overall support member. The depth of the slot may be at least around 20 mm, and is preferably around 23 mm or 27 mm.

The laterally insertable corner body may be formed of two edge sections, a first edge section and a second edge section, which are approximately perpendicular to one another.

Approximately perpendicular is intended to mean substantially perpendicular. In other words, the first and second edge sections define an overall geometry which generally allows the corner body to conform to a corner of the pallet.

The edge sections may otherwise be referred to as edge bodies, or edge portions.

The one or more lateral projections may span at least some of an included area between the first and second edge sections.

Included area is intended to mean the area between internal faces of the edge sections. For example, where the edge sections are generally perpendicular, the included area would be the triangle defined by edges along the two internal faces of the edge sections, and between end points of the edge sections. Defined another way, the included area is the geometry which, when viewed from above, would still remain within a footprint of the corner body.

The one or more lateral projections may span the whole included area.

In other words, the one or more lateral projections may be triangular, or generally triangular.

The first and second edge sections may have a constant, or substantially constant thickness in a first region, and a variable thickness in a second region.

The variable thickness may be tapering. That is to say, the second region may be referred to as a tapering portion. One end of the laterally insertable corner body may therefore be narrower than the other.

The second region may comprise ribs. The ribs may be reinforcing so as to improve the structural rigidity of the laterally insertable corner body. The ribs may be generally triangular. An outer end of the ribs may join the narrow tip mentioned above.

The ribs may be around 2 mm in thickness. The thickness is measured in a direction generally parallel to the longitudinal axis of the elongate member when inserted.

The laterally insertable corner body may be manufactured from metal or plastic.

The laterally insertable corner body may be between about 35 mm and about 75 mm in width and length.

Preferably the laterally insertable corner body is about 55 mm in width and length. In other words, when viewed from above, the laterally corner body would fit within a square having dimensions of about 55 mm by about 55 mm.

Preferably the laterally insertable corner body is between about 20 mm and about 60 mm in height, and more preferably about 40 mm in height. In alternative embodiments, the laterally insertable corner body is between about 20 mm and about 100 mm in height, and more preferably around 65 mm in height.

According to a fifth aspect of the invention there is provided a laterally insertable elevated stacking pallet support member, the laterally insertable support member comprising:

an elongate member comprising a first end portion and a second end portion; and first and second laterally insertable corner bodies according to the fourth aspect of the invention; wherein the first and second end portions are received in the receiving portions of the first and second laterally insertable corner bodies respectively.

The elongate member is longer in one direction. As such, the elongate member is an elongate body. Said longer direction may be said to be the longitudinal direction or longitudinal axis of the elongate member.

The first and second end portions are intended to mean portions at either end of the elongate member.

The elongate member may be made from cardboard. The elongate member may be made from reinforced corrugated cardboard.

The elongate member may be L-shaped in cross-section.

L-shaped is intended to mean an angular portion. That is to say, the cross-section taken normal to a longitudinal axis defines two perpendicular, or generally perpendicular, edges or sections.

According to a sixth aspect of the invention there is provided an elevated stacked pallet arrangement comprising:

first and second pallets according to the first aspect of the invention, the second pallet being elevated relative to the first pallet;

a plurality of support members according to either of the second or fifth aspects of the invention, the lateral projections of the plurality of support members being received by the load bearing features of the first and second pallets.

In some arrangements, the support members may engage one or more pallet supports of the second pallet. Pallet supports may refer to feet, wheels or skids. Pallet supports are examples of load bearing features. Skids are therefore examples of load bearing features. In a preferred arrangement, the support members engage load bearing features of the first pallet and pallet supports of the second pallet. All, or only some, pallet supports may be engaged by the support members. The above arrangements are particularly preferable where the pallets are half pallets. The half pallets may have a plurality of skids, preferably three skids. The skids may attach to the deck.

In preferred embodiments, a lateral projection may be abutted by the pallet support. Specifically, the lateral projection may be abutted by an underside of the pallet support. The pallet support may be a skid of the second pallet. Where the lateral projection is abutted by an underside of the skid, further securing means may be used to secure the second pallet in the elevated stacked arrangement. Said securing means may include one or more of a band and a film.

References to the support members being received by load bearing features of the pallets may specifically refer to lateral projections of the support members being received by, or engaging, load bearing features of the pallets.

Engagement is intended to encompass one or more of abutment, contact, retention and restraint.

All of the load bearing features of the first and second pallets may receive lateral projections.

According to a seventh aspect of the invention there is provided an elevated stacked pallet arrangement comprising:

a first loaded pallet comprising a deck, and products being supported by the deck;

a second loaded pallet comprising a deck, and products being supported by the deck;

a plurality of support members extending between the deck of the first pallet and the deck of the second pallet to elevate the second loaded pallet relative to the first loaded pallet, the first and second loaded pallets thereby forming an elevated stacked arrangement.

One or more of a strap and a film may secure the plurality of support members around at least one of the loaded pallets.

According to an eighth aspect of the invention there is provided a method of elevated stacking first and second pallets, each of the first and second pallets comprising a deck;

wherein the method comprises the steps of:

raising the second pallet above the first pallet; and inserting a plurality of support members such that they each engage both the deck of the first pallet and the deck of the second pallet.

The plurality of support members may be inserted laterally.

One or more lateral projections of the support members may be received by a respective supporting slot of the first and/or second pallets. The supporting slot may be disposed in a side wall of the pallet. There may be a supporting slot disposed at each of four corners of the deck. Where one or more lateral projections are received by a supporting slot, the one or more lateral projections may be said to be received in the deck.

The method may further comprise the step of securing the plurality of support members to the first and/or second pallets.

Securing the plurality of support members may comprise securing one or more of a strap and a film around the plurality of support members.

The strap or straps may be adjustable, such as ratchet straps. Alternatively, the strap or straps may be elasticated. For example, rubber bands or bungee cord may be used.

The film may be a plastic film, such as linear low-density polyethylene (LLDPE). One or multiple straps may be used. One or more straps may be used in combination with the film.

The first and second pallets may each comprise an upper recess in at least four respective corners; and wherein inserting the plurality of support members may further comprise the step of lateral projections of the plurality of support members being received by the upper recesses of the first pallet.

The first and second pallets may each comprise a lower recess in the at least four respective corners; and wherein inserting the plurality of support members may further comprise the step of lateral projections of the plurality of support members being received by the lower recess of the second pallet.

The at least four corners of each of the first and second pallets may further comprise a supporting slot; and wherein inserting the plurality of support members may further comprise the step of the lateral projections of the plurality of support members being received by the supporting slots of the first pallet.

The at least four corners of each of the first and second pallets may further comprise a supporting slot; and wherein inserting the plurality of support members may further comprise the step of lateral projections of the plurality of support members being received by the supporting slots of the second pallet.

According to a ninth aspect of the invention there is provided a pallet comprising:

a deck comprising a product supporting surface and a retention structure configured to retain an electronic device.

The electronic device may be any one of a number of different electronic devices. For example, RFID tags or other tracking devices may be used.

The retention structure is advantageous because the electronic device can be safely and securely attached, or secured, to or within the pallet. This means that the electronic device can be added in a subsequent manufacturing step after the pallet has been manufactured.

The retention structure may comprise one or more retaining members.

The one or more retaining members may assist in aligning the electronic device in a direction parallel to long sides of the pallet. The one or more retaining members may assist in aligning the electronic device in a direction normal to the product supporting surface. The one or more retaining members may retain the electronic device.

The one or more retaining members may be biased toward a retaining configuration.

The retaining members being biased toward a retaining configuration leads to easier insertion of the electronic device by a user. For example, a user can push the electronic device into the retention structure, and due to the biased nature of the retention structure the electronic device is then secured therein.

The retaining members may be clips.

Clips are intended to mean a feature with a hooked portion. The hooked portion is configured to cooperate with the electronic device to retain, and possibly align, the electronic device. The clips may incorporate an elongate portion, or stem, which facilitates the flexing of the clip. This leads to easier insertion of the electronic device by a user.

Clips are advantageous for tool-free insertion of the electronic device. Furthermore, clips are simple and low cost features to manufacture. Clips also provide a positive feedback to the user once the electronic device is correctly inserted in position.

The clips may extend from an underside opposing the product supporting surface.

The opposing underside provides a plurality of surfaces which cannot be utilised for the supporting of products. As such, by having the clips or, more broadly, retaining members, extend from the opposing underside, some functionality or use can be derived from an otherwise potentially wasted space. Furthermore, by having the clips or, more broadly, retaining members extend from the opposing underside, the electronic device may be at least partly protected from damage, owing to the surrounding structure of the deck.

The deck may further comprise one or more alignment bodies configured to align the electronic device.

The one or more alignment bodies are useful because they assist in the alignment of the electronic device. This reduces the likelihood of human error, or some other issue, affecting the alignment of the electronic device. The one or more alignment bodies may cooperate with the one or more retaining members to provide multi-directional alignment of the electronic device. For example, in isolation the one or more alignment bodies may assist in alignment of the electronic device in a direction parallel to a short side of the pallet. The one or more alignment bodies in combination with the one or more retaining members may align the electronic device in a direction parallel to a short side of the pallet, parallel to a long side of the pallet, and normal to the product supporting surface (i.e. multi-directional alignment).

The one or more alignment bodies may be projections.

The projection(s) may be elongate. That is to say, they may be longer in one direction than the others. The projection(s) may be constant have a constant height (i.e. distance by which they project). Alternatively, the projection(s) may have a variable height. The projection(s) may incorporate end stops. The end stops may be configured to limit the travel of the electronic device. The end stops may therefore assist in alignment and retention of the electronic device.

The deck may further comprise a plurality of ribs disposed beneath the product supporting surface, and the projections extend from one or more of the ribs.

Having the projections extend from one or more of the ribs is advantageous because the ribs are already present to reinforce the product supporting surface. Required design changes are therefore reduced accordingly.

The deck may be defined by four sides, which extend from the product supporting surface; and wherein the retention structure may be positioned to align a surface of the electronic device with an aperture in one of the sides of the deck when the electronic device is retained by the retention structure.

The aforementioned alignment is beneficial because the electronic device can be viewed from the side of the pallet. A user can therefore see whether the electronic device is present. Furthermore, if the electronic device incorporates information, or identification, such as a QR code, said information or identification can be read or scanned from the side of the pallet.

The retention structure may be accessible from underneath the deck, the electronic device thereby being insertable from underneath the deck.

The deck may further comprises a second retention structure configured to retain a second electronic device.

Having a greater number of electronic devices, if the electronic devices are the same, is useful for reasons of improved access or detectability by both a user and machinery.

According to a tenth aspect of the invention there is provided a combination of:

a pallet according to the ninth aspect of the invention; and an electronic device; wherein the electronic device is retained by the retention structure of the pallet.

According to an eleventh aspect of the invention there is provided a detachable enclosure for a pallet, the detachable enclosure comprising:

a retention mechanism configured to releasably connect the detachable enclosure to a pallet; wherein the detachable enclosure is configured to house a component.

The detachable enclosure is for use with a pallet. The detachable enclosure is so called because it can be detached, if and when required, from the pallet. This provides the functionality that, among other things, the component housed therein can be accessed more easily, and independently of the pallet.

The retention mechanism being configured to releasably connect the detachable enclosure to a pallet is intended to mean that the same detachable enclosure can be connected, disconnected and then reconnected to the pallet. That is to say, the detachable enclosure can be reused.

The detachable enclosure being configured to house the component is intended to mean the detachable enclosure substantially surrounds the component. In some embodiments the detachable enclosure may be waterproof such that the component is protected from the ingress of moisture and other contaminants. The detachable enclosure may also offer protection to the component from external impacts.

The component may be, or include, an electronic device. The electronic device may include one or more of a sensor arrangement, an RFID tag or other device which provides some useful functionality in combination with a pallet. The component may be a component which is damaged by water, or moisture, exposure. Further examples of a component include a PCB and batteries.

The detachable enclosure may be plastic. The detachable enclosure may be manufactured from one or more of polypropylene, polystyrene, polyethylene or some other variety of thermoplastic.

The detachable enclosure may further comprise:

a first portion; and a second portion; wherein the first portion and second portion are separable to provide access to the component.

The first portion may be a base. The second portion may be a lid.

The first and second portions form the detachable enclosure. The combination of the first and second portions may form a waterproof detachable enclosure.

The component(s) may be mounted to, or secured to, either or both of the first and second portions.

The first and second portions may be secured to one another by an interference fit, clips or fasteners, such as screws. Other methods of securing the first and second portions include using adhesive, plastic welding, the use of pressure or any other method to connect plastic components.

The first portion may be configured to abut an underside of the pallet; and the second portion comprises the retention mechanism; and wherein the first portion is configured to be secured against the pallet by the second portion.

The first portion may be configured to entirely, or partially, abut an underside of the pallet. The underside is intended to refer to an underside which opposes a product supporting surface. In other embodiments, the first portion may not contact the pallet, specifically the underside of the product supporting surface thereof. In such instances, the first portion may be said to be secured to the pallet by the second portion, instead of being secured against the pallet by the second portion.

The first portion is thereby sandwiched, in use, between the pallet and the second portion. This is advantageous because the first portion need not be secured to either of the pallet or the second portion. Instead, with the first portion positioned against the pallet, when the second portion is combined with the first portion (i.e. to at least substantially seal the enclosure), the retention mechanism secures both the first and second portions in place. This means that both the first and second portions can be removed upon the release of the retention mechanism. This reduces the number of operations otherwise required to access the component.

The second portion may comprise one or more gripping members, or tabs, by which a user can hold the second portion.

In preferred arrangements, the first and second portions are secured to one another before the detachable enclosure is connected to the pallet. Similarly, in preferred arrangements, the detachable enclosure is disconnected from the pallet as a single body. That is to say, the first and second portions may remain secured to one another irrespective of whether or not the detachable enclosure is connected to, or disconnected from, the pallet.

The retention mechanism may comprise a plurality of clips.

The clips may comprise an abutment and a release tab.

The clips may be disposed at recessed ends of the second portion.

The clips being disposed at recessed ends means that a footprint, or outer geometry, of the second portion can be made smaller.

The detachable enclosure may be waterproof.

This is advantageous because the component is protected from the ingress of water or moisture. This may be particularly relevant for electronic components, or other sensitive components.

The detachable enclosure may have two planes of symmetry.

Multiple planes of symmetry allows the detachable enclosure to be used in two different orientations. As a result, insertion and removal is faster and less prone to alignment error.

According to a twelfth aspect of the invention there is provided a combination of:

a pallet; and the detachable enclosure of the eleventh aspect of the invention, wherein the detachable enclosure is releasably connected to the pallet.

According to a thirteenth aspect of the invention there is provided a pallet comprising:

a deck comprising a product supporting surface and a plurality of ribs which span, at least in part, an opposing underside of the product supporting surface; wherein the plurality of ribs comprises one or more apertures configured to be engaged by a retention mechanism, or a part thereof, of a detachable enclosure.

According to a fourteenth aspect of the invention there is provided a combination of:

a pallet according to the thirteenth aspect of the invention; and a detachable enclosure according to the eleventh aspect of the invention; wherein the retention mechanism of the detachable enclosure engages the one or more apertures to releasably connect the detachable enclosure to the pallet.

According to a first arrangement there is provided a pallet comprising:

a deck comprising a product supporting surface and at least one retention structure configured to retain an electronic device, the deck further comprising a plurality of ribs which span, at least in part, an opposing underside of the product supporting surface; wherein the plurality of ribs comprises one or more apertures configured to be engaged by a retention mechanism, or a part thereof, of a detachable enclosure.

There may be two or more retention structures. The retention structures may be disposed along long sides of the deck. The retention structures may be disposed along opposing long sides of the deck.

Also disclosed is a combination of:

a pallet according to the first arrangement;

an electronic device retained by the at least one retention structure; and a detachable enclosure according to the eleventh aspect of the invention, wherein the retention mechanism of the detachable enclosure engages the one or more apertures to releasably connect the detachable enclosure to the pallet.

Preferably there are two retention structures.

According to a fifteenth aspect of the invention there is provided a method of elevated stacking first and second pallets, each of the first and second pallets comprising a deck and pallet supports attached to the deck, the deck comprising one or more load bearing features;

wherein the method comprises the steps of:

raising the second pallet above the first pallet; and inserting a plurality of support members such that they each engage the one or more load bearing features in the deck of the first pallet and the pallet supports of the second pallet.

Pallet supports may be feet, skids or wheels. The method is preferably used in combination with pallets having skids as pallet supports.

In some embodiments, it may be lateral projections of the support members which engage the one or more load bearing features of the first pallet and/or the pallet supports of the second pallet. The one or more load bearing features of the first pallet may be an upper recess and a lower recess. Alternatively, the one or more load bearing features of the first pallet may be an upper recess and a supporting slot. The one or more load bearing features may be disposed at each corner of the first pallet.

Any optional features and advantages disclosed in connection with the eighth aspect of the invention are also applicable to the fifteenth aspect of the invention. The method according to the eighth aspect of the invention is particularly suited for use with quarter size pallets (otherwise referred to as quarter pallets), whilst the method according to the fifteenth aspect of the invention is particularly suited for use with half size pallets (otherwise referred to as half pallets).

The plurality of support members may be inserted laterally.

The support members may engage all of the pallet supports of the second pallet.

The first and second pallets may be fractional pallets.

The first and second pallets may be half pallets.

The first and second pallets may be half pallets.

According to a sixteenth aspect of the invention there is provided an elevated stacked pallet arrangement comprising:

first and second pallets, each of the first and second pallets comprising a deck and pallet supports attached to the deck, the decks each comprising one or more load bearing features; and a plurality of support members each comprising one or more lateral projections;

wherein the one or more lateral projections of the plurality of support members are received by the one or more load bearing features of the first pallet and the pallet supports of the second pallet to elevate the second pallet relative to the first pallet.

Embodiments of the present invention will now be described, by way of example only, with reference to the accompanying figures in which.

Figure 4:
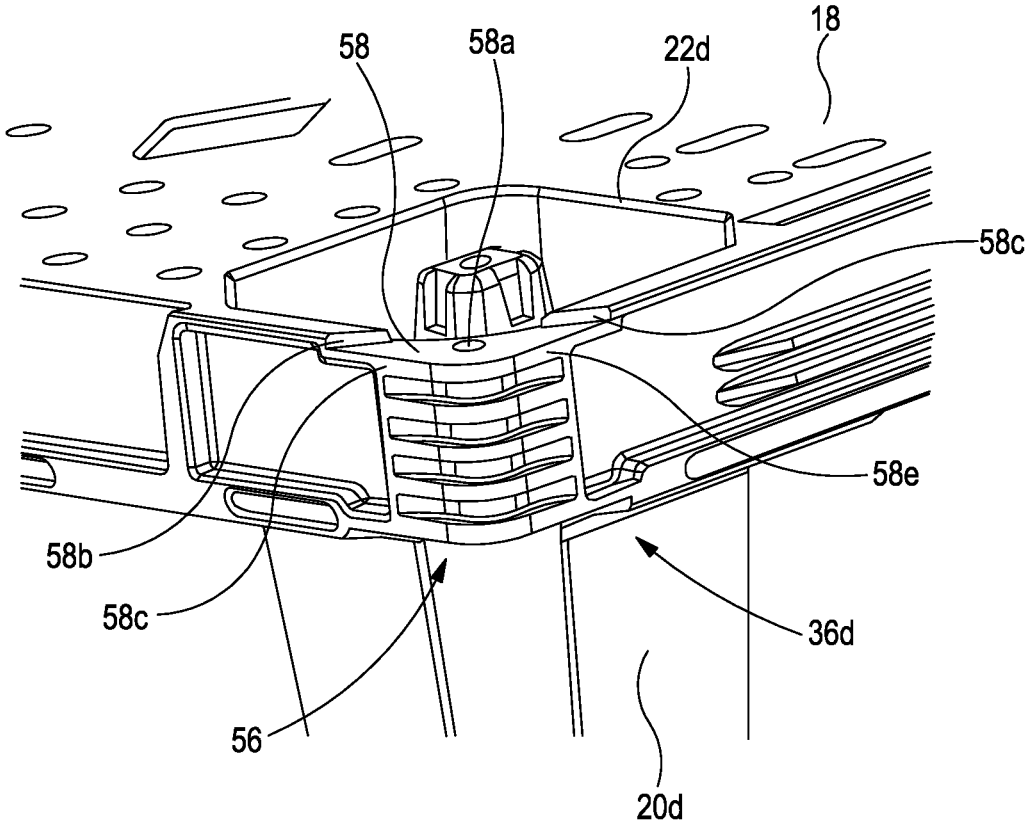
FIG. 4 is a close-up perspective view of a rear corner of the quarter pallet of FIG. 2.
Figure 5:
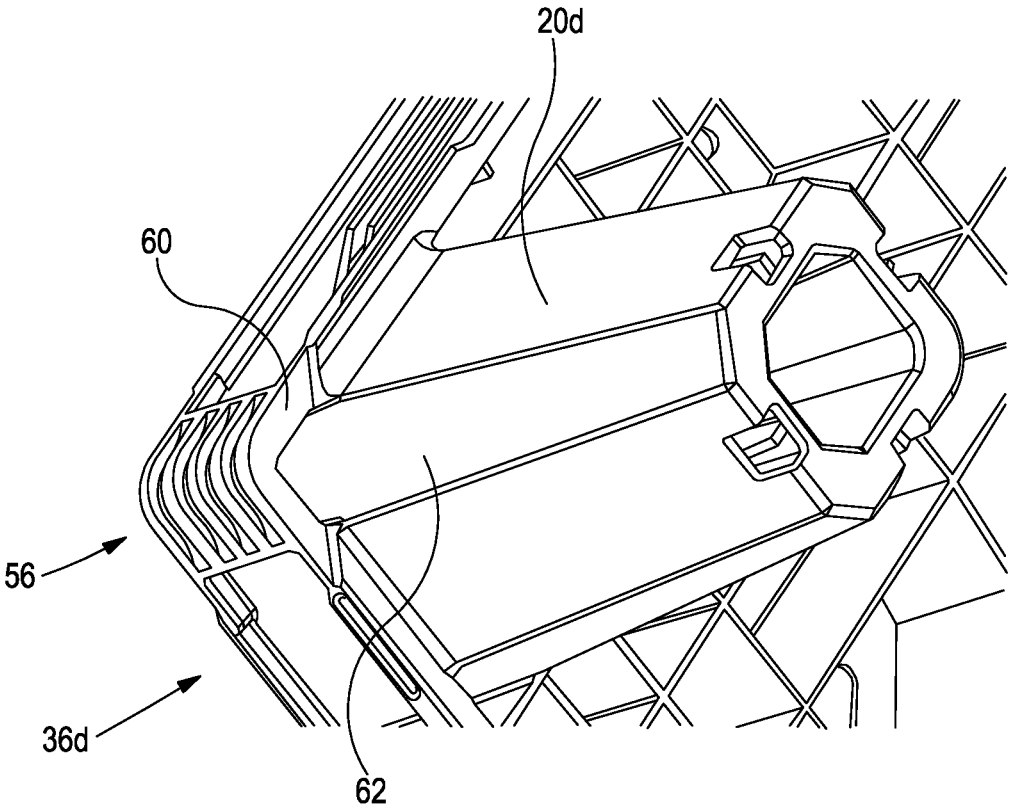
FIG. 5 is a close-up underside view of the rear corner of FIG. 4.
Figure 6A:
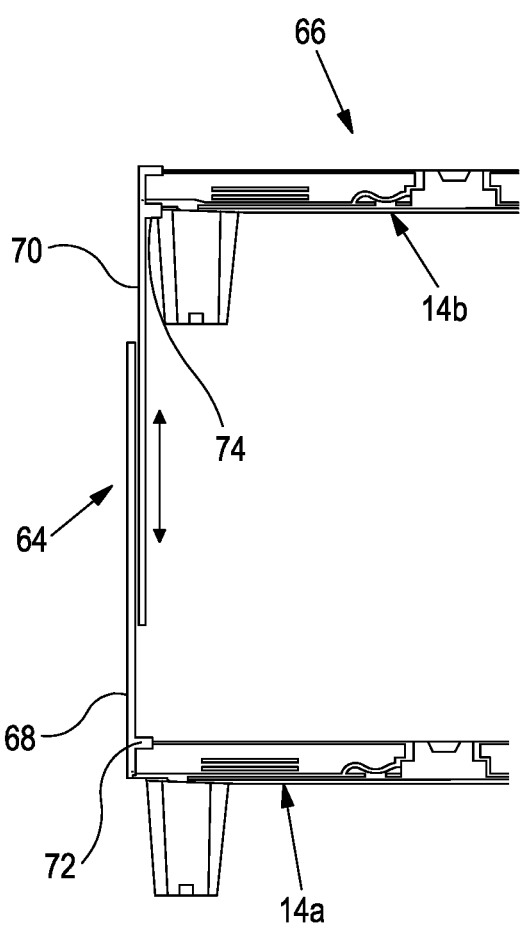
Figure 6B:
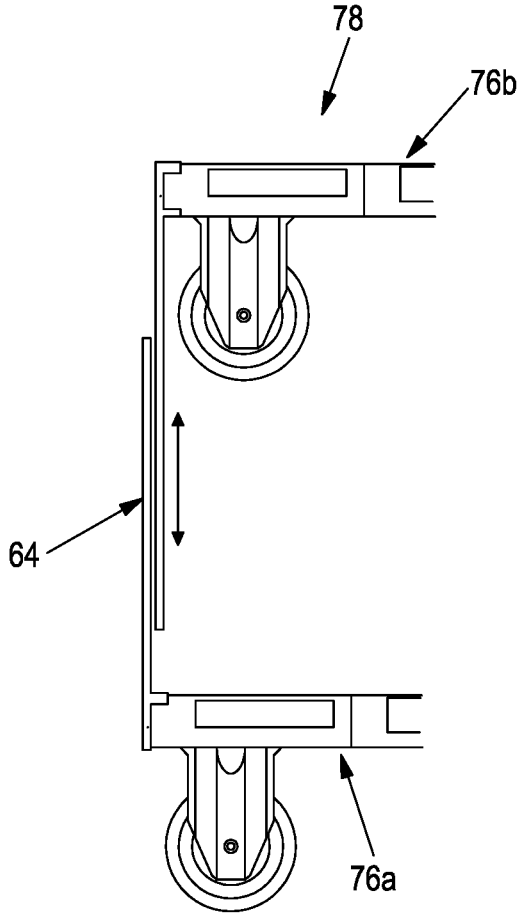
Figure 7:
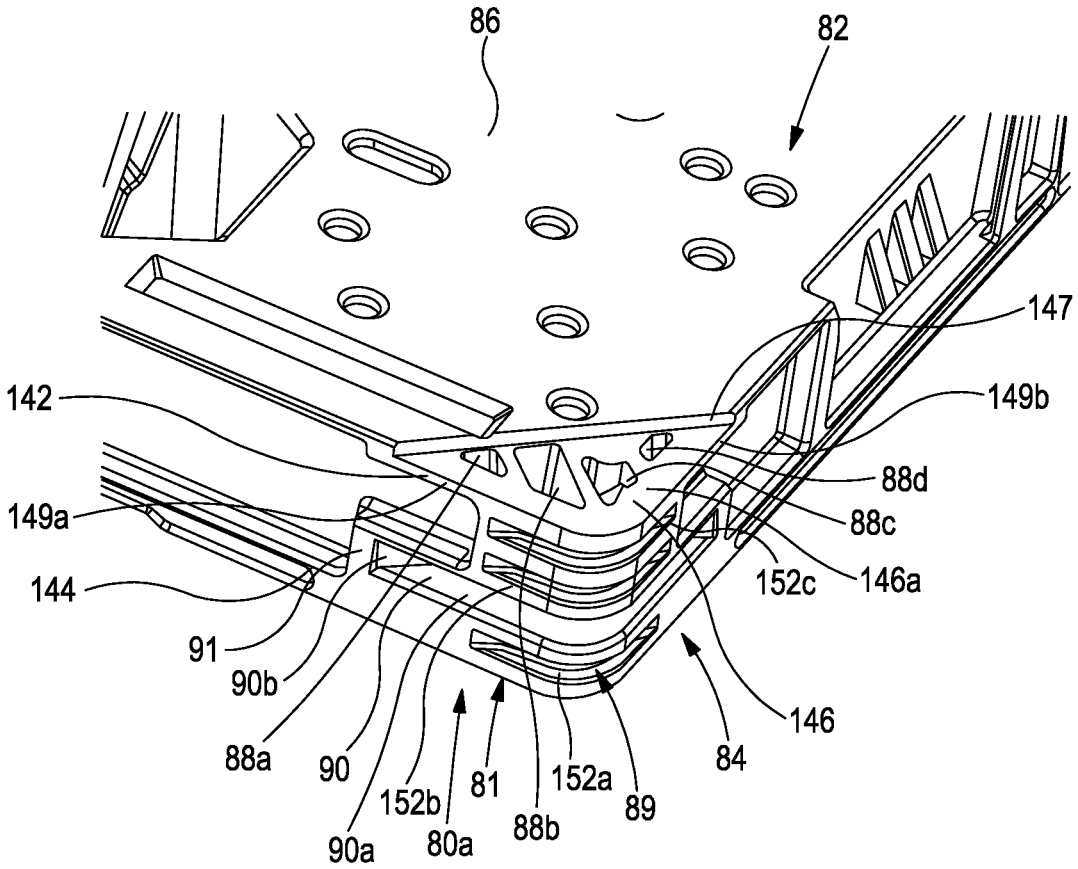
Figure 8:
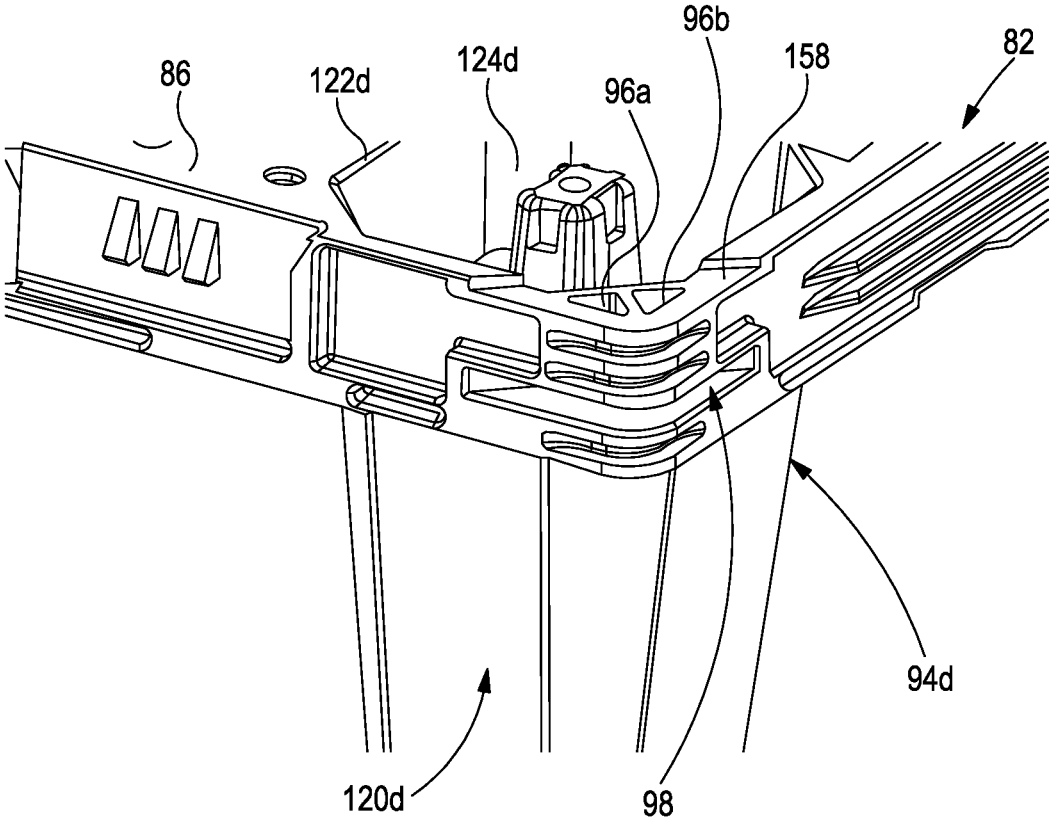
Figure 9:
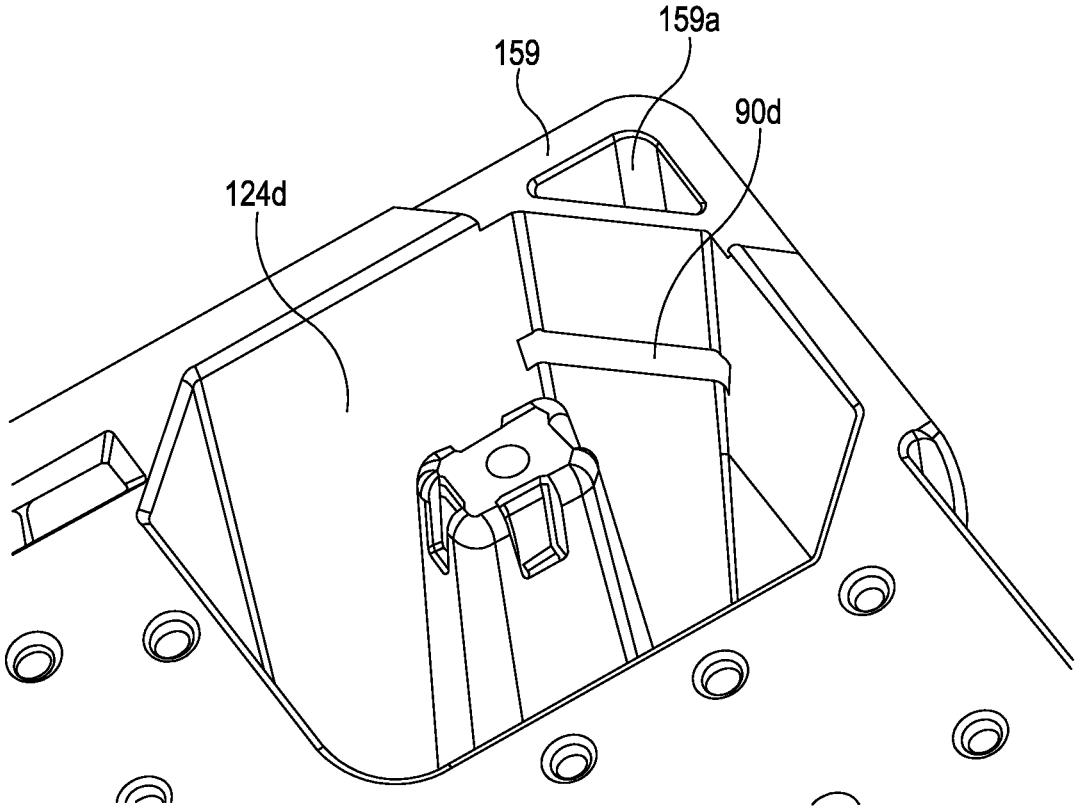
Figure 10:
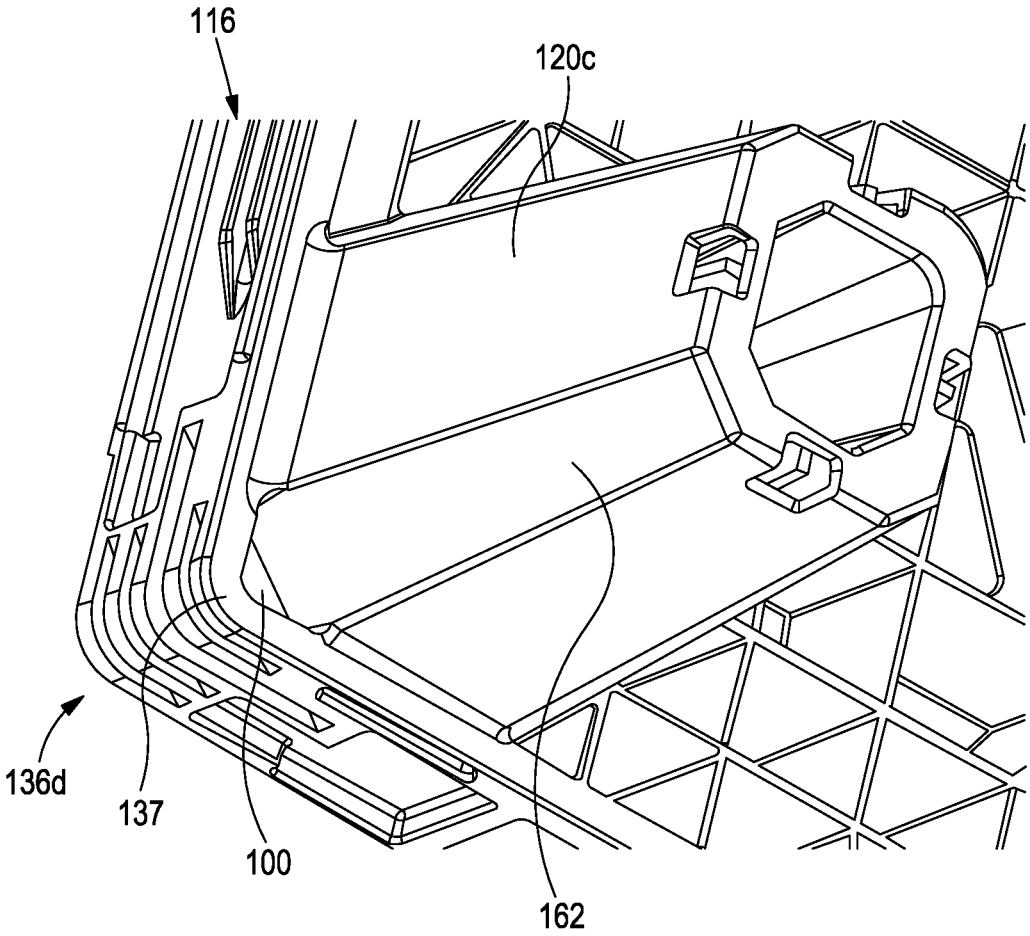
Figure 11A:
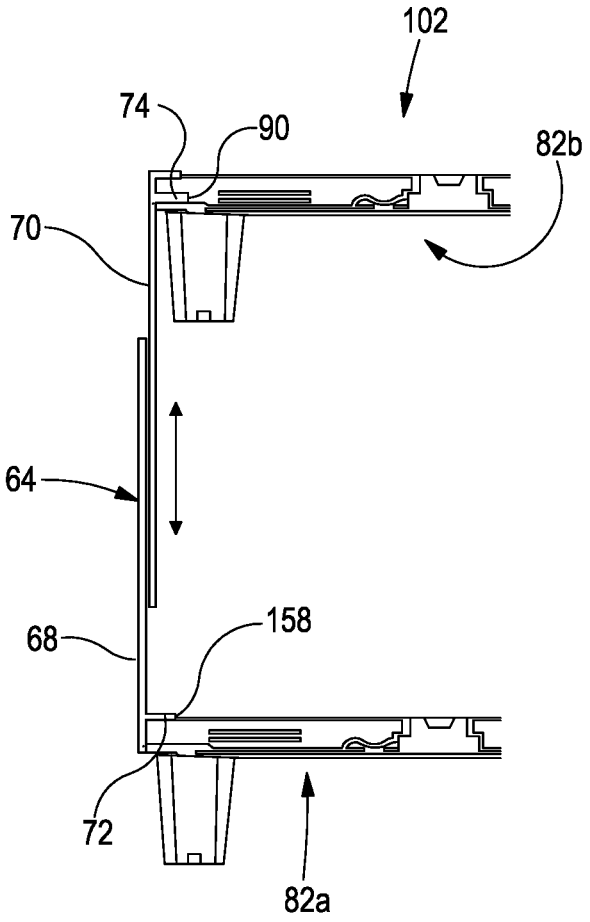
Figure 11B:
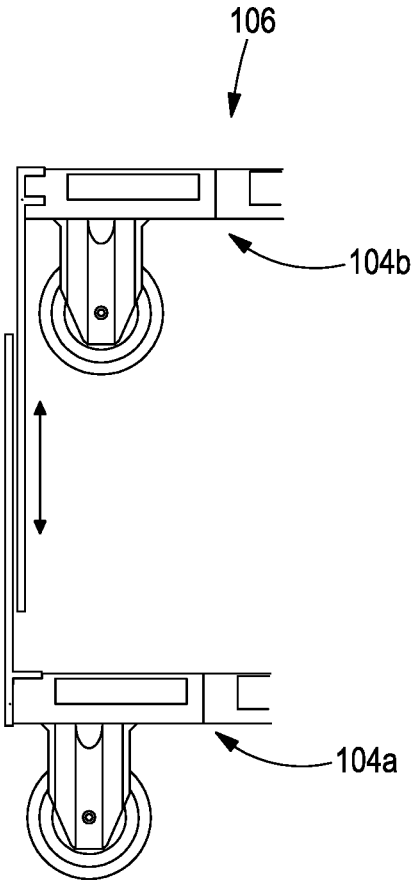
Figure 12:
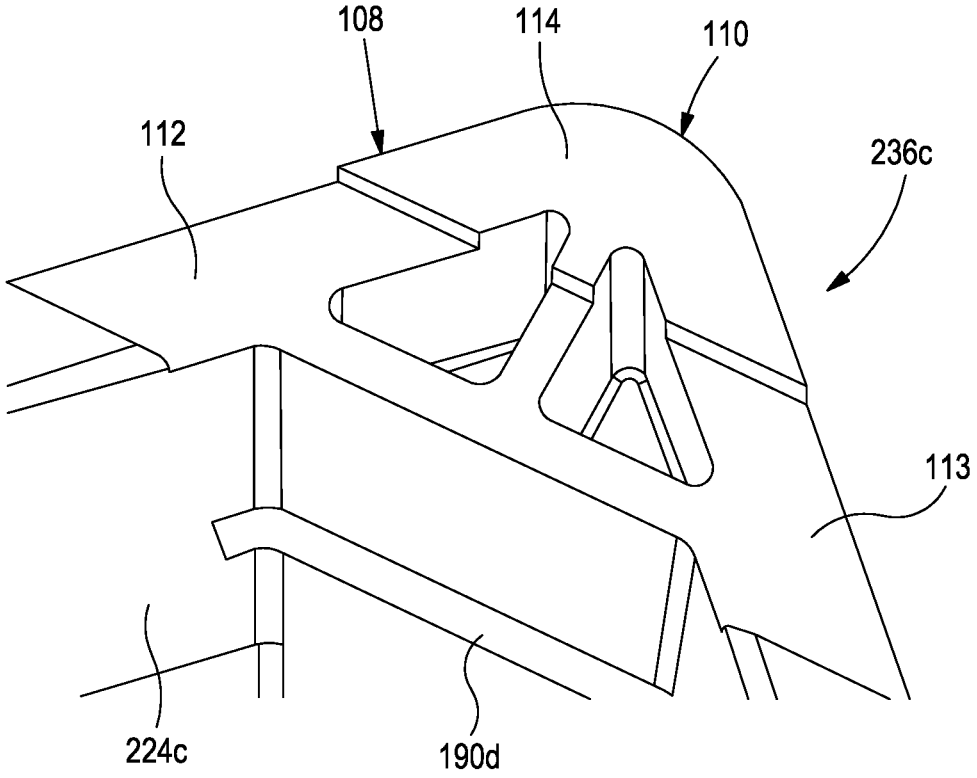
Figure 13:
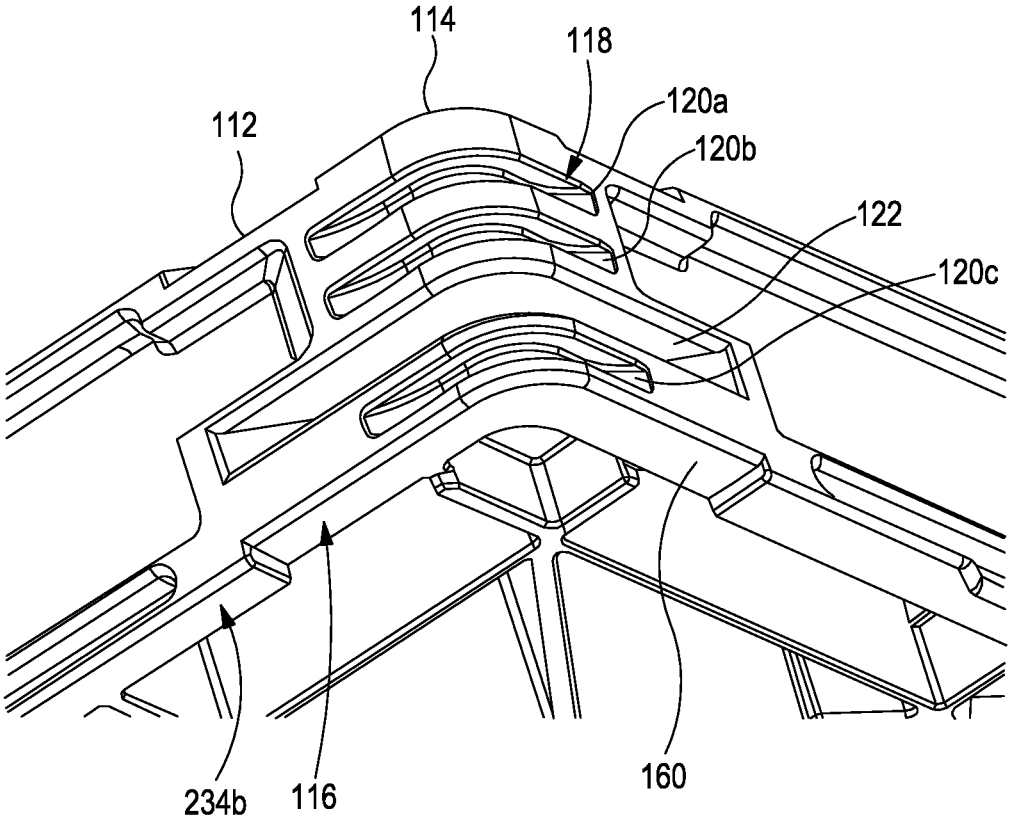
Figure 14:
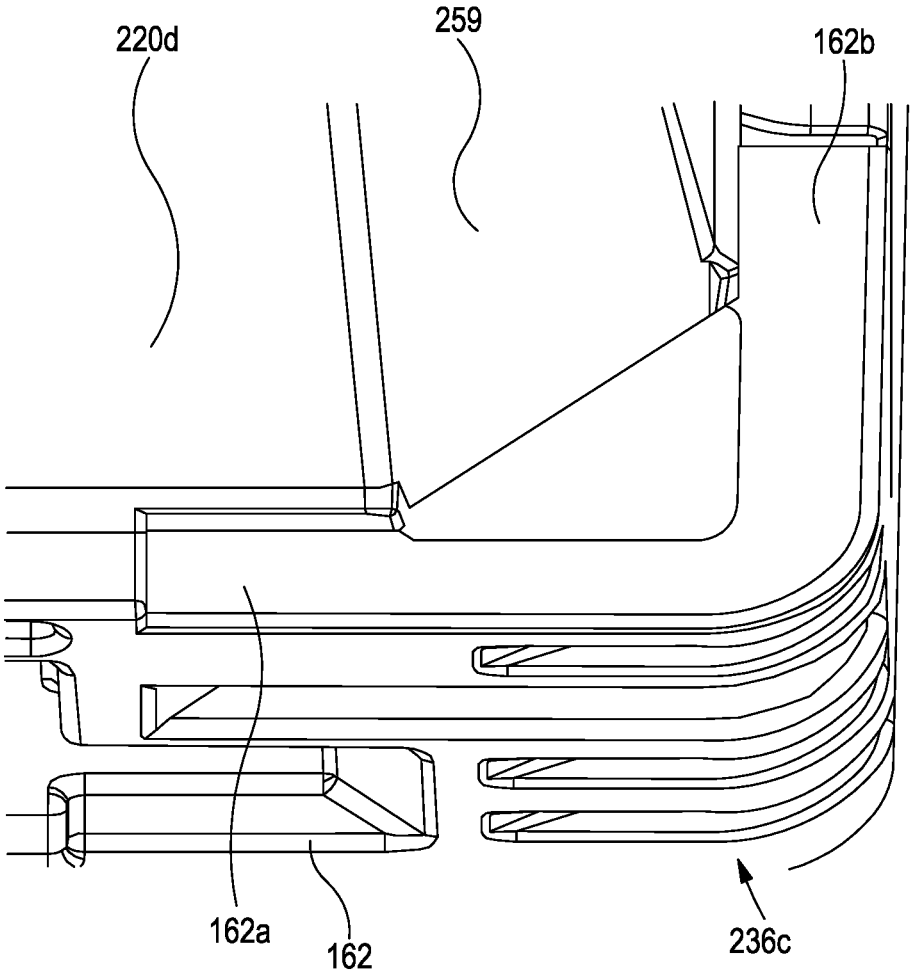
Figure 15A:
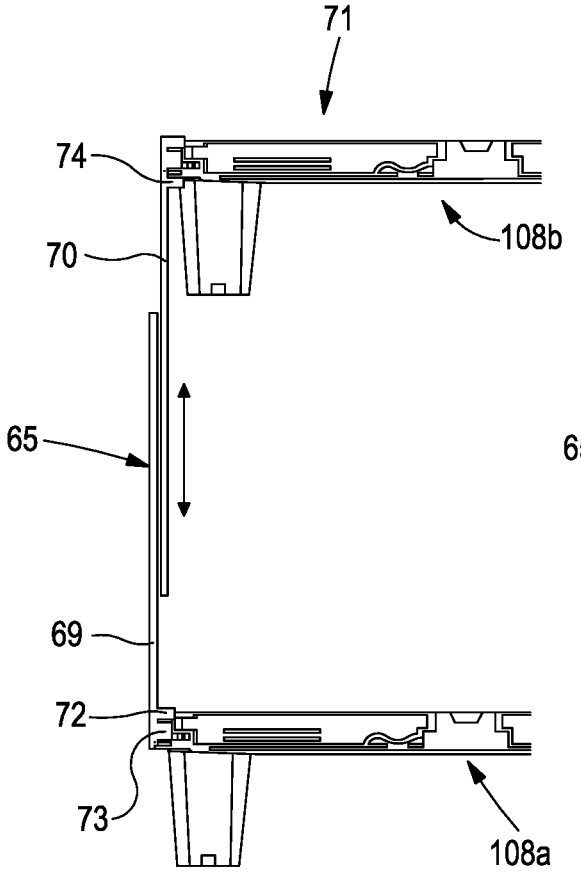
Figure 15B:
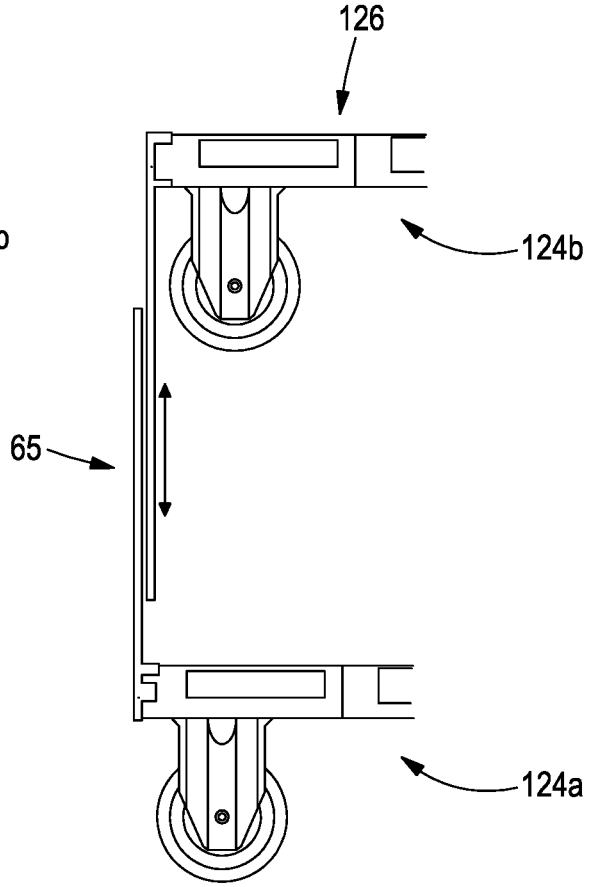
Figure 16A:
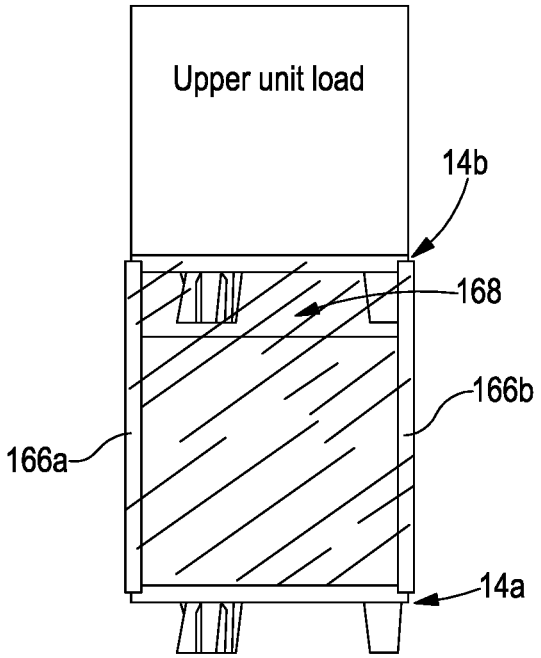
Figure 16B:
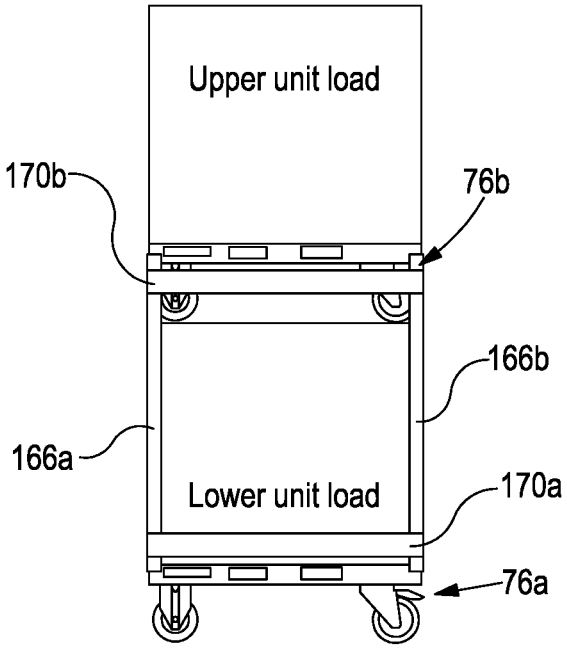
Figure 17:
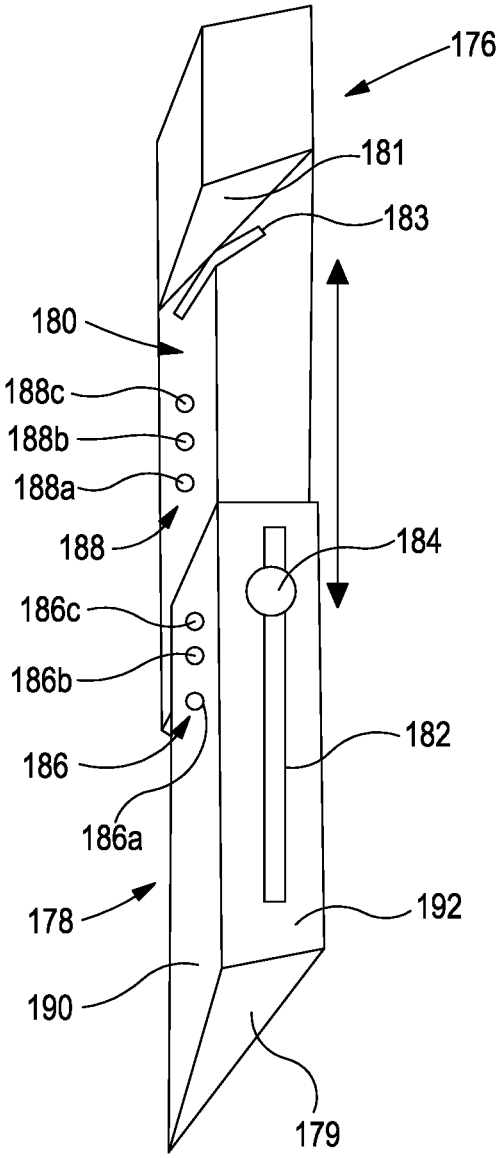
Figure 18:
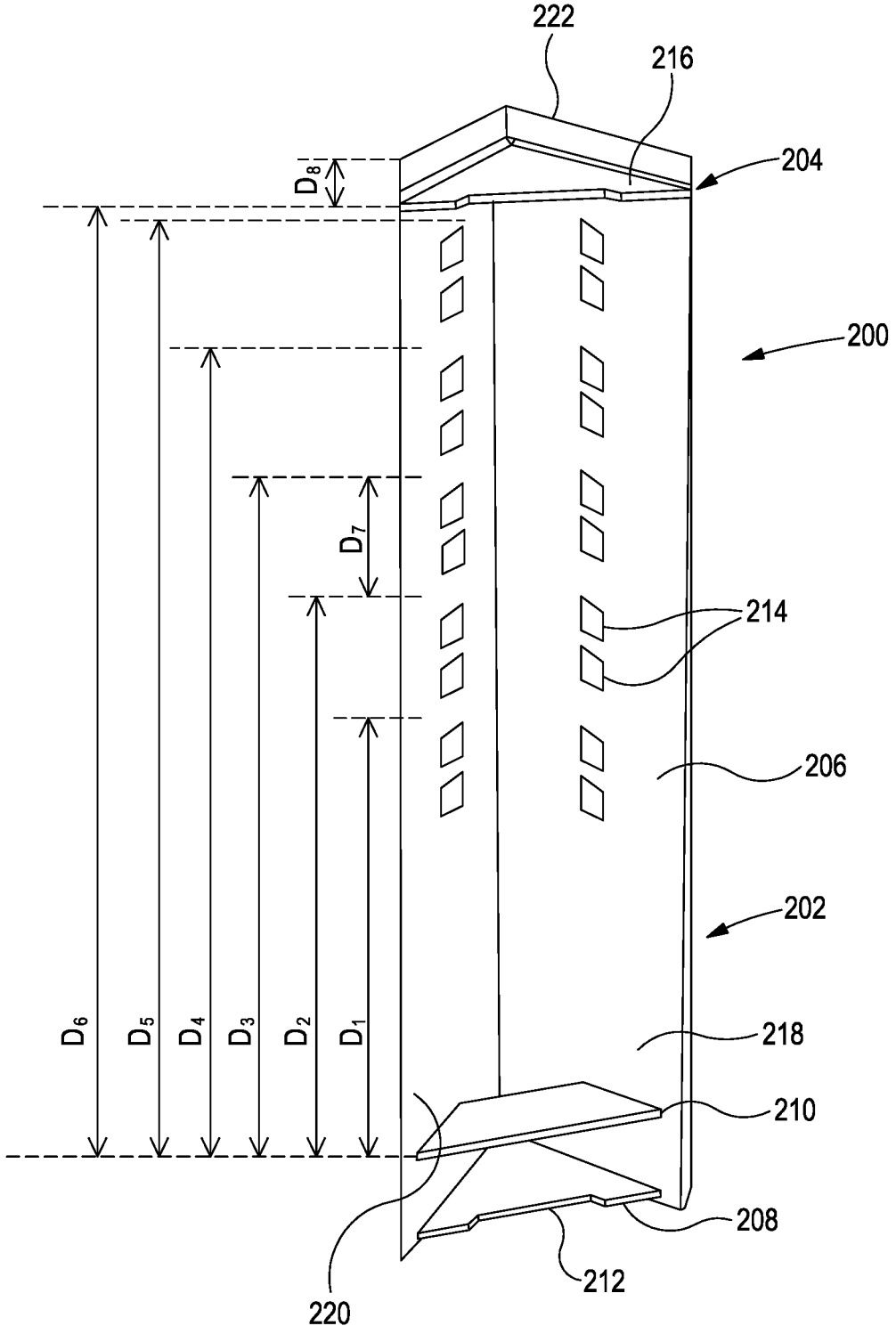
Figure 19:
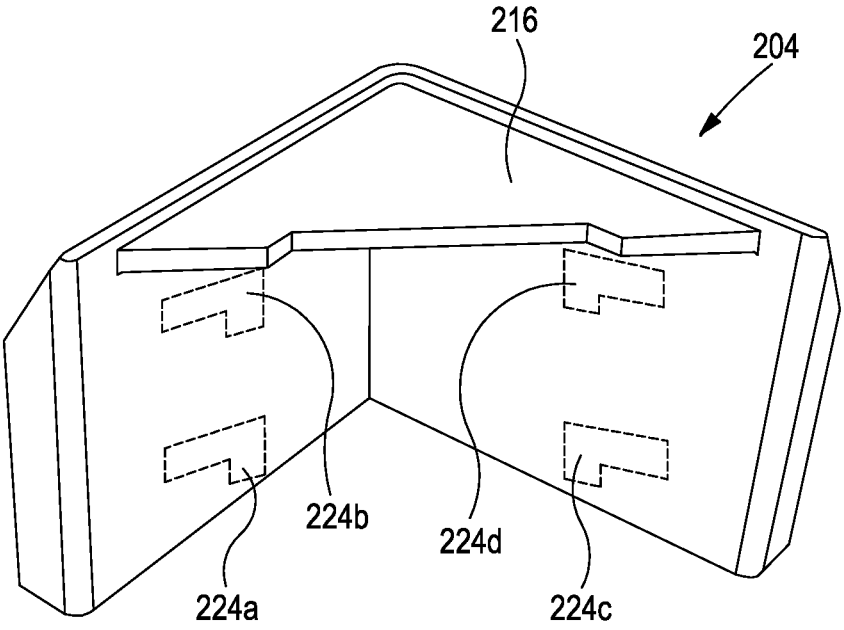
Figure 20:
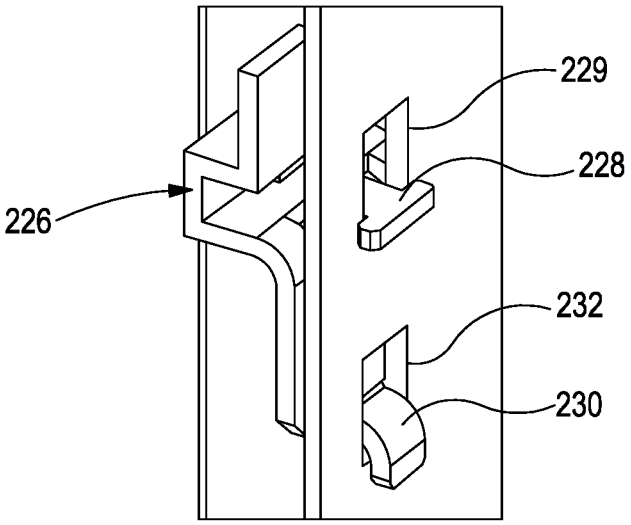
Figure 22:
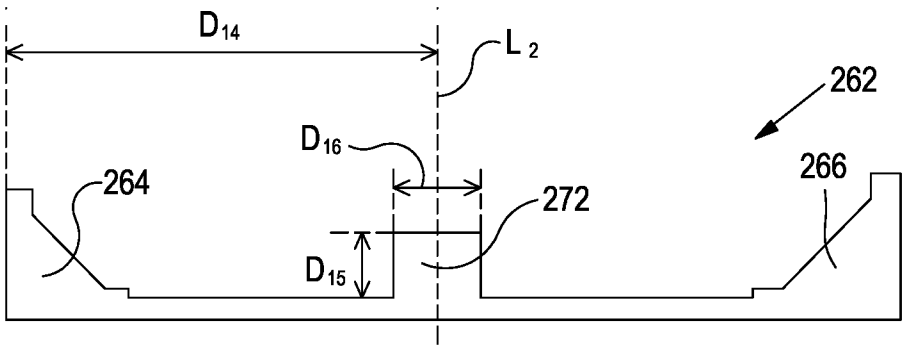
Figure 23:
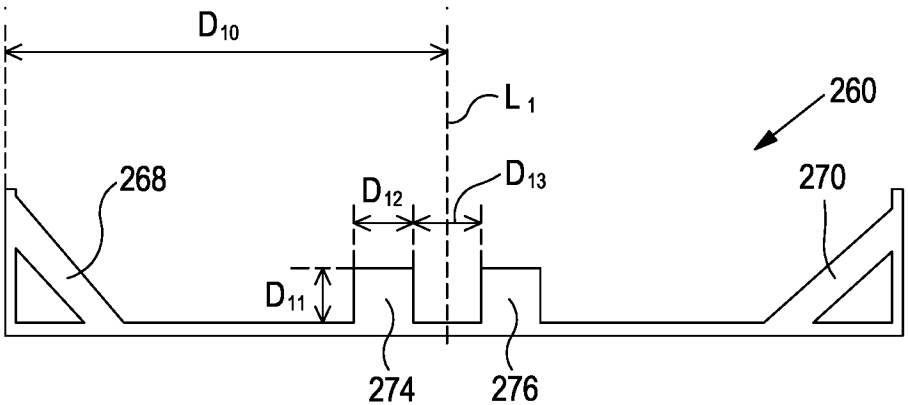
Figure 21:
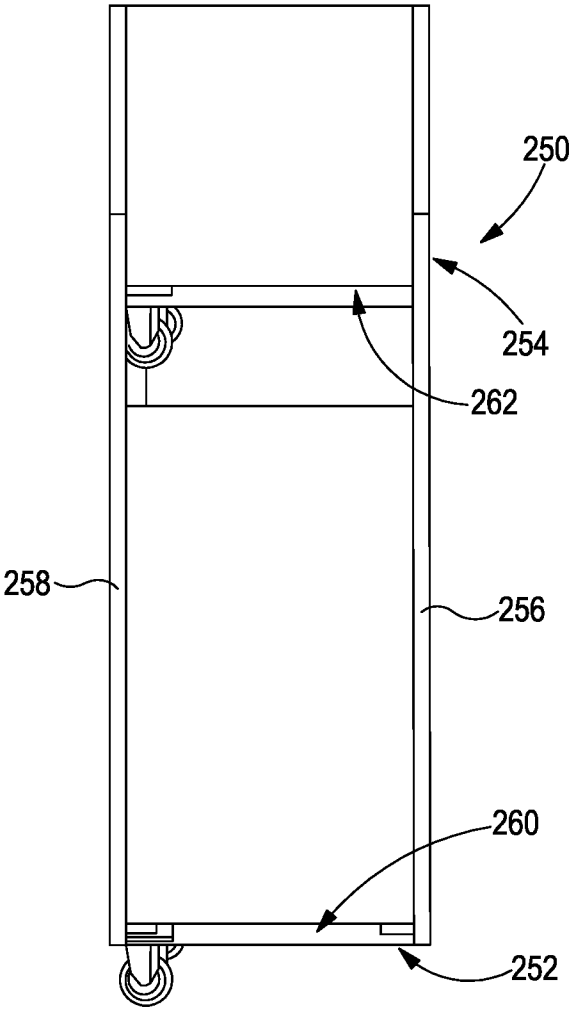
Figure 24:
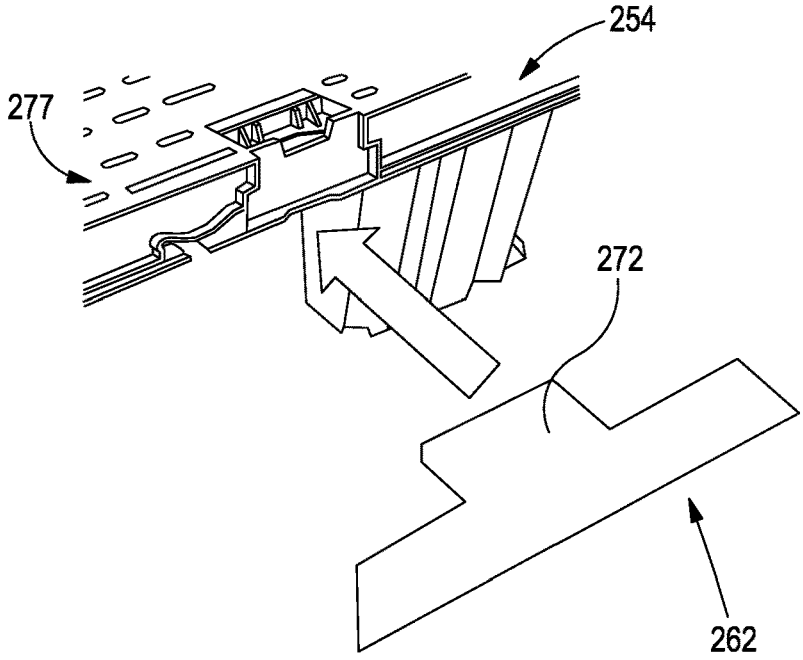
Figure 25:
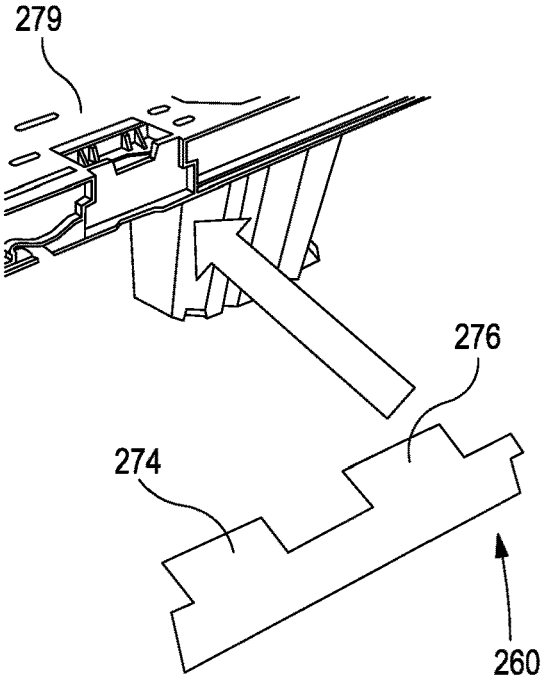
Figure 26:
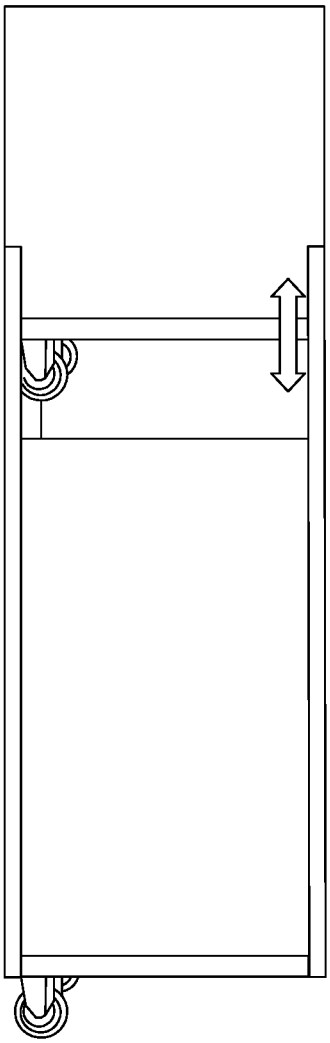
Figure 27:
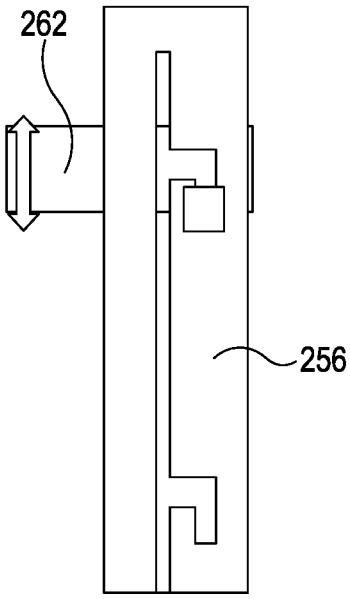
Figure 28A:
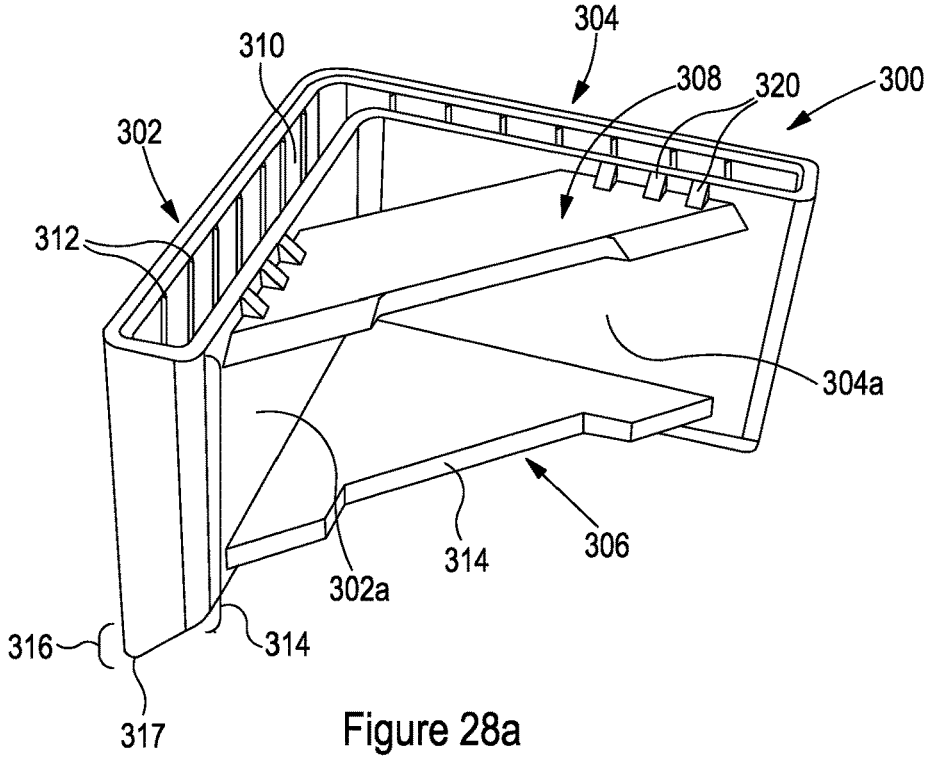
Figure 28B:
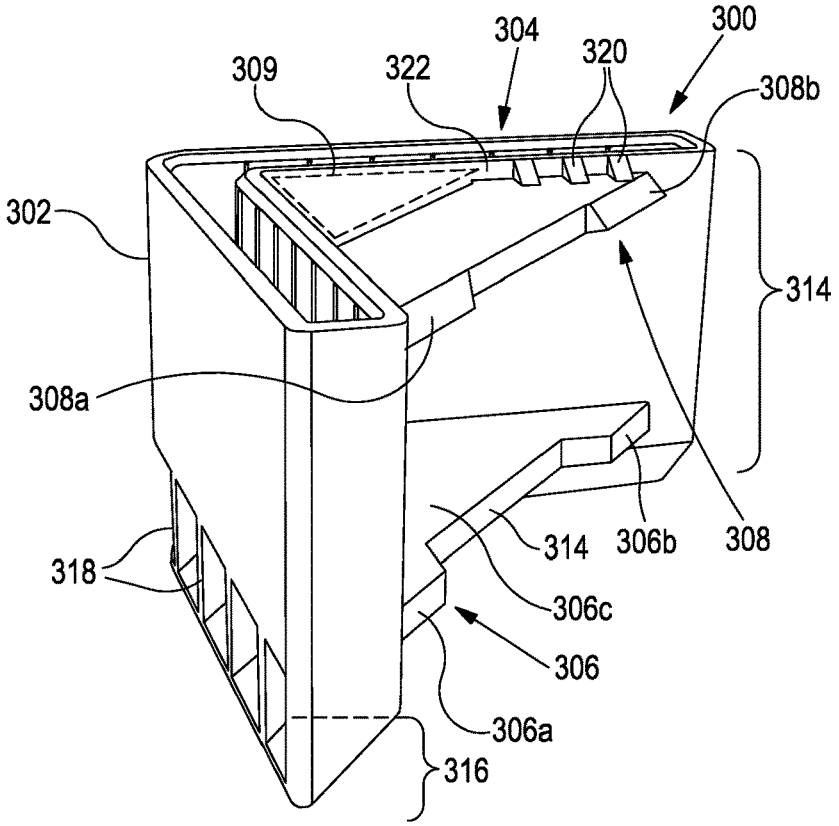
Figure 28C:
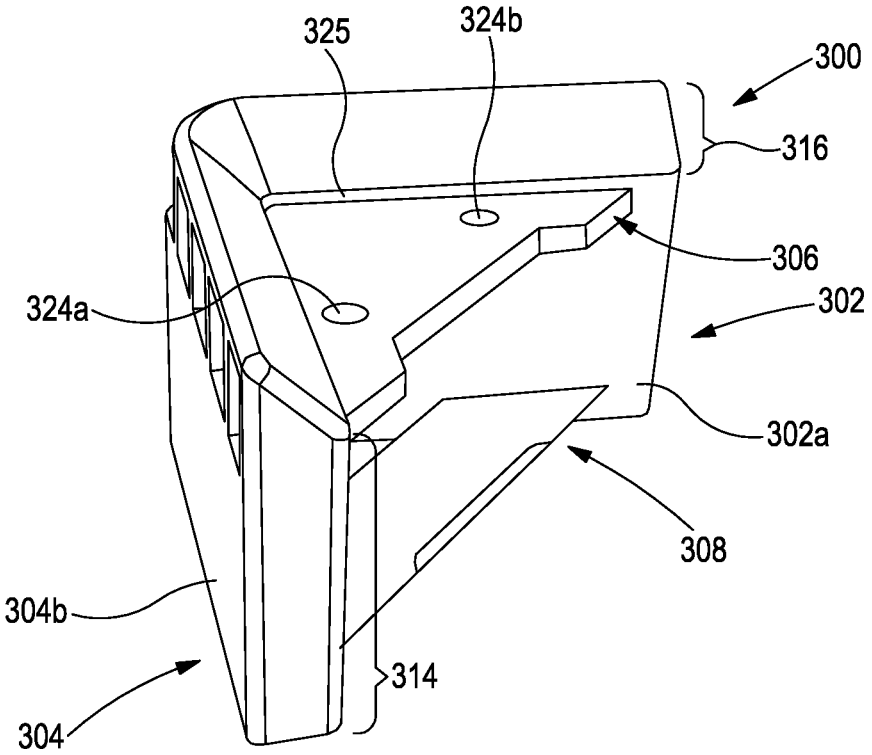
Figure 28D:
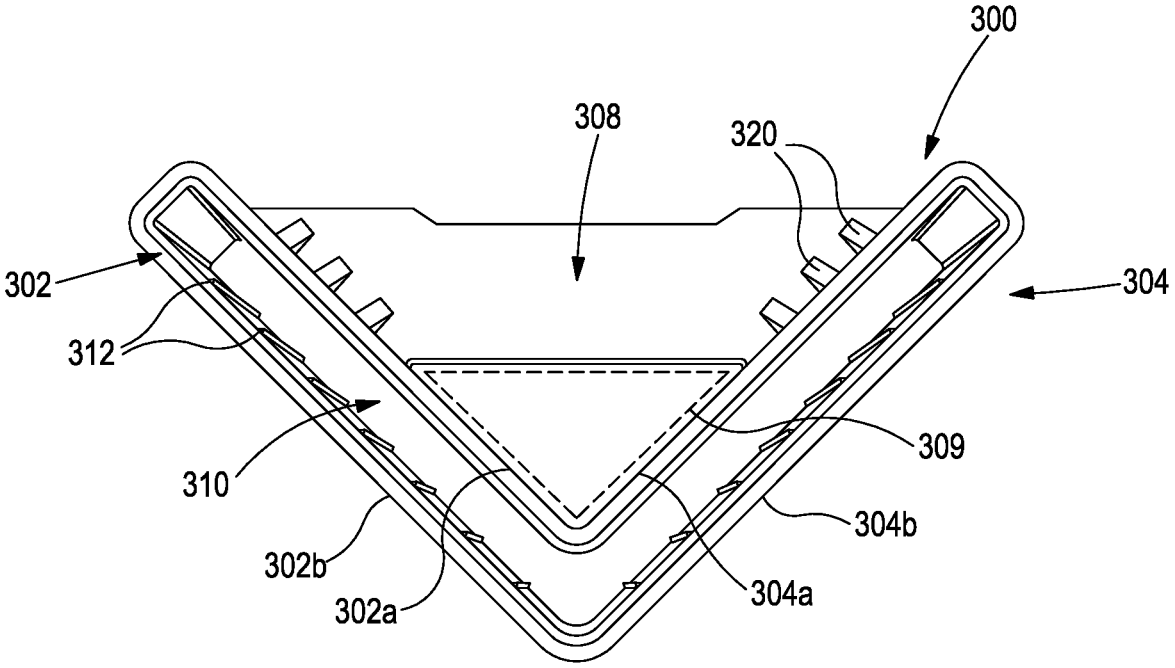
Figure 29:
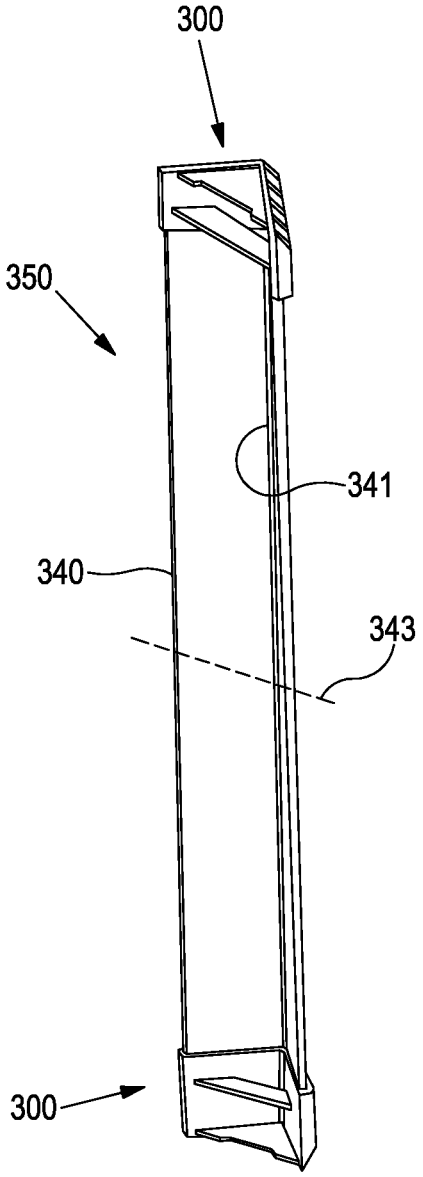

FIG. 6*a* is a side view of rear ends of the quarter pallet of FIGS. 4 and 5 separated by a support member in an elevated stacked arrangement;

FIG. 6*b* is a side view of rear ends of quarter dollys, incorporating the features of FIGS. 4 and 5, separated by a support member in an elevated stacked arrangement;

FIG. 7 is a close-up perspective view of a front corner of a quarter pallet according to an alternative embodiment of the invention;

FIG. 8 is a close-up perspective view of a rear corner of a quarter pallet according to the alternative embodiment of the invention;

FIG. 9 is a close-up perspective view of a rear corner of the alternative embodiment of the invention;

FIG. 10 is a close-up underside view of the rear corner of FIG. 9;

FIG. 11*a* is a side view of rear ends of the quarter pallet of FIGS. 8 and 9 separated by a support member in an elevated stacked arrangement;

FIG. 11*b* is a side view of rear ends of quarter dollies, incorporating the features of FIGS. 8 and 9, separated by a support member in an elevated stacked arrangement;

FIG. 12 is a close-up perspective view of a rear corner of a quarter dolly according to a further alternative embodiment of the invention;

FIG. 13 is a close-up perspective view of an underside of a front corner of a quarter dolly according to the further alternative embodiment of the invention;

FIG. 14 is a close-up underside view of the rear corner of FIG. 12;

FIG. 15*a* is a side view of rear ends of the quarter pallet of FIGS. 12 and 14 separated by a support member in an elevated stacked arrangement;

FIG. 15*b* is a side view of rear ends of two quarter dollies, incorporating the features of FIGS. 12 and 14, separated by a support member in an elevated stacked arrangement;

FIG. 16*a* is a side view of two quarter pallets in an elevated stacked arrangement, with film used to secure support members in position;

FIG. 16*b* is a side view of two quarter dollies in an elevated stacked arrangement, with bands used to secure the support members in position;

FIG. 17 is a perspective view of an adjustable support member according to an aspect of the invention;

FIG. 18 is a perspective view of another embodiment of adjustable support member;

FIG. 19 is a perspective view of a second portion of the FIG. 18 arrangement;

FIG. 20 is an example of a mechanism for coupling the first and second portions of FIG. 18 together;

FIG. 21 is a side view of an elevated stacked arrangement incorporating support bodies;

FIG. 22 is a view from above of a second support body;

FIG. 23 is a view from above of a first support body;

FIG. 24 is a perspective view of part of the second support body being inserted into a pallet;

FIG. 25 is a perspective view of part of the first support body being inserted into a pallet;

FIG. 26 is a side view like that of FIG. 21, indicating a direction of adjustment;

FIG. 27 is a side view of one mechanism suitable for adjusting the offset between upper and lower pallets in the FIG. 26 arrangement;

FIGS. 28*a*-28*d* are various views of a corner body;

FIG. 29 is a perspective view of a support member incorporating the corner body of FIGS. 28*a*-28*d;*

Figure 29A:
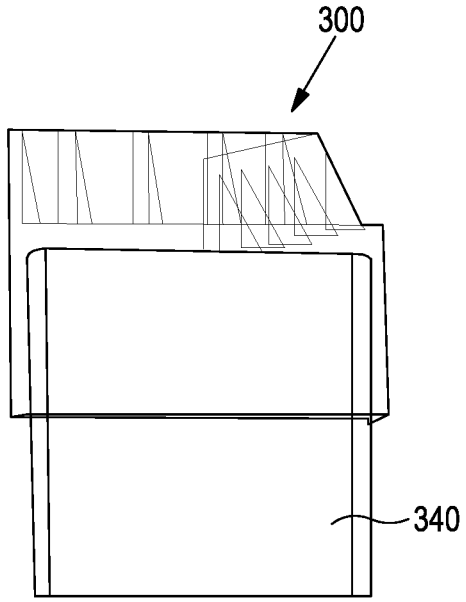
Figure 29B:
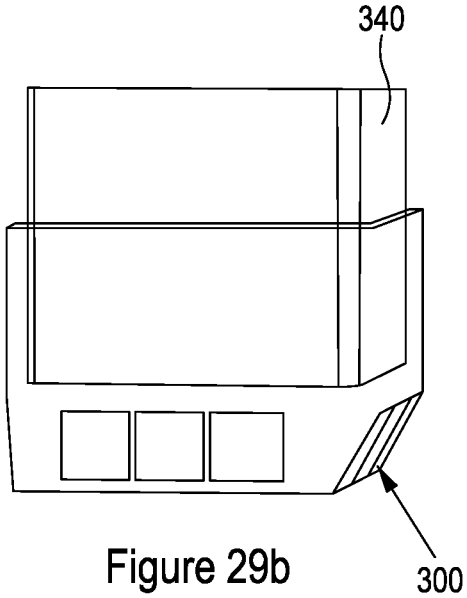
Figure 30:
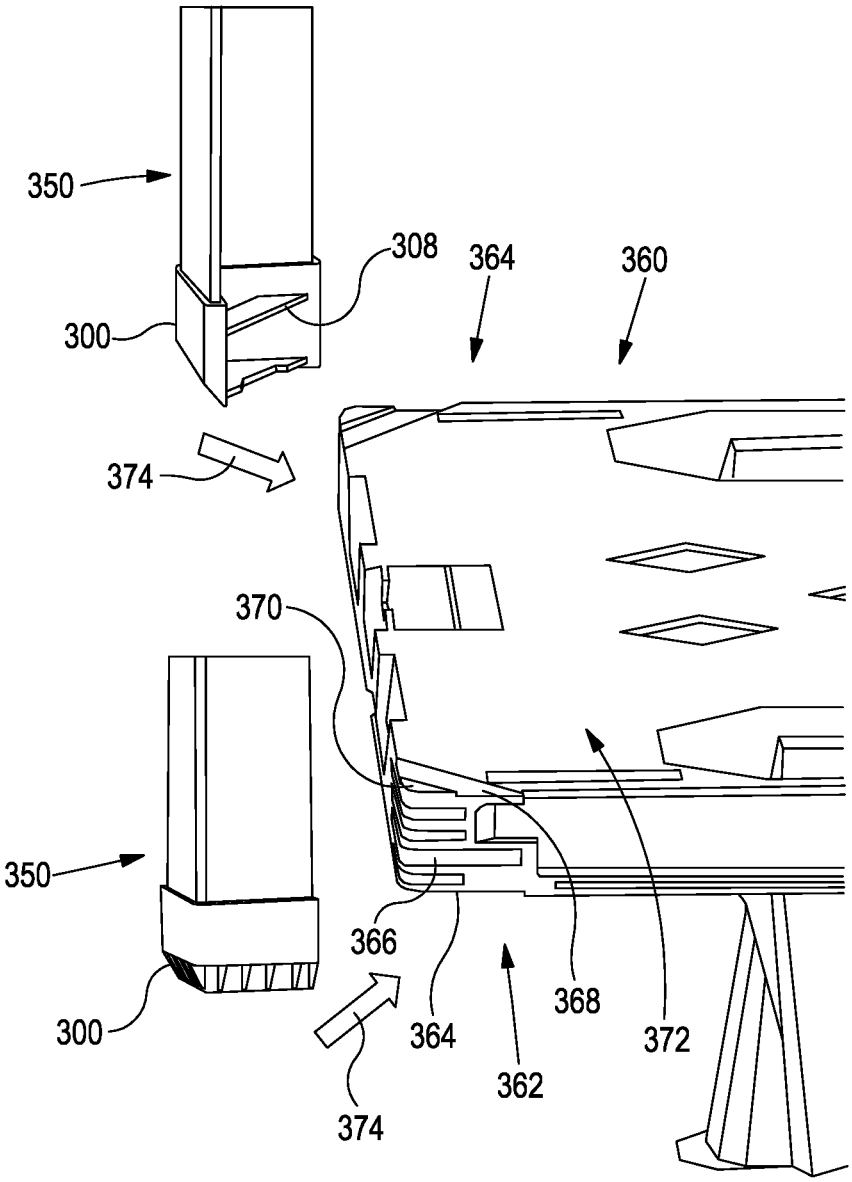
Figure 31:
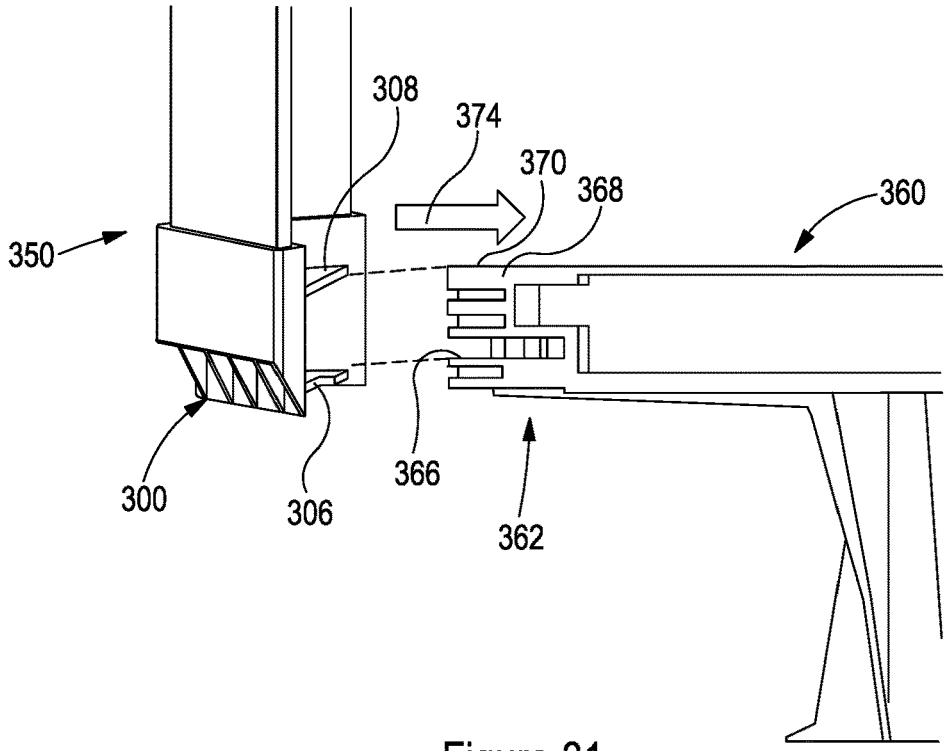
Figure 32:
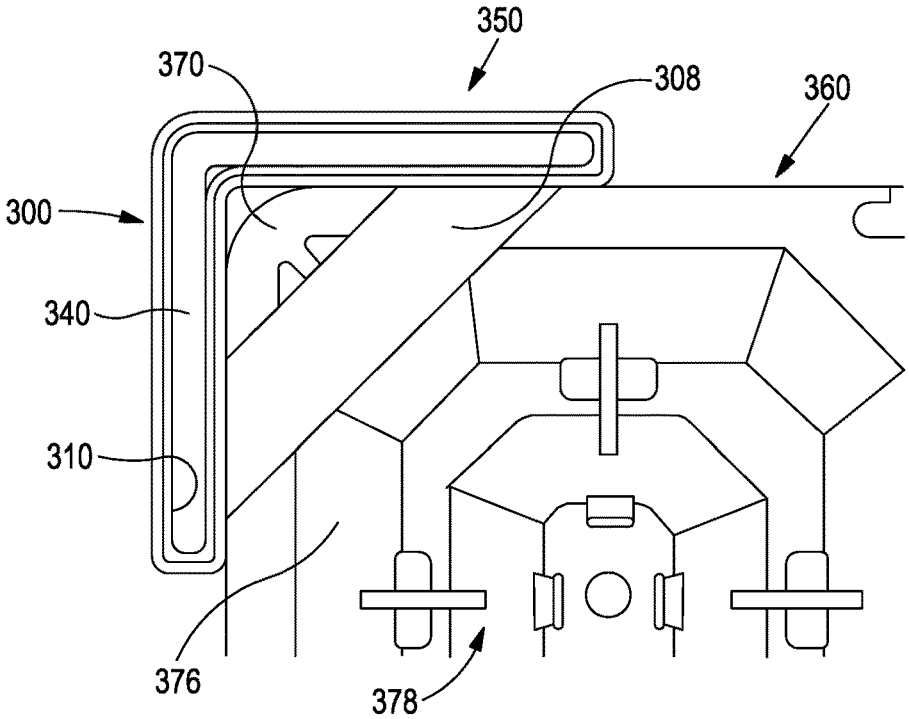
Figure 33A:
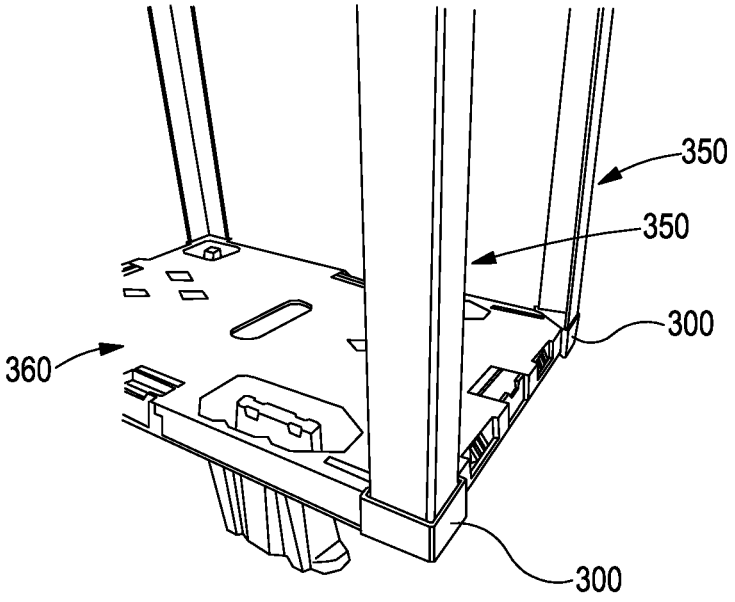
Figure 33B:
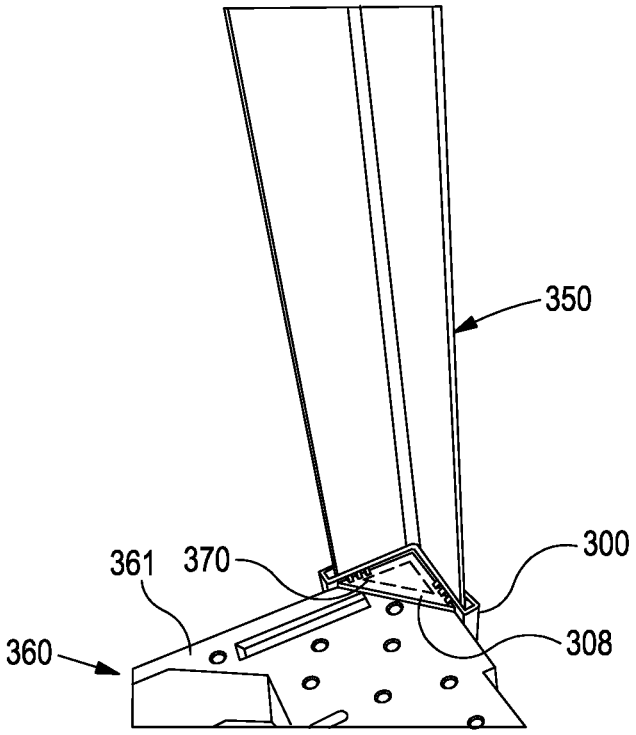
Figure 34:
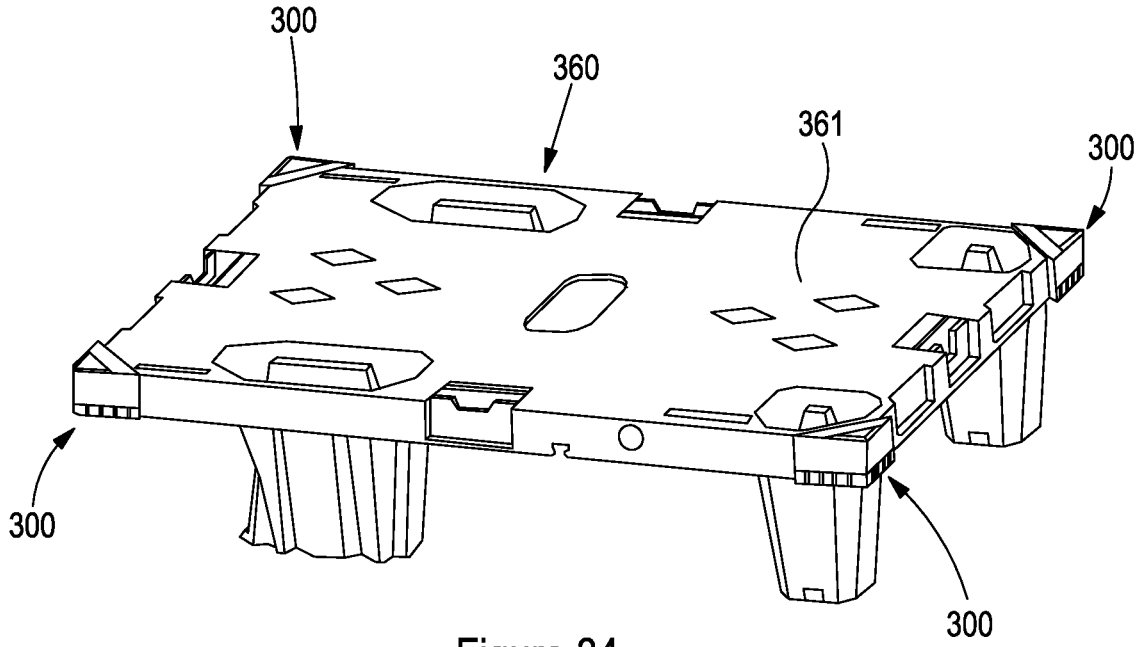
Figure 35:
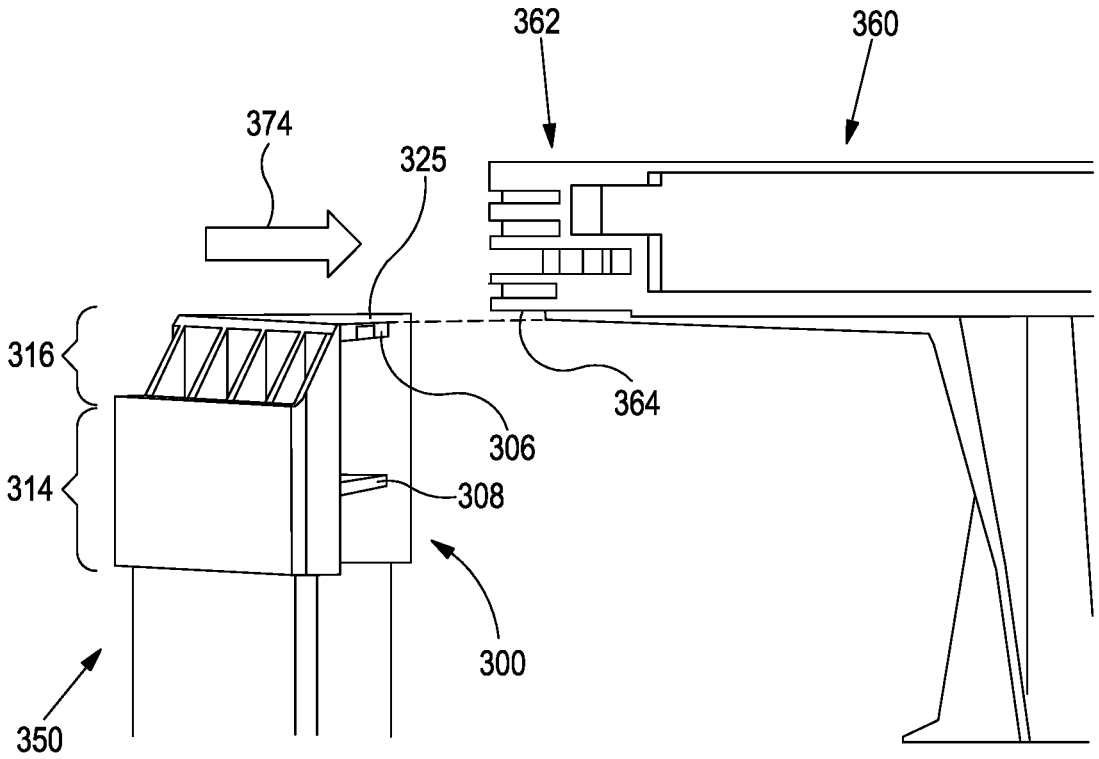
Figure 36:
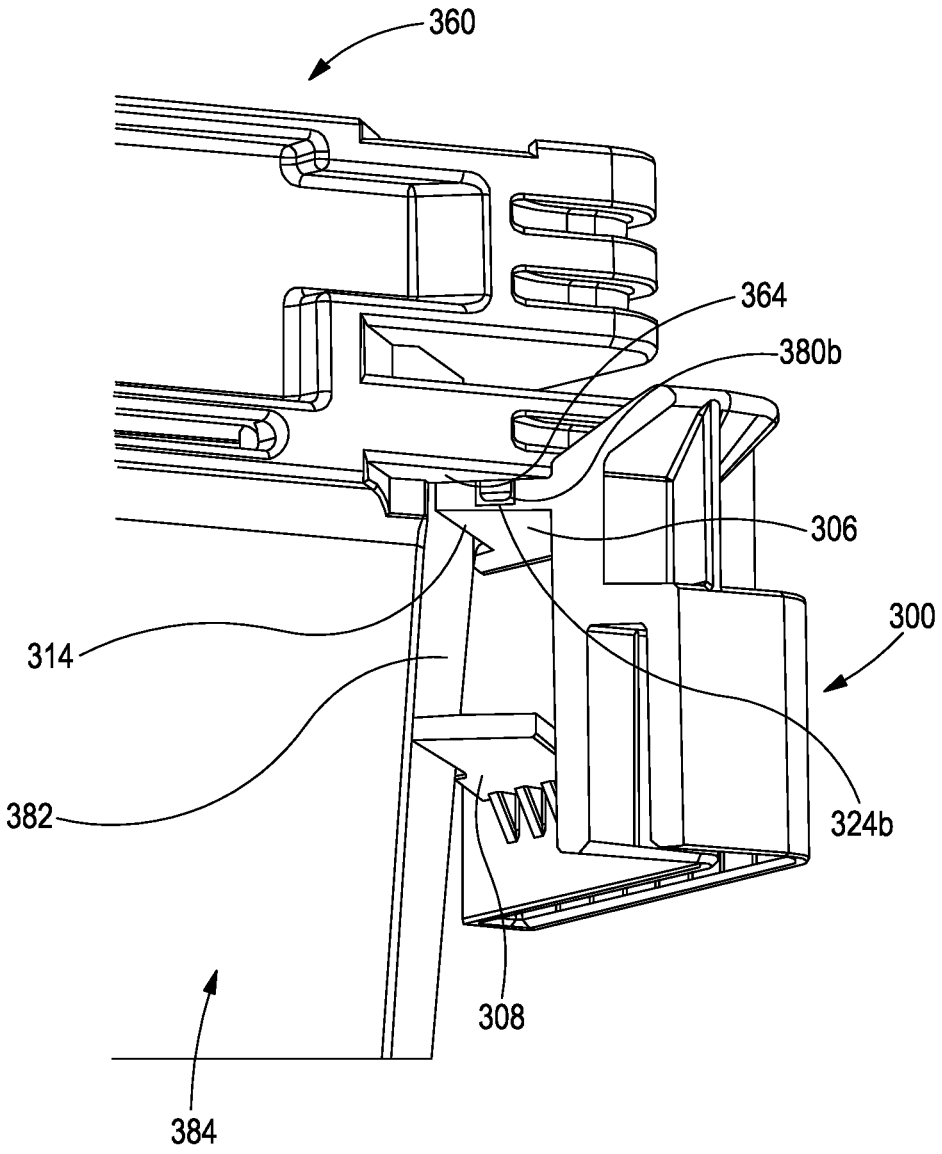
Figure 37:
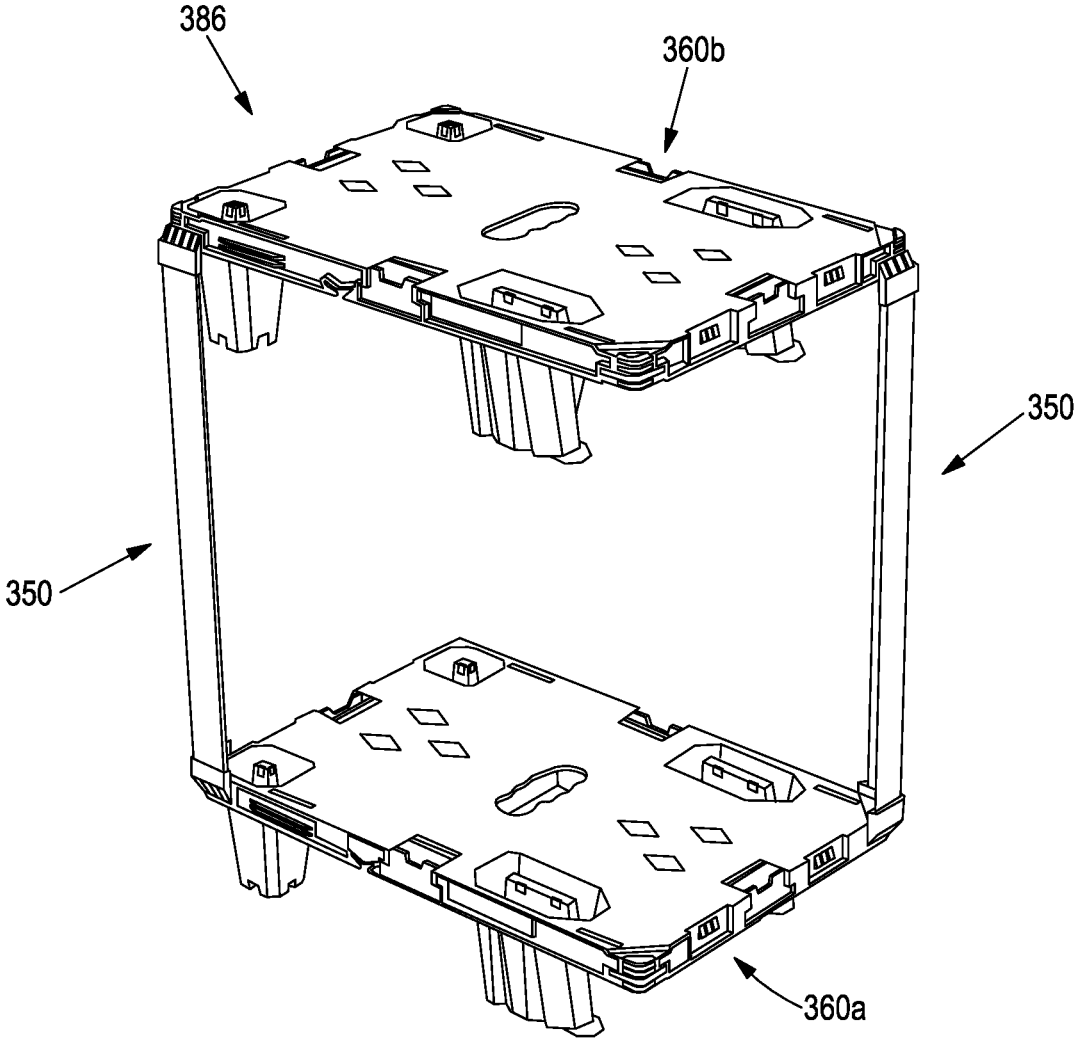
Figure 38:
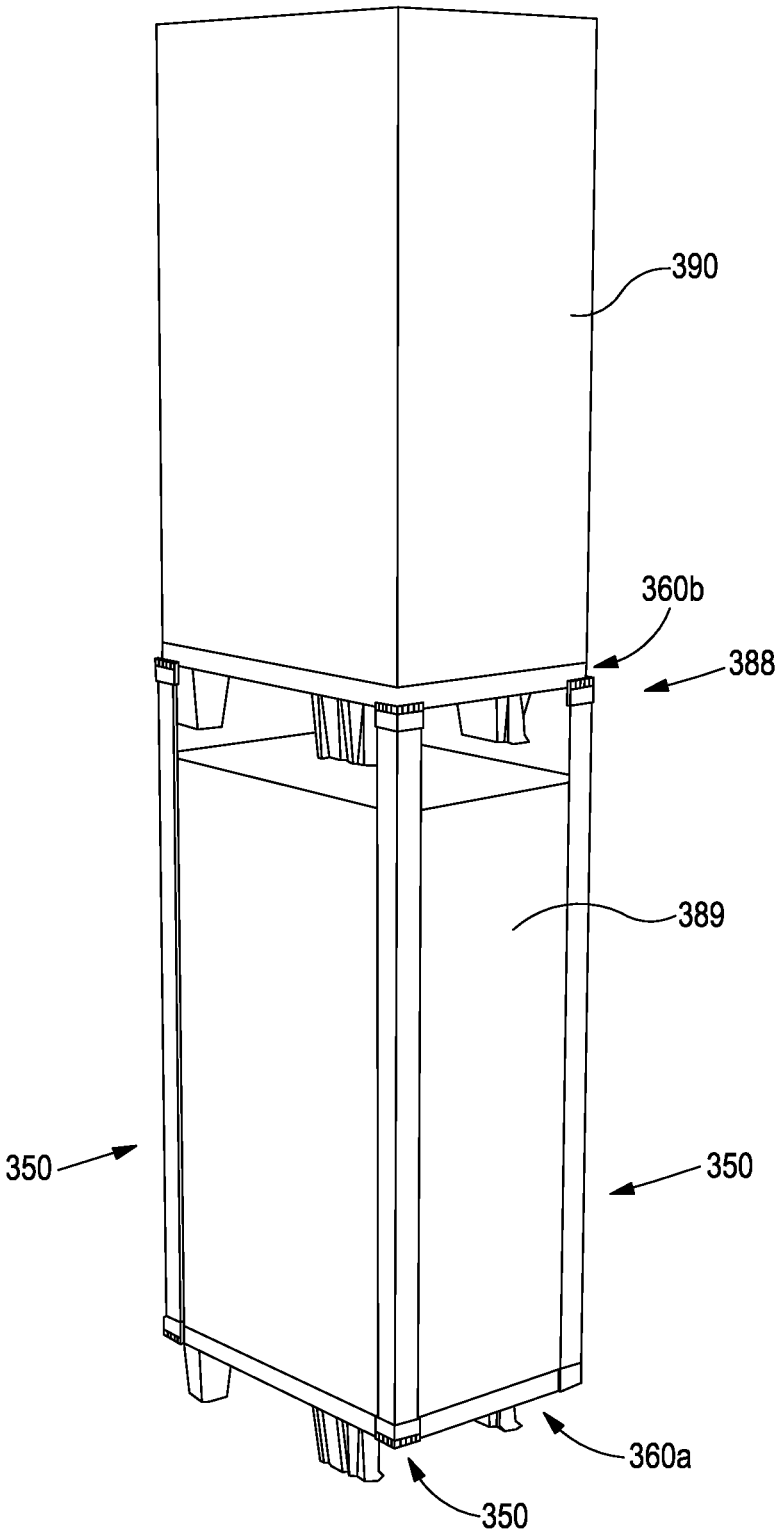
Figure 39:
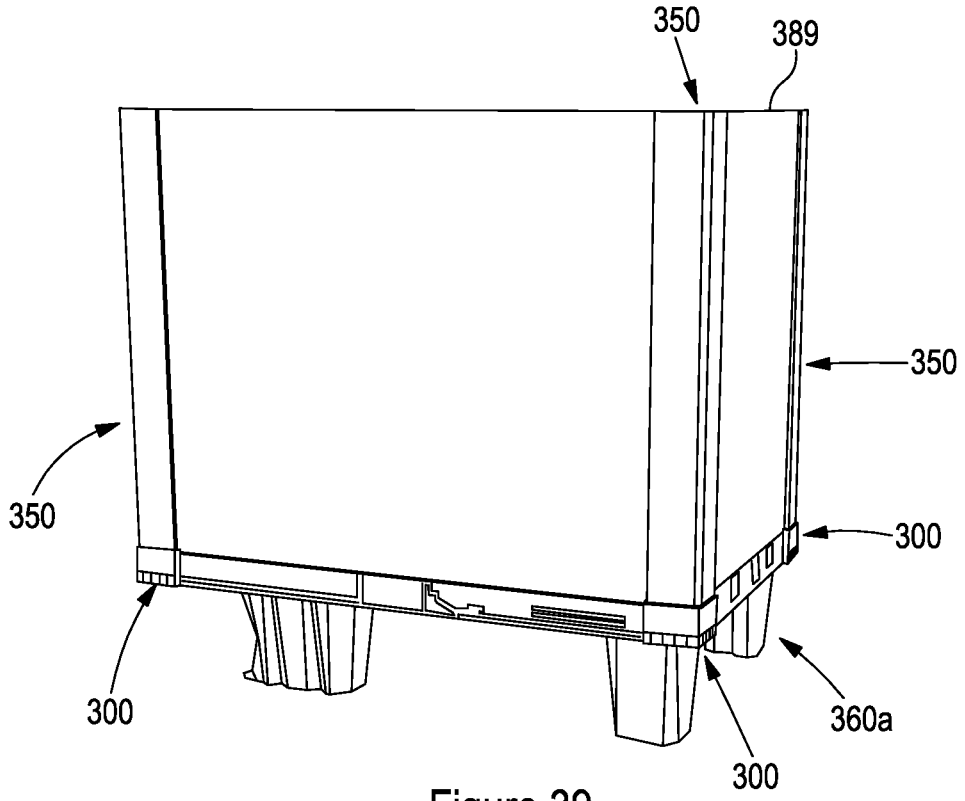
Figure 40:
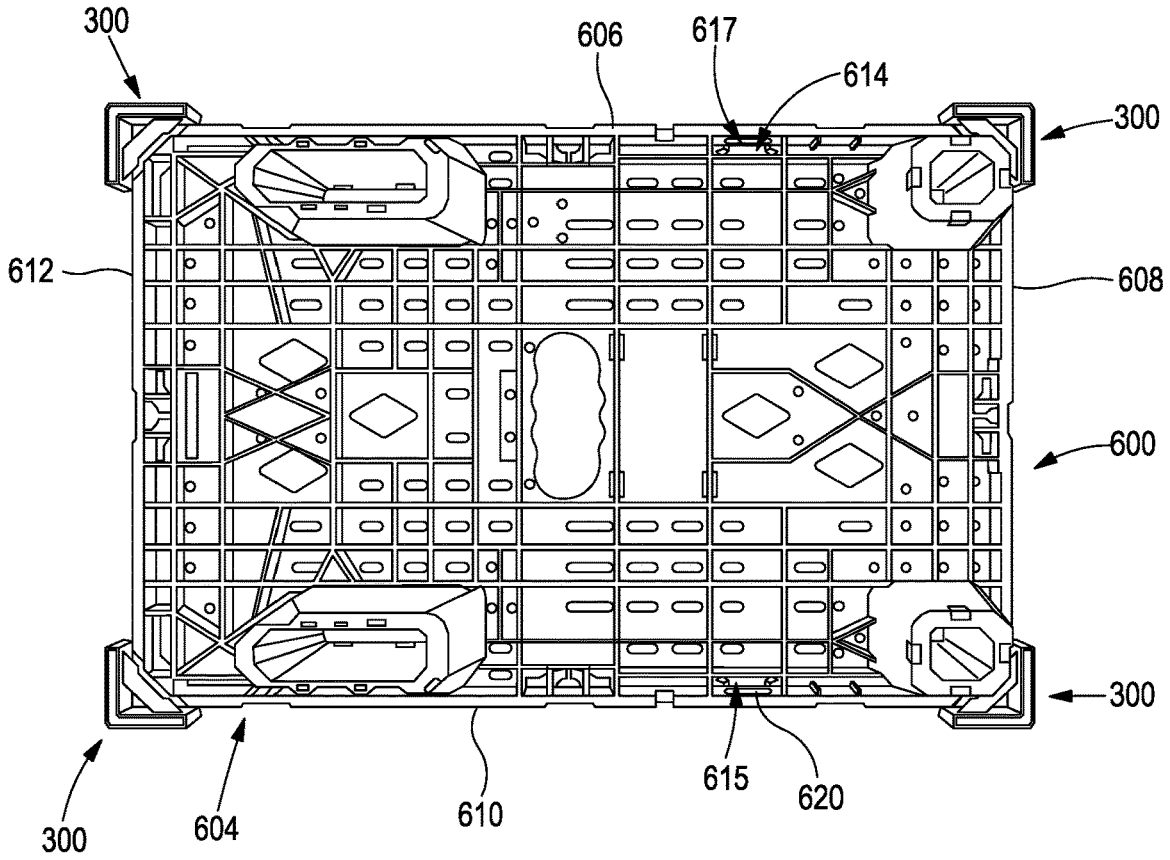
Figure 41:
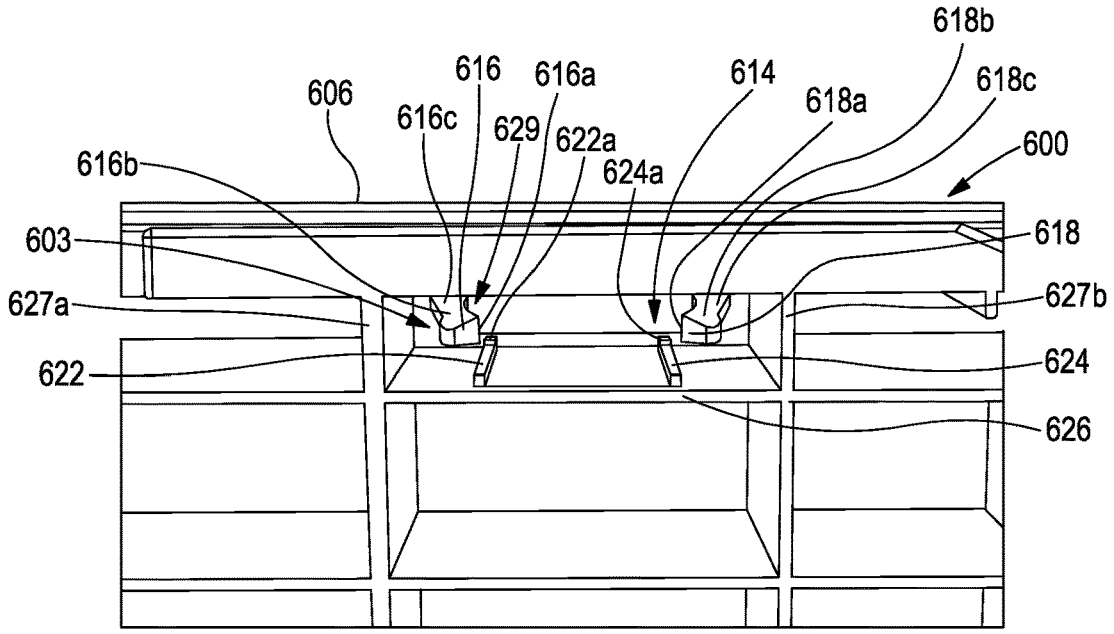
Figure 42:
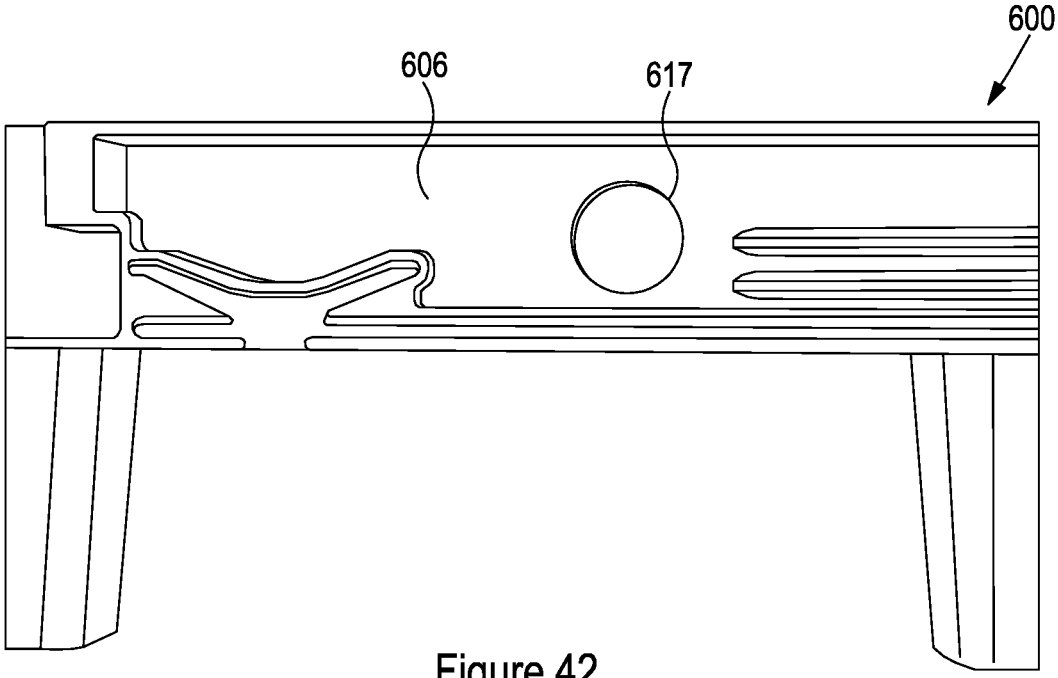
Figure 43:
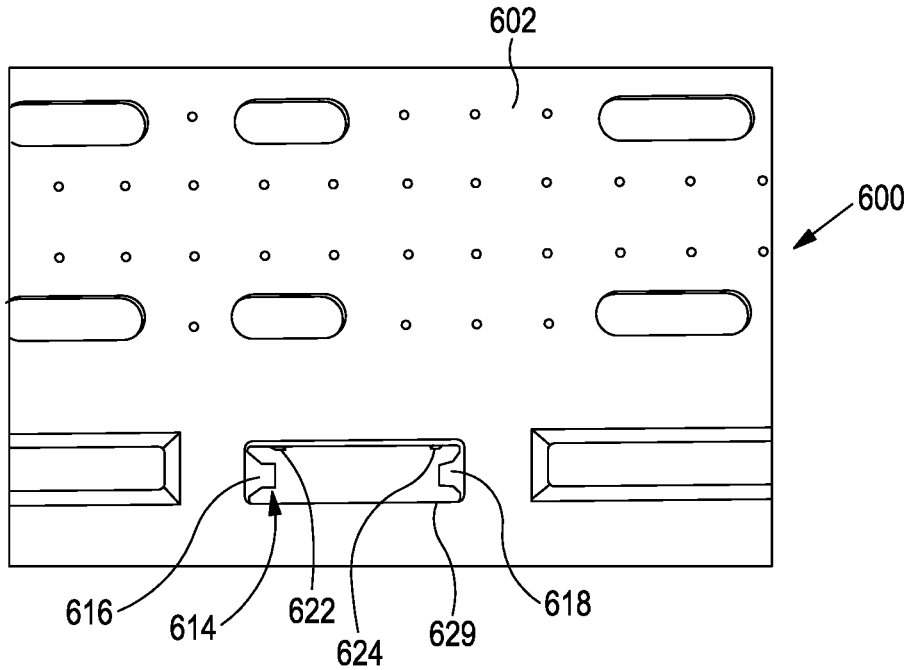
Figure 44:
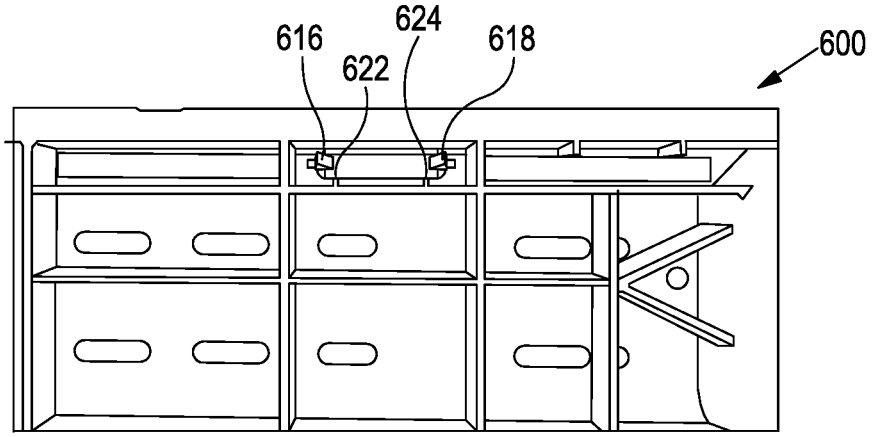
Figure 45:
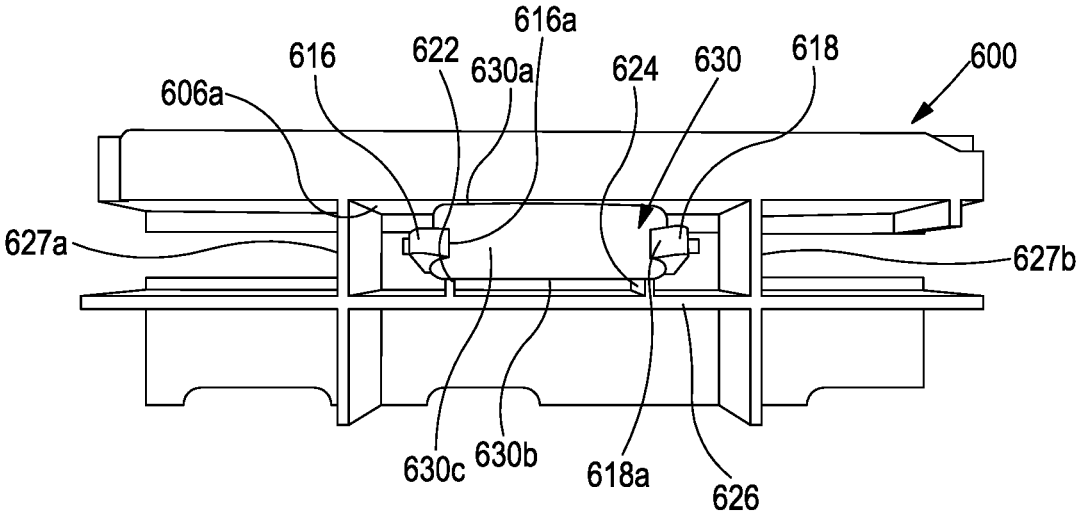
Figure 46:
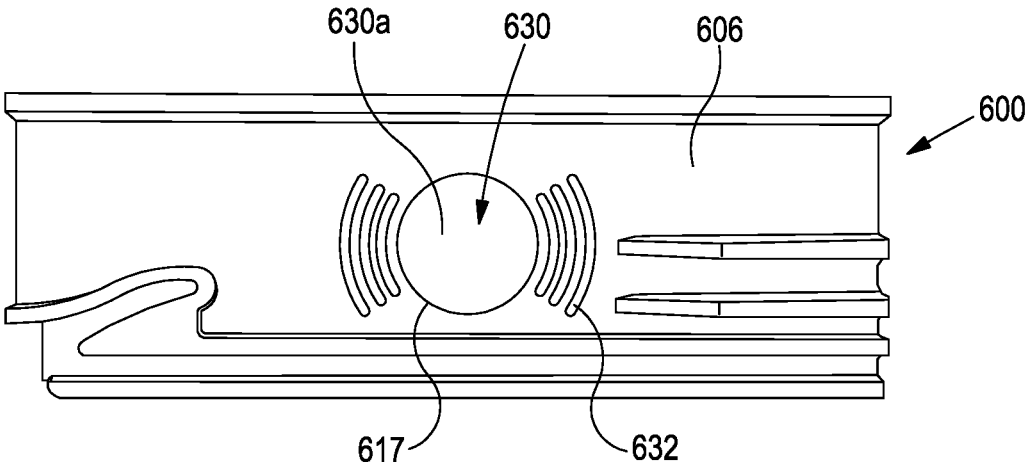
Figure 47:
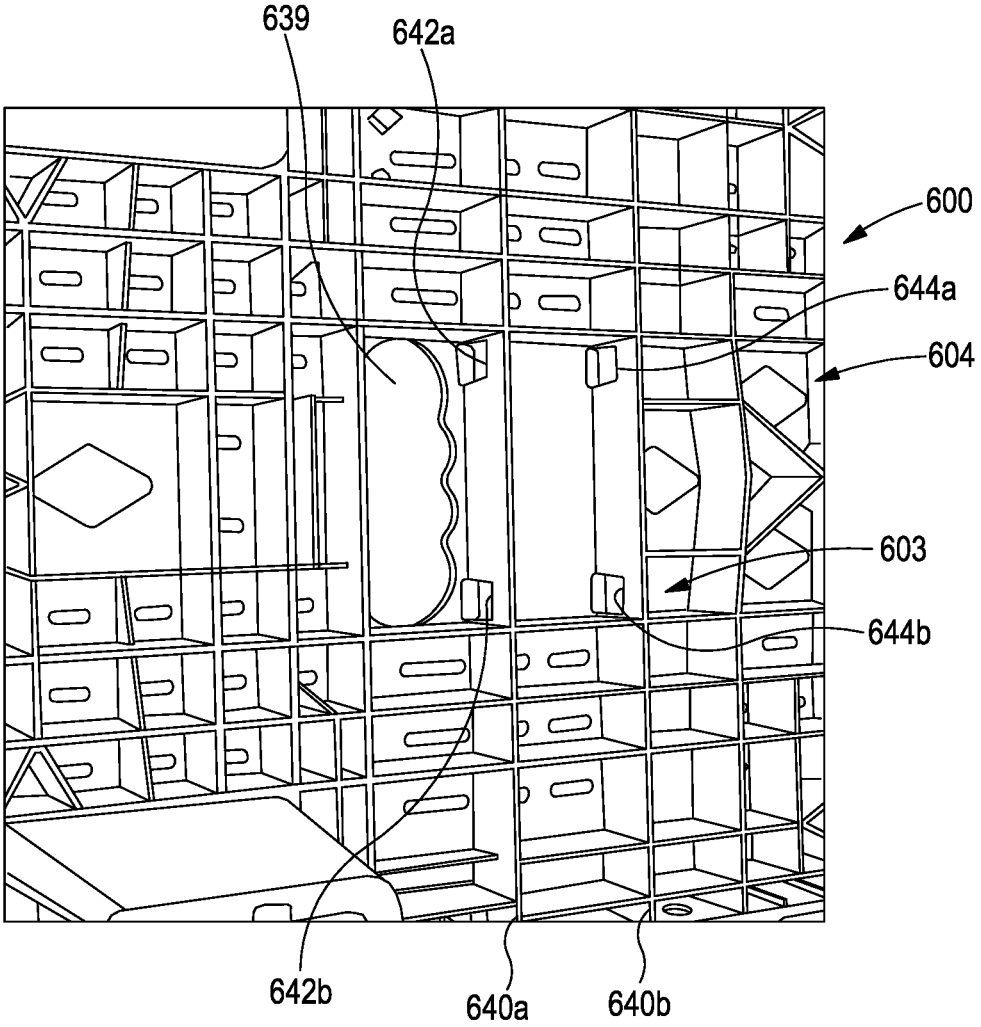
Figure 48:
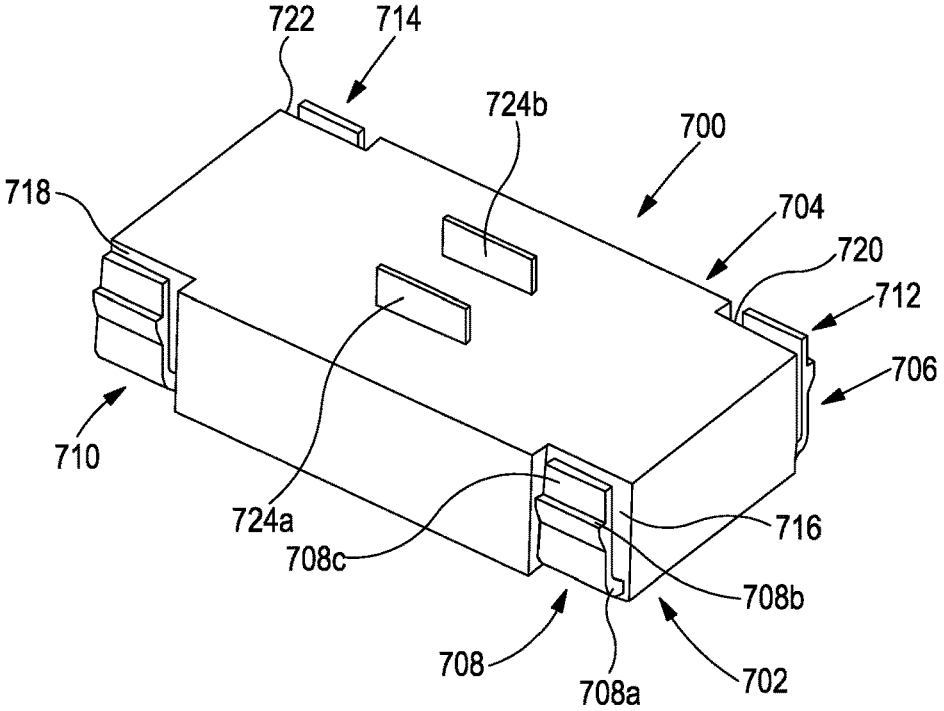
Figure 49:
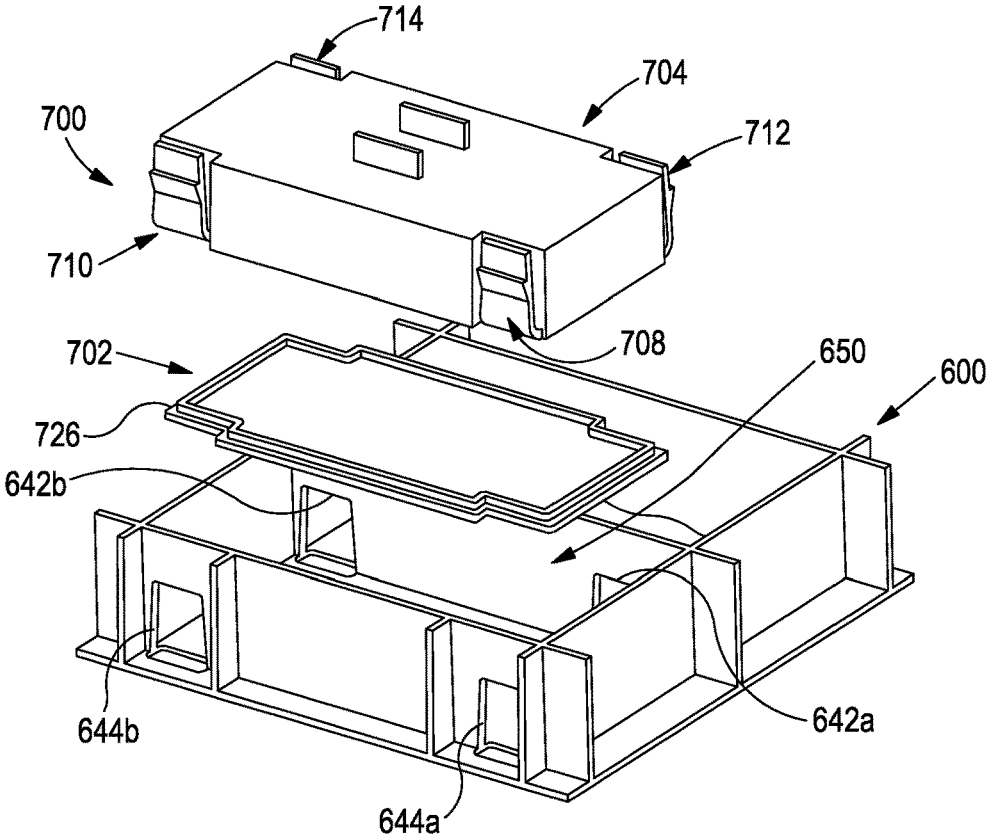
Figure 50:
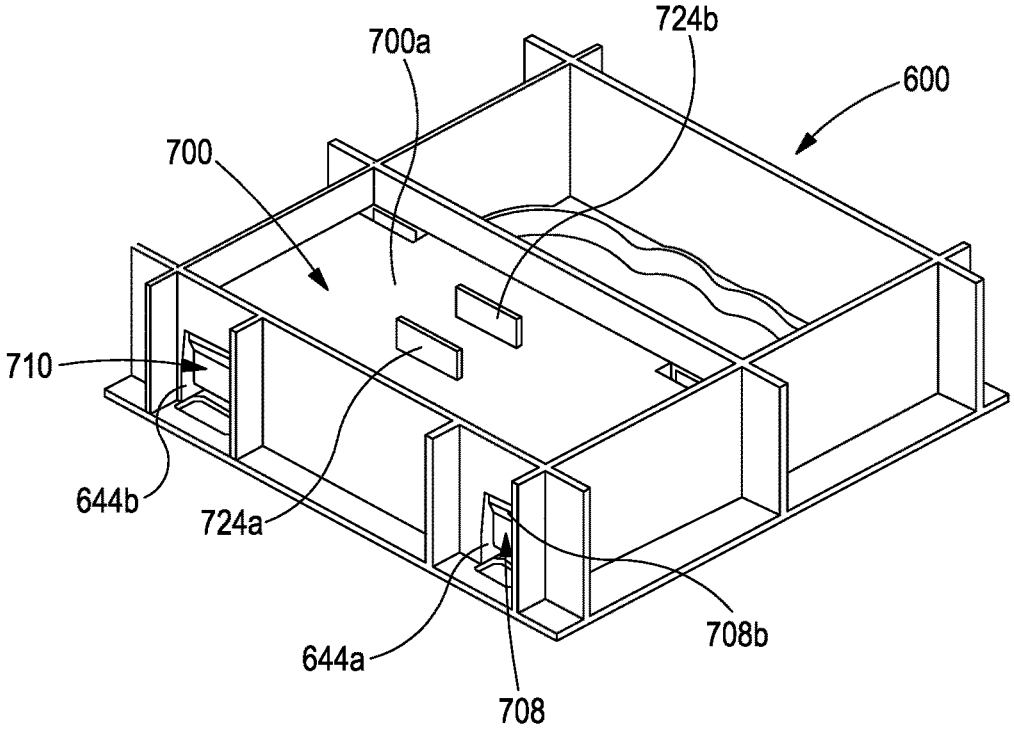
Figure 51:
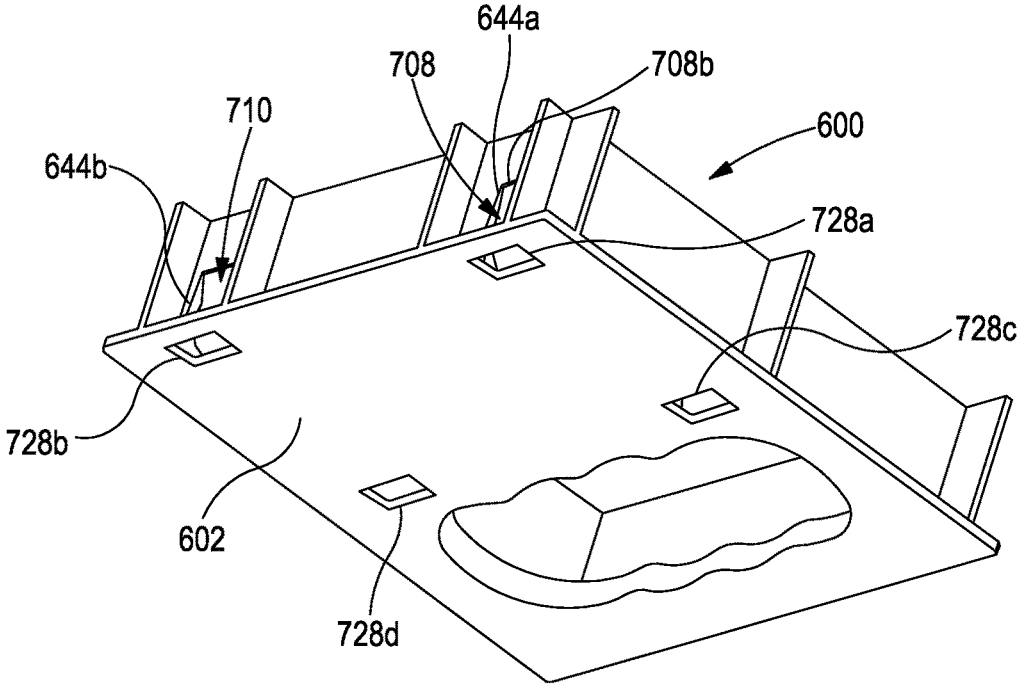
Figure 52A:
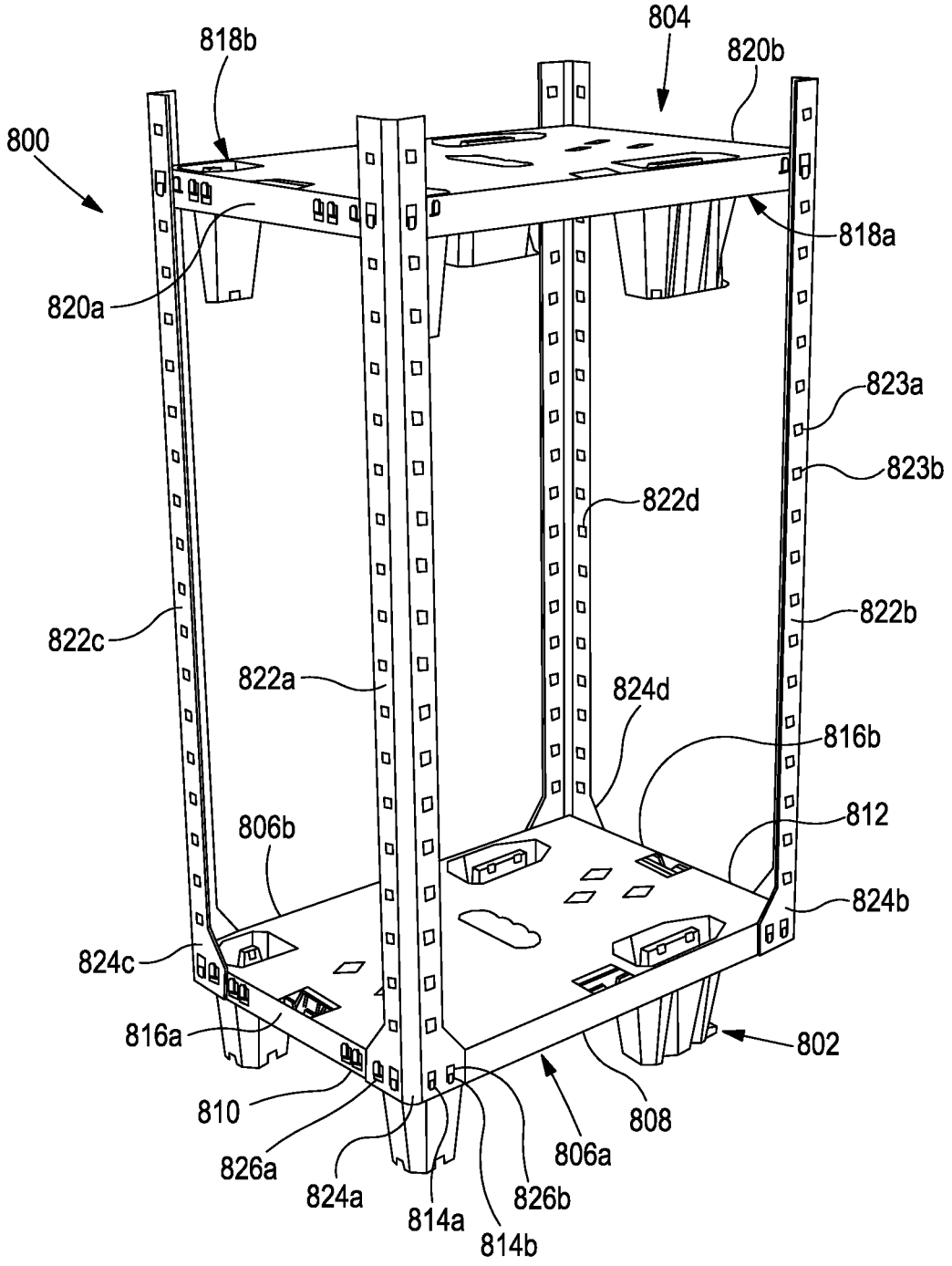
Figure 52B:
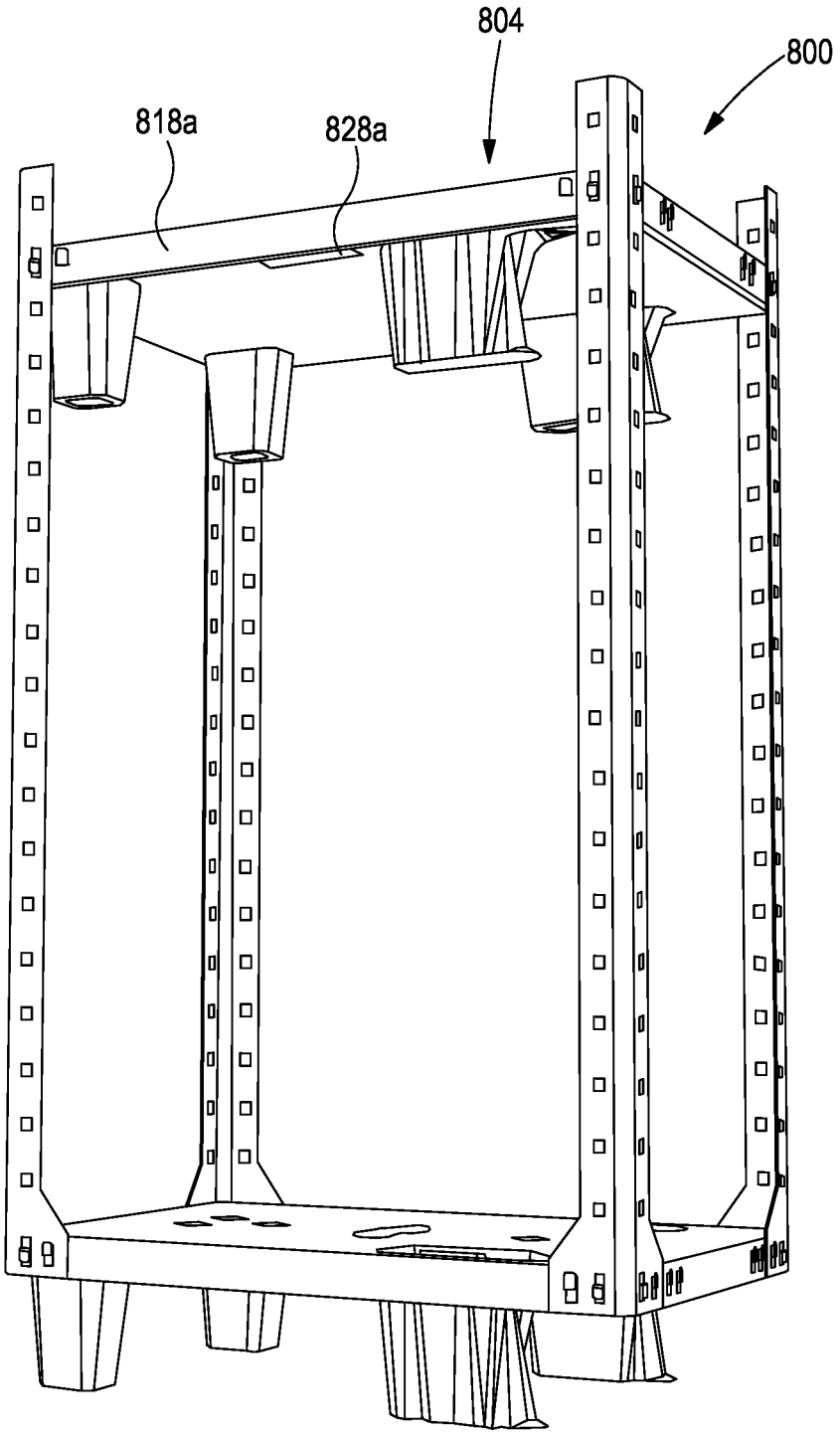
Figure 53:
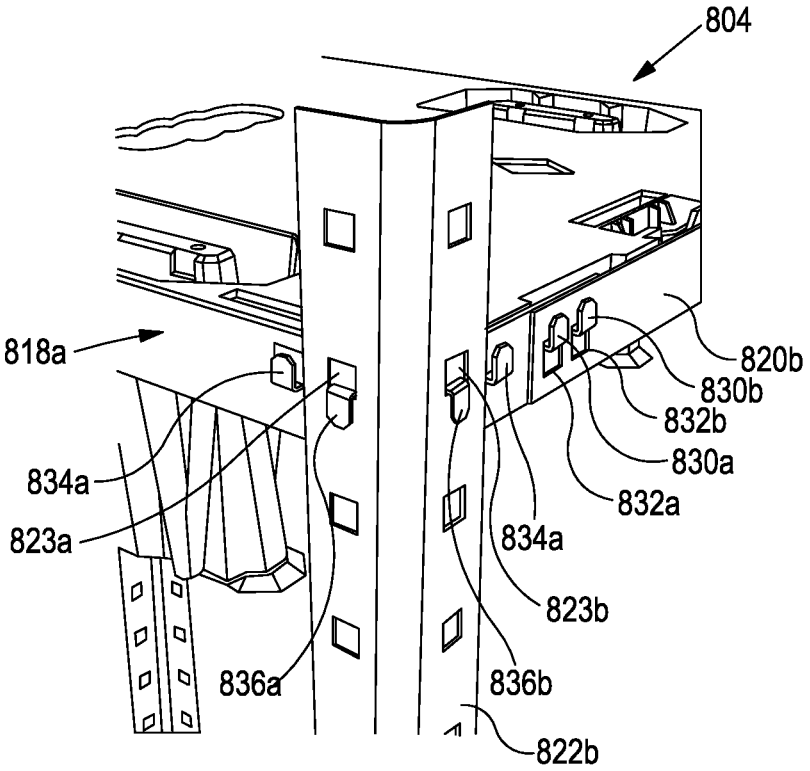
Figure 54:
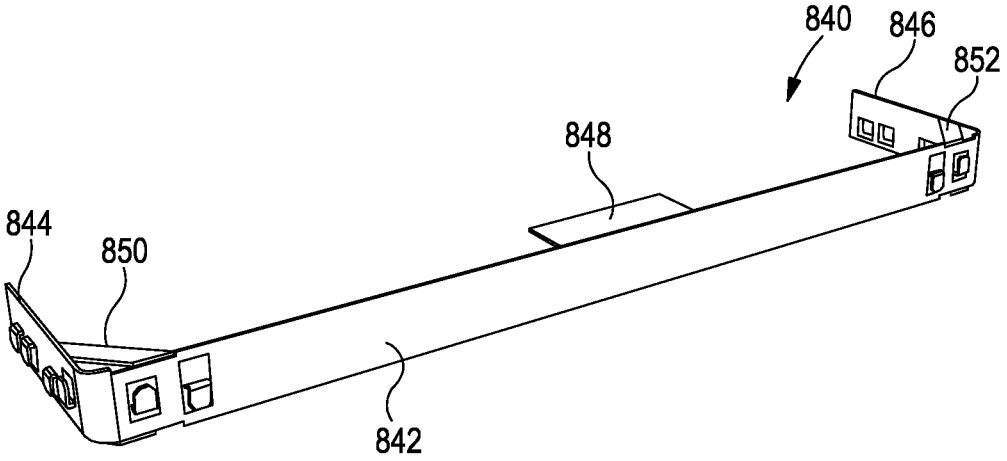
Figure 55:
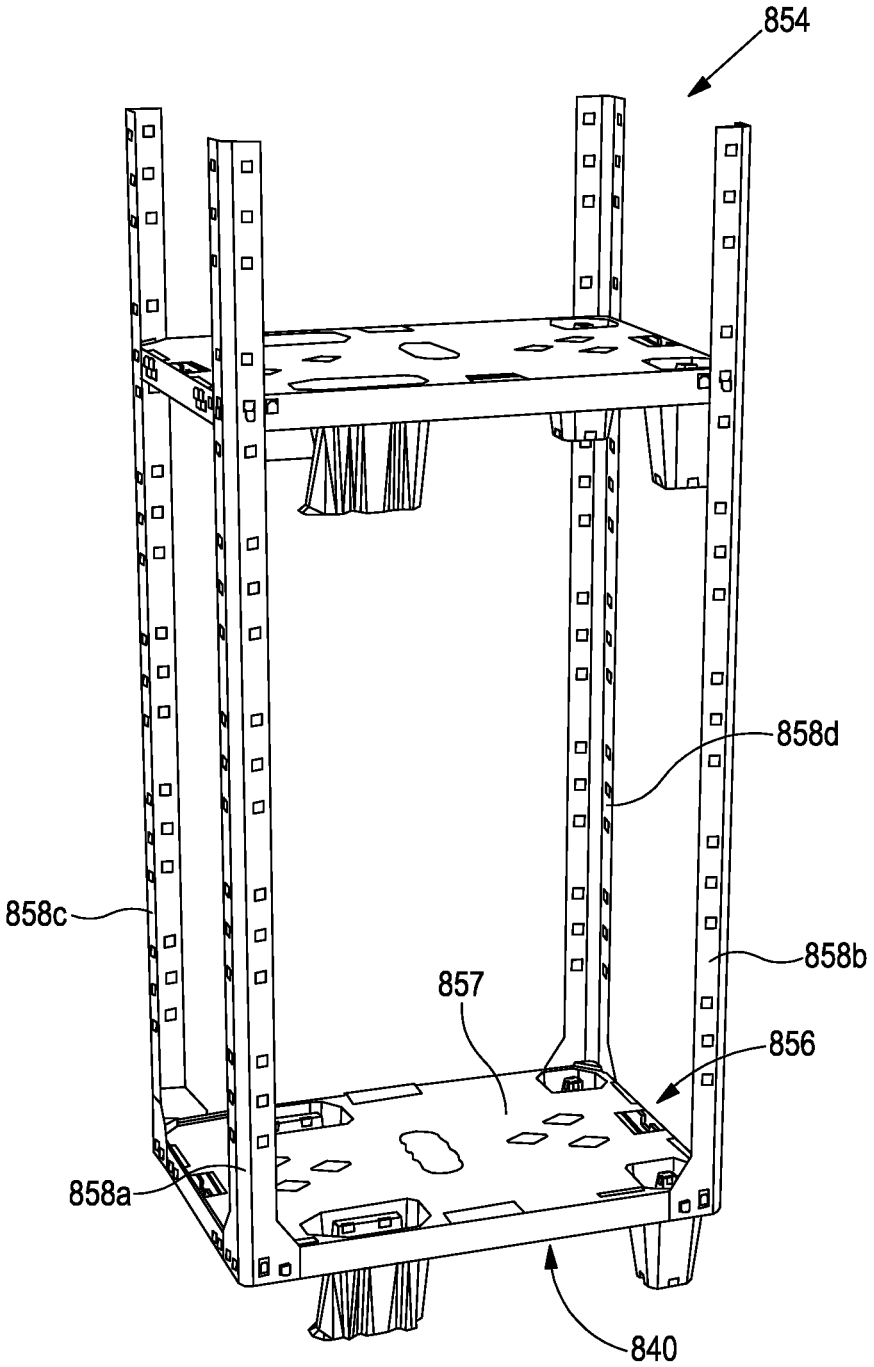
Figure 56:
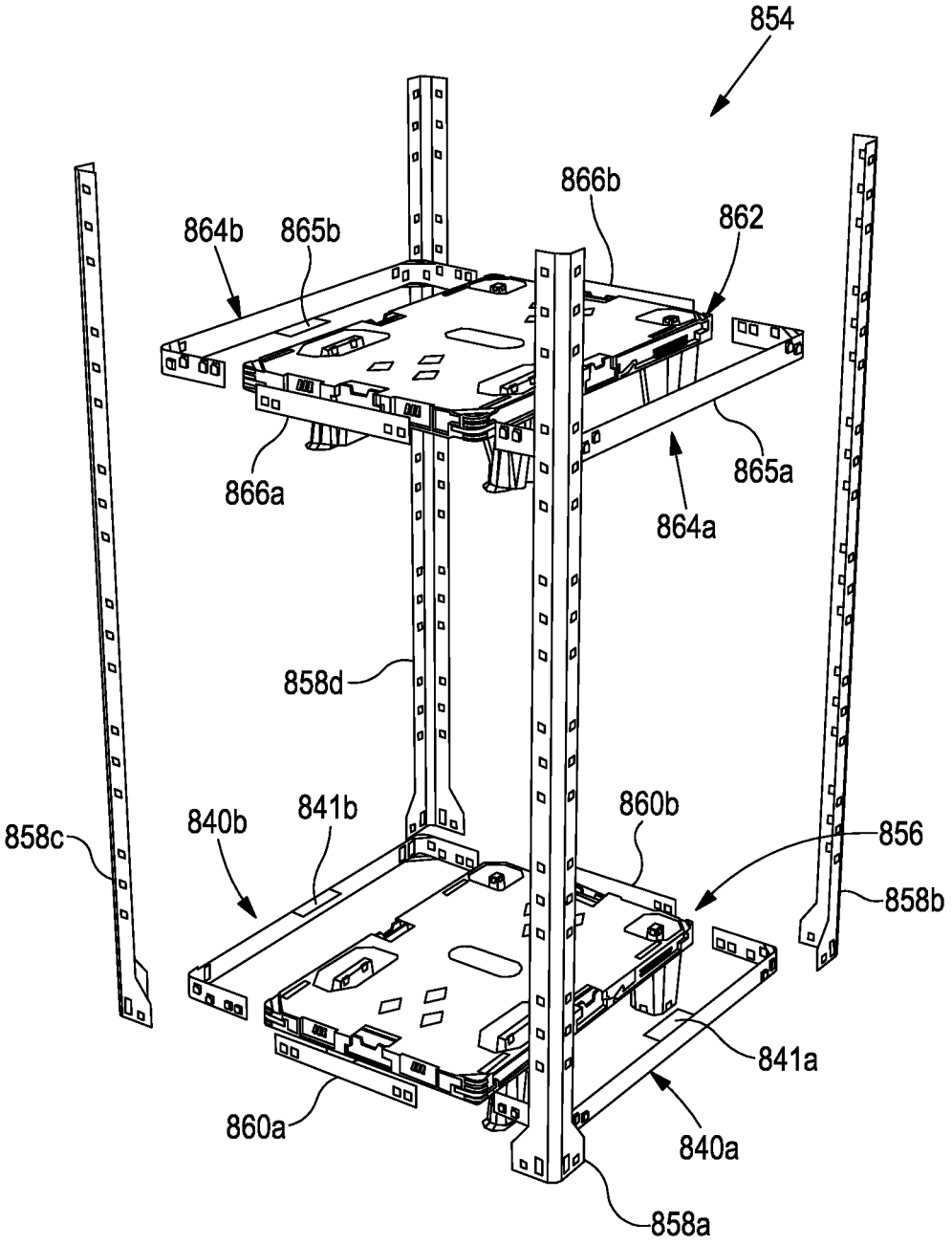
Figure 57A:
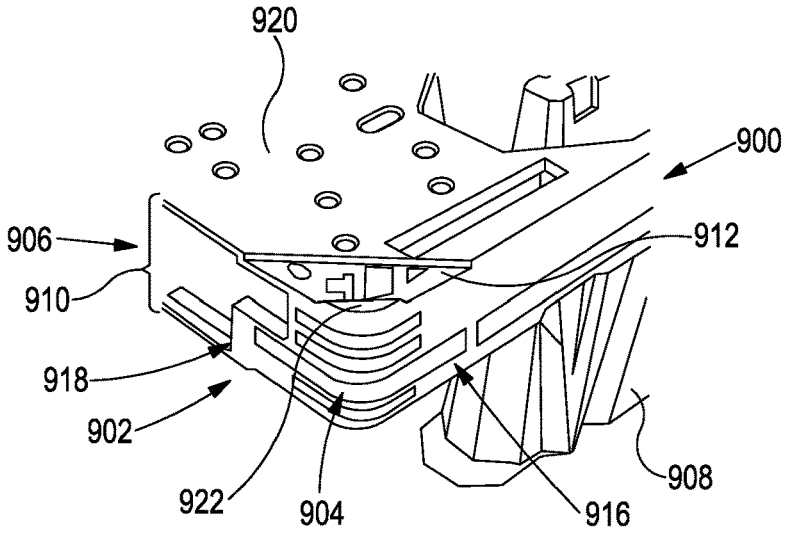
Figure 57B:
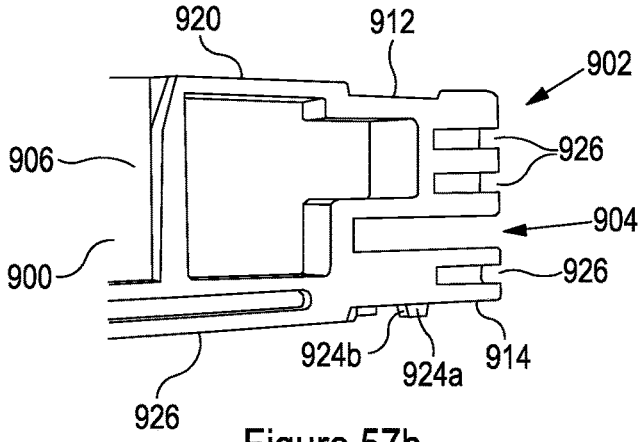
Figure 57C:
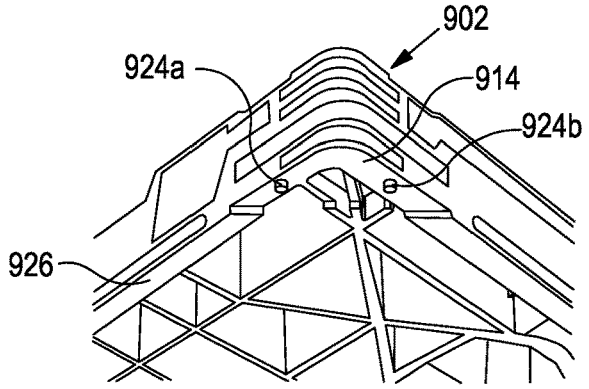
Figure 58A:
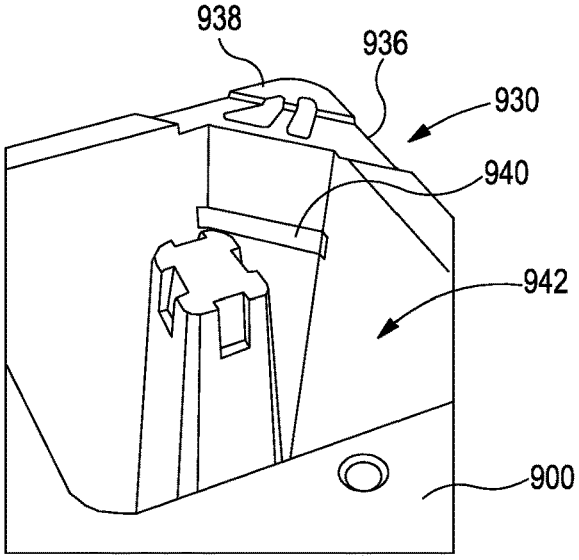
Figure 58B:
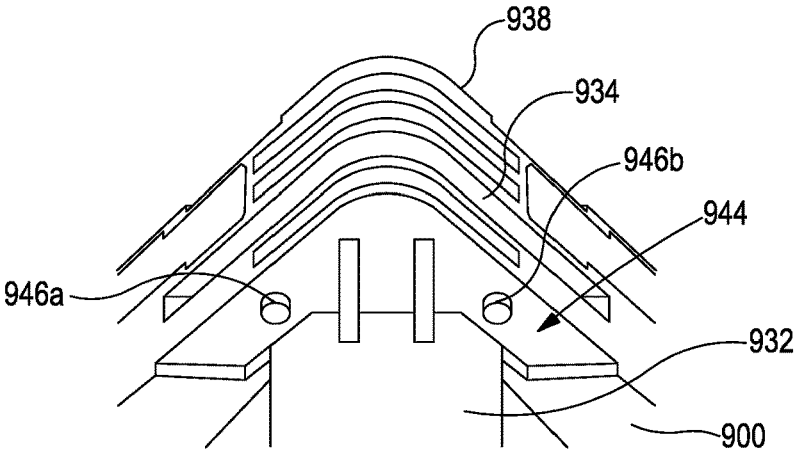
Figure 58C:
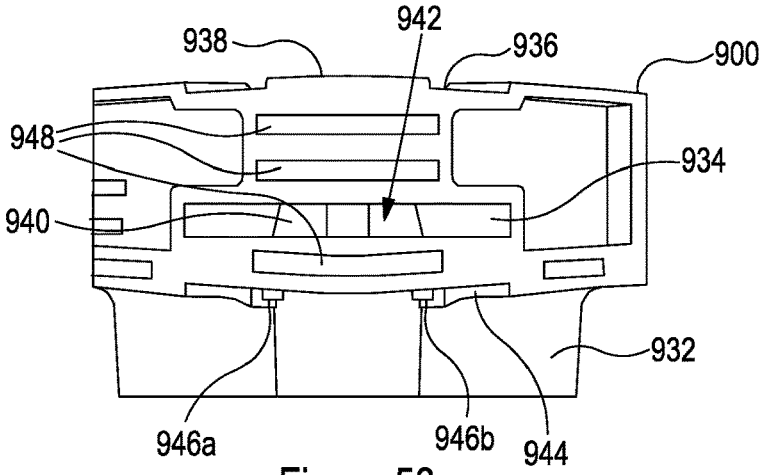

FIG. 29*a* is a close-up side view of on end of the support member of FIG. 29;

FIG. 29*b* is a close-up side view of the other end of the support member of FIG. 29;

FIG. 30 is a perspective view of two support members being inserted into a pallet;

FIG. 31 is an offset side view of one of the corners of the pallet of FIG. 30, with a support member being inserted therein;

FIG. 32 is a plan view of one of the corners of the pallet of FIG. 30, with support member inserted therein;

FIG. 33*a* is an external perspective view of a pallet with support members inserted in corners thereof;

FIG. 33*b* is an internal perspective view of the FIG. 33*a* arrangement;

FIG. 34 is a perspective view of a pallet with four corner bodies inserted in corners thereof;

FIG. 35 is an offset side view of a pallet with a support member being aligned therewith;

FIG. 36 is an angled perspective view of a pallet with a corner body received by a corner thereof, the corner body being partly cutaway;

FIG. 37 is a perspective view of an elevated stacked arrangement, with two support members shown;

FIG. 38 is a perspective view of an elevated stacked arrangement, with four support members shown and pallets loaded with goods or products;

FIG. 39 is a close-up perspective view of a lower pallet of the FIG. 38 arrangement;

FIG. 40 is a view of a pallet with a retention structure according to another aspect of the invention, with four corner bodies inserted in corners thereof;

FIG. 41 is a close-up view of the retention structure of FIG. 40;

FIG. 42 is a side view of part of the pallet of FIG. 40;

FIG. 43 is a plan view of part of the pallet of FIG. 40;

FIG. 44 is a close-up view of the retention structure of FIG. 40, from below;

FIG. 45 is a close-up view of the retention structure of FIG. 40, from below, with an electronic device retained thereby;

FIG. 46 is a side view of part of the pallet of FIG. 40, with electronic device retained by the retention structure thereof;

FIG. 47 is an angled view of an underside of a pallet according to another aspect of the invention;

FIG. 48 is a perspective view of a detachable enclosure according to an aspect of the invention;

FIG. 49 is an exploded view of the detachable enclosure of FIG. 48 being inserted into a part of the pallet of FIG. 47;

FIG. 50 is a perspective view of the FIG. 49 arrangement, with the detachable enclosure connected to the pallet; and FIG. 51 is a rotated view of the arrangement shown in FIG. 50;

FIG. 52*a* is a perspective view of an elevated stacked arrangement incorporating support bodies;

FIG. 52*b* is a rotated view of the FIG. 52*a* arrangement;

FIG. 53 is a close-up perspective view of the FIG. 52*a* arrangement, or a portion thereof;

FIG. 54 is a perspective view of a support body in isolation;

FIG. 55 is a perspective view of a further embodiment of an elevated stacked arrangement incorporating support bodies;

FIG. 56 is a perspective exploded view of the FIG. 55 arrangement;

FIGS. 57*a* to 57*c* are perspective views of a front corner of an alternative embodiment of a pallet;

FIGS. 58*a* to 58*c* are perspective views of a rear corner of the pallet of FIGS. 57*a* to 57*c;*

Figure 62:
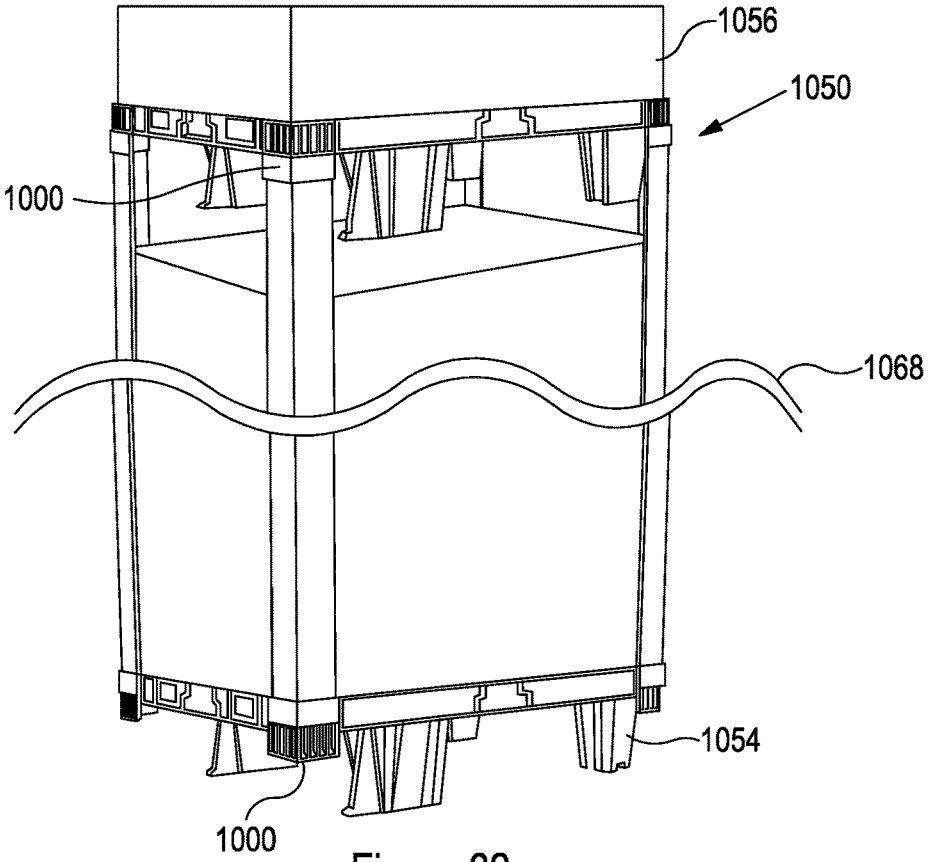
Figure 63:
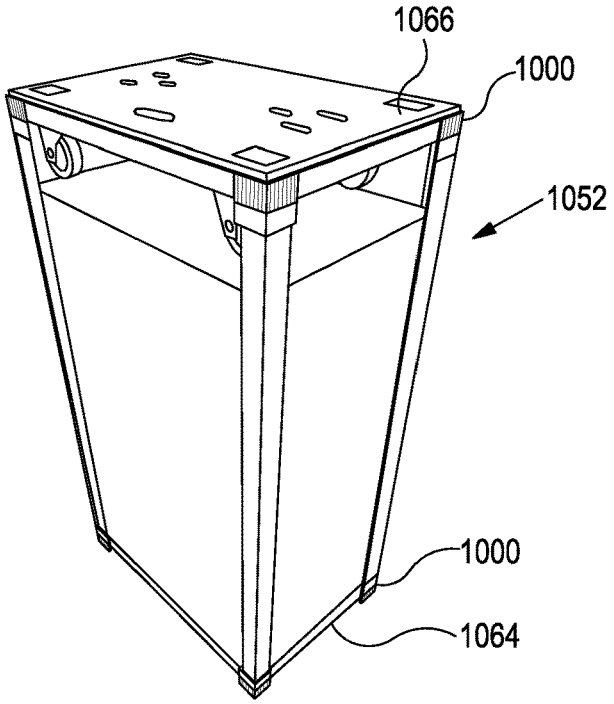
Figure 64:
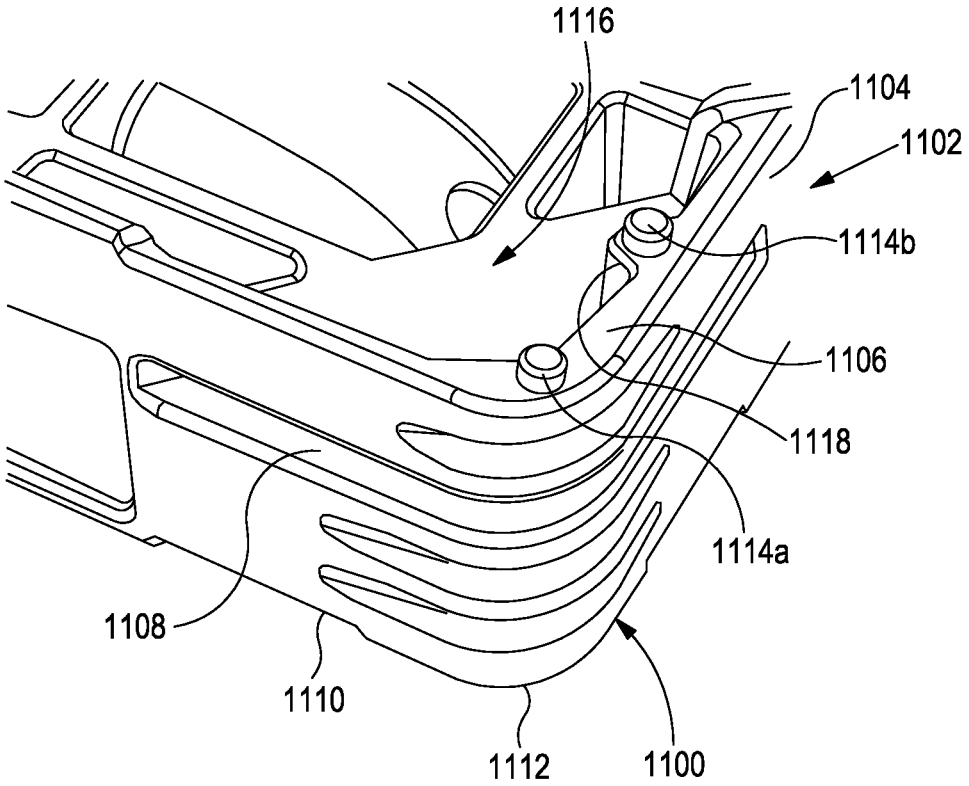

FIGS. 59*a* to 59*d* are perspective views of a corner body according to an alternative embodiment of the present invention;

FIGS. 60 to 63 are perspective views of elevated stacked arrangements according to an embodiment of the invention; and FIG. 64 is a perspective view of an underside of a corner of a dolly according to the invention.

BACKGROUND

Figure 1:
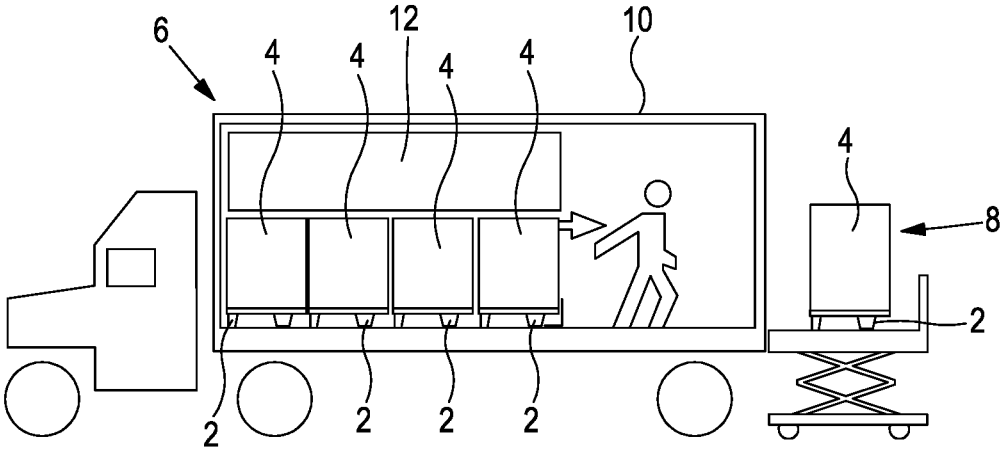
FIG. 1 is a schematic illustration of loaded pallets being unloaded from a trailer of a lorry.

FIG. 1 schematically illustrates pallets 2, with goods 4 stacked on the pallets 2, being unloaded from a lorry 6. Specifically, the pallets 2 with goods 4 stacked on the pallets 2, are transported in, and then unloaded from, a trailer 10 of the lorry 6. The pallets 2 with goods 4 stacked on the pallets 2 will be referred to as loaded pallets 8. As will be observed from FIG. 1, the loaded pallets 8 are shorter in height than the trailer 10 of the lorry 6. As such, there exists a void 12 in the trailer 10 which remains unoccupied during transportation of the loaded pallets 8.

The void 12 represents a wasted volume which, if occupied by loaded pallets 8, could be utilised to enable the lorry 6 to transport more goods. The void 12 represents an inefficiency in the chain of transportation of loaded pallets 8.

The applicant has devised a novel way of stacking loaded pallets 8 on top of one another to thereby utilise the, presently unused, void 12.

Although arguably more goods 4 could be stacked on top of the given pallet 2 in order to increase the height of the loaded pallet 8, this is not necessarily a practical solution, as discussed below.

There are primarily two varieties of loaded pallets 8: point of sale (POS) displays and replenishment pallets.

A loaded POS display may have a height of up to around 1800 mm. This includes the height of the pallet. POS displays display products for promotional purposes. Where such POS displays are loaded onto a pallet 2, the loaded pallet may be sufficiently tall that most of the available vertical space within the trailer 10 is utilised. As such, transportation of POS displays can be reasonably efficient owing to the POS displays utilising more of the available space in the trailer 10.

Replenishment pallets are comparatively shorter. For example, replenishment pallets may be up to around 1200 mm in height (inclusive of the height of the pallet). This height restriction is dictated by the typical height of a first shelf above a floor of the shop floor. That is to say, typically there is 1200 mm between the floor of the shop floor and an underside of a first shelf, or first obstruction vertically upwards. The replenishment pallets should therefore be shorter than the height of the first vertical shelf if they are to be received in the gap provided thereby. It is replenishment pallets for which the present invention is particularly advantageous. This is because the comparatively shorter replenishment pallets would otherwise lead to more space in the trailer 10 being wasted during transportation of loaded pallets 8 which are replenishment pallets.

Given the above, in accordance with the present invention, stacking two loaded pallets 8 of the replenishment variety on top of one another provides the novel advantage that the currently wasted void 12 can be utilised, whilst the dimensions of the loaded pallet 8 remain unchanged and therefore suitable for the loaded pallet 8 to be located on the shop floor.

As well as being more efficient to transport loaded pallets 8, the stacking of loaded pallets also reduces the space requirement for storage of said loaded pallets 8. That is to say, storing two loaded pallets 8 separately requires twice the floor footprint, or floor space, when compared to storing two loaded pallets 8 stacked on top of one another.

This document sets out a number of arrangements which provide the functionality that a loaded pallet 8 may be stacked on top of another loaded pallet 8 in a safe and efficient manner.

The solution is desirably compatible with goods or products of a total height of between around 700 mm to 1200 mm. Furthermore, the solution desirably should not compromise the structural integrity of the goods or products. The solution should desirably also not considerably affect the stability of the loads on the pallets, whether stacked or not.

Existing attempts to optimise truck capacity fall largely within two categories: reinforced secondary and tertiary packaging, and rigid structures to support the upper load. However, these have a number of drawbacks including increased cost and waste, limited flexibility and limited application.

Pallet Design Modifications

Figure 2:
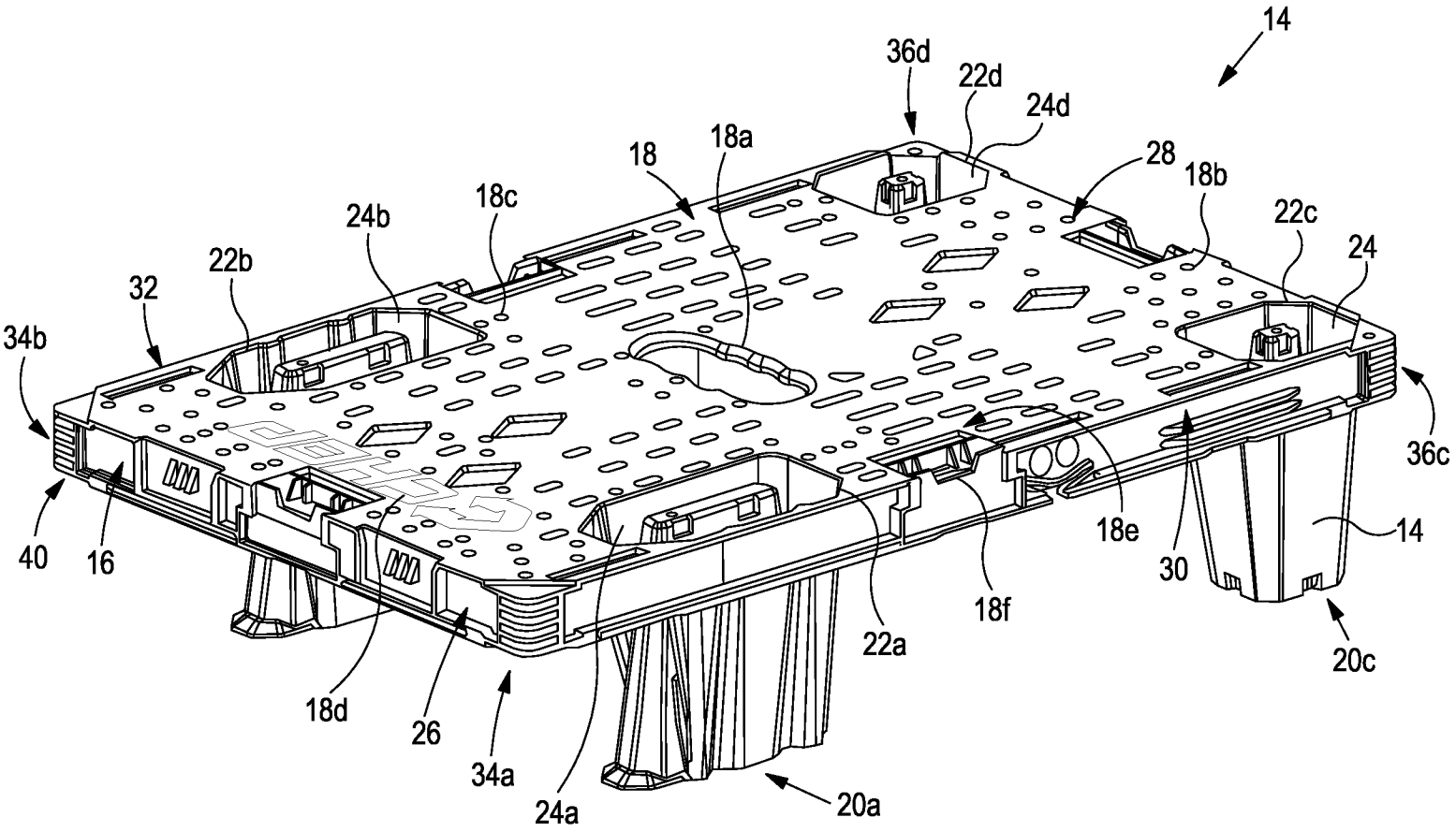
FIG. 2 is a perspective view of a quarter pallet according to an embodiment of the present invention.

FIG. 2 illustrates a quarter pallet 14 according to an embodiment of the invention. Some of the features, but not all, of the illustrated quarter pallet 14 are described in WO2014013230, which is hereby incorporated by reference The quarter pallet 14 comprises a deck 16 and four feet 20*a*, 20*b*, 20*c* and 20*d* (20*b* and 20*d* are not visible in FIG. 2).

The deck 16 has a product supporting surface 18 and an opposing underside (the opposing underside being hidden from view in FIG. 2). The deck 16 is defined as a thickened body, and is not a solid body. In particular, the opposing underside is not a solid surface but is instead a discontinuous surface defined by a plurality of ribs.

Various features are incorporated in the product supporting surface 18. These include, to name some examples, a hand access hole 18*a*, drainage holes 18*b*, gripping nodules 18*c* and a logo 18*d*. Other features include display slots 18*e*, and connectors 18*f*. Cut-outs 22*a-d* are also present in the product supporting surface 18, and correspond with a respective uppermost point of the feet 20*a-d*. Cut-outs 22*a-d* open out into cavities 24*a-d* which are defined by the feet 20*a-d*.

Feet 20*a-d* and cavities 24*a-d* facilitate the direct stacking of a second quarter pallet onto the quarter pallet 14. Direct stacking is intended to mean the stacking of two pallets 14 when no goods are placed on the respective product supporting surfaces 18. In direct stacking, the feet 20*a-d* of the pallet 14 to be stacked penetrate the cut-outs 22*a-d* of the pallet below, and enter the cavities 24*a-d*, in order to reduce the combined height of the directly stacked pallets. The purpose of direct stacking is to reduce the height of, and thereby the volume occupied by, unloaded pallets.

The illustrated quarter pallet 14, more specifically the deck 16, has two short sides 26, 28 and two long sides 30, 32. The short sides 26, 28 may be referred to as the front side 26 and rear side 28 respectively. The feet 20*a-d* may be referred to as front feet 20*a*, 20*b* and rear feet 20*c*, 20*d*.

The feet 20*a-d* are examples of pallet supports. Other examples of such pallet supports include wheels, for example fixed wheels and swivel wheels. Swivel wheels may be swivel caster wheels. Swivel wheels is intended to mean wheels which can rotate about two axes i.e. can rotate to turn the wheel but can also rotate to change the direction in which the wheel is pointing.

The deck 16 also has four corners 34*a*, 34*b* and 36*a*, 36*b*. The corners 34*a*, 34*b* on the front side 26 may be referred to as front corners 34*a*, 34*b*. The corners 36*c*, 36*d* on the rear side 28 may be referred to as rear corners 36*c*, 36*d*.

The invention relates to, among others, features incorporated in the deck 16 to facilitate the elevated stacking of pallets such as the quarter pallet 14 of FIG. 2. These features may be referred to generally as load bearing features 40.

The stacking to which the present invention relates is not that of the direct stacking of unloaded pallets discussed above. As explained in connection with FIG. 1, the present invention relates to the stacking of loaded pallets 8. The stacking to which the present invention relates may therefore be referred to as 'elevated stacking'. In elevated stacking, a stacked loaded pallet is elevated relative to another loaded pallet such that goods can remain on the product supporting surface of at least the lower pallet. It is envisaged that for the majority of instances, goods will remain on the product supporting surfaces of both lower and upper pallets in elevated stacking arrangements. However, this need not always be the case.

The load bearing features 40, and interactions between those features, will be described in further detail below. In particular, three different combinations of load bearing features will be described and illustrated below. Similarly, the elevated stacking of pallets will be discussed in greater detail, including a method for executing elevated stacking.

The load bearing features 40 described and illustrated in this document are all features designed to receive lateral projections of support members. The aforementioned support members, and their lateral projections, will also be described in greater detail below.

Figure 3:
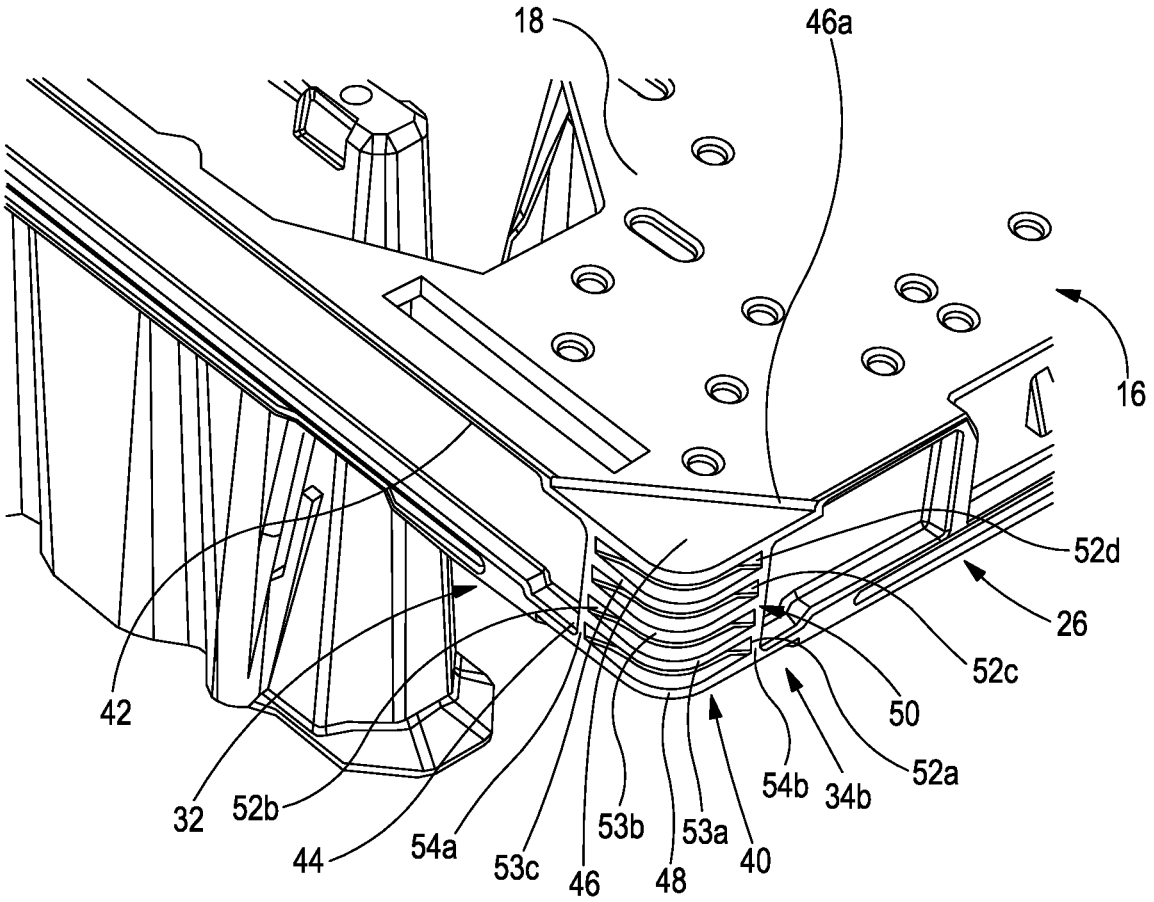
FIG. 3 is a close-up perspective view of a front corner of the quarter pallet of FIG. 2.

FIG. 3 is a close up perspective view of the front corner 34*b* of FIG. 2. FIG. 3 therefore shows part of the long side 32 and the front short side 26 of the deck 16. Also visible in FIG. 3 are upper and lower ribs 42, 44.

The corner 34*b* incorporates the load bearing feature 40. In the present case load bearing feature is an umbrella term for upper and lower recesses, and supporting slots (discussed in more detail below).

In this instance, the load bearing feature 40 comprises upper and lower recesses 46, 48. The upper recess 46 is recessed relative to the product supporting surface 18. The upper recess 46 therefore defines a stepped portion. The upper recess 46 reduces the surface available for supporting products on the product supporting surface 18. The upper recess 46 is generally triangular. The upper recess 46 spans the corner 34*b* diagonally.

Lower recess 48 is recessed relative to an underside of the deck 16. Lower recess 48 is also generally triangular. Lower recess 48 also defines a stepped portion. The lower recess 48 spans the corner 34*b* diagonally.

In FIG. 3 the upper and lower recesses 46, 48 are generally flat. For example, it may be said that a base of each of the recesses is flat, and/or parallel to the plane of the product supporting surface 18. However, either or both of the upper and lower recesses 46, 48 may be angled. As such, the upper and/or lower recesses 46, 48 may be inclined upwards or downwards relative to the product supporting surface 18. The upper recess 46 is defined at least in part by a solid face 46*a* which spans a length of a diagonal side of the upper recess 46.

Both the upper and lower recesses 46, 48 are configured to receive a lateral projection of a support member (discussed in more detail later within this document). As such, the upper and lower recesses 46, 48 provide surfaces upon which lateral projections can rest. This facilitates the elevated stacking of pallets.

Located between upper and lower recesses 46, 48 is a slot array 50. In FIG. 3, the slot array 50 comprises four slots 52*a-d*. A depth of the slots 52*a-d* is not constant across their length. Instead, the depth of the slots 52*a-d* varies along their length. As such, innermost faces of the slots 52*a-d* are bell-like in geometry. In other words, the depth of the slots 52*a-d* is greatest at an outer tip of the corner 34*b*. The outer tip of the corner may also be referred to as the centre or apex of the corner. The depth of the slots 52*a-d* is least, i.e. the slots 52*a-d* are most shallow, at ends of the slots 52*a-d*. The ends of the slots 52*a-d* are defined by vertical ribs 54*a, b*. Vertical rib 54*a* is connected between the upper and lower ribs 42, 44. One of the ends of the slots 52*a-d* is flush with the vertical rib 54*a*. The slots 52*a-d* are vertically separated by walls 53*a-c*. The slots 52*a-d* share the same dimensions. That is to say, the slots 52*a-d* are recessed to the same depth, and span the same portion of the corner 34*b*. However, in other arrangements the slots 52*a-d* may have dimensions which differ from one another.

One or more of the slots 52*a-d* may, in elevated stacking, receive a locating projection of a support member. Due to the relatively shallow depth of the slots 52*a-d* compared with upper and lower recesses 46, 48, any locating projection of the support member received therein would primarily assist in locating a separate lateral projection of the support member for receipt by the load bearing features 40. One example of such a locating projection is a rib. As such, the slots 52*a-d* are not considered to be load bearing features 40.

Upper and lower recesses 46, 48 are the same width and length and are recessed to the same depth. However, this is not essential and the dimensions of the upper and lower recesses 46, 48 may differ. The combination of the upper and lower recesses 46, 48 defines a narrowing portion of the deck 16. That is to say, the upper and lower recesses 46, 48 define a reduced thickness portion of the deck 16. As will be described in further detail below, the upper and lower recesses 46, 48 are configured to receive lateral projections of support members. In other words, upper and lower recesses 46, 48 provide faces upon which corresponding lateral projections of a support member can rest.

FIG. 4 is a close up perspective view of rear corner 36*d*. The corner 36*d* shares a number of features in common with the front corner 34*b* illustrated in FIG. 3. However, due to the load bearing feature 56 being positioned at one of the rear corners 36*c*, 36*d*, there are some differences relative to the load bearing feature 40 of FIG. 3. The differences are due, at least in part, to the proximity of the load bearing feature 56 to rear feet 20*c*, 20*d*. In particular, the variations are due to the presence of the cut-out 22*d* and the different geometry of the surrounding product supporting surface 18.

The main differences between the load bearing features 40, 56 are geometries of the respective upper 46, 58 and lower recesses 48, 60.

Beginning with upper recess 58, because of the proximity of the cut-out 22*d* to the rear corner 36*d*, the upper recess 58 opens out into the cut-out 22*d*. In other words, unlike the upper recess 46 of FIG. 3, the upper recess 58 of FIG. 4 is not defined by a solid face which spans the length of the diagonal side. Instead, upper recess 58 is defined at least in part by two faces 58*b*, 58*c*. There is an opening between the two faces 58*b*, 58*c*. Upper recess 58 also includes a bore 58*a*. The bore 58*a* does not pass through the entire corner 36*a*. That is to say, the bore 58*a* is a blind bore. The bore 58*a* may assist in the drainage of liquids from the deck product supporting surface 16.

FIG. 5 is a perspective view of the rear corner 36*d* from beneath. FIG. 5 shows lower recess 60 more clearly. The lower recess 60 is generally triangular in form. The lower recess 60 is defined at least in part by a surface of the rear foot 20*d*. In particular, the lower recess 60 is defined at least in part by a chamfered edge 62 of the rear foot 20*d*. The chamfered edge 62 provides an uninterrupted plane through the lower recess 60. That is to say, the chamfered edge 62 allows a flat triangular surface to fit flush into the lower recess 60, across an L-shaped face of the lower recess 60.

The upper recesses 46, 58 have generally perpendicular sides which are 35 mm long. The generally perpendicular sides of the upper recess 58 are labelled with the numerals 58*d*, 58*e* in FIG. 4. Upper recesses 46, 58 are recessed to a depth of between about 1.5 to 2 mm relative to the product supporting surface 18.

The first embodiment provides a contact area between the lateral projections and the load bearing features 40, without compromising the structural integrity of the pallet at the corners.

The use of the load bearing features 40, 56 in elevated stacking of two pallets is now described.

FIG. 6*a* is a side view of rear ends of two quarter pallets 14*a*, 14*b* separated by a support member 64. The support member 64 will be described in greater detail below.

A lower pallet 14*a* forms a base of the elevated stacked arrangement 66. An upper pallet 14*b* is elevated above the lower pallet 14*a*. The elevation is provided by the support member 64. That is to say, the upper pallet 14*b* is lifted or supported above the lower pallet 14*a* by the support member 64.

The support member 64 is adjustable in the illustrated arrangement 66. The support member 64 comprises a first portion 68 and a second portion 70. The first and second portions 68, 70 are moveable relative to one another such that the support member 64 is adjustable. By adjustable, what is meant is that the first and second portions 68, 70 are moveable relative to one another such that the overall height (or length) of the support member can be changed, thereby changing the height between the upper and lower pallets (or separation between the upper and lower pallets).

Each of the first and second portions 68, 70 comprise a respective lateral projection 72, 74. The lateral projections 72, 74 are received by the load bearing features 56 of the rear corners of the lower and upper pallets 14*a*, 14*b*.

The lateral projection 72 of the first portion 68 is received by the upper recess 58 in the lower pallet 14*a*. As such, a lower face of the lateral projection 72 rests on the upper recess 58. The lateral projection 74 of the second portion 70 is received by the lower recess 60 in the upper pallet 14*b*. The lower recess 60 in the upper pallet 14*b* rests on an upper face of the lateral projection 74.

Although not illustrated, further equivalent support members will also be used in the three remaining corners of the pallets 14*a*, 14*b*. Similarly, and as will be described later in more detail, further reinforcement to detachably secure the support members to the pallets may be used.

Both lower and upper pallets 14*a*, 14*b* are shown with no products or goods on the respective product supporting surfaces. However, in use, it is expected that products or goods will be present on the product supporting surfaces.

A method of elevated stacking the upper pallet 14*b* on the lower pallet 14*a* may include the following steps. Initially, the lower pallet 14*a* is positioned such that the corners, and so load bearing features, are externally accessible. If not already loaded, products can then be loaded onto the product supporting surface of the lower pallet 14*a*. A protective and securing layer, such as a film, may then be applied over the lower pallet 14*a* with products stacked thereon. The upper pallet 14*b* is then loaded with goods and the upper pallet 14*b* is positioned directly above, i.e. elevated relative to, the lower pallet 14*a*. A film may also be applied over the upper pallet 14*b* with products stacked thereon. Each support member 64 is then adjusted to the desired height, the desired height being equivalent to the desired vertical distance between the pallets 14*a*, 14*b*. The upper pallet 14*b* is positioned above the lower pallet 14*a* by more than the desired vertical distance. This allows each support member to be inserted more easily because there is vertical clearance between at least some of the lateral projections and the load bearing features which receive the lateral projections. Each support member 64 is then aligned with a respective upper recess of the lower pallet 14*a* and respective lower recess of the upper pallet 14*b*. Each support member 64 is then inserted laterally such that the lateral projection 72 of the support member 64 is received by the corresponding lower recess of the pallet 14*a*. The upper pallet 14*b* is then lowered such that the lateral projection 74 of each support member is received by the respective lower recess of the upper pallet 14*b*. The lowered height of the upper pallet 14*b* corresponds with the desired vertical distance between the upper pallet 14*b* and the lower pallet 14*a*. Straps or film may then be secured around either the support members or the entire elevated stacked arrangement 66, to secure the arrangement 66 (described in further detail below in connection with FIGS. 16*a* and 16*b*). The film may be a stretch film.

The above method thereby provides steps of elevated stacking two loaded pallets, which can be used to improve the use of space in the trailer 10 of a lorry 6 in the arrangement illustrated in FIG. 1.

In order to remove the upper pallet 14*b* from the elevated stacked arrangement 66, any straps or film securing the arrangement 66 are first removed. The upper pallet 14*b* is then lifted upwards, away from the lower pallet 14*a*. It is anticipated that any movement of the upper pallet 14*b* or lower pallet 14*a* be carried out using standard equipment such as one or more forklifts, cranes or pallet trucks. Once the upper pallet 14*b* is lifted high enough that the lateral projection 74 of each support member disengages the lower recess of the upper pallet 14*b*, the upper pallet 14*b* is free of the support member 64. As such, the upper pallet 14*b* can be moved accordingly. With the lateral projection 74 of each support member having disengaged the respective lower recess of the upper pallet 14*b*, the support member 64 can be removed (that is to say, the lateral projection 72 of each support member 64 is removed from the corresponding lower recess of the pallet 14*a*). The lower pallet 14*a* can then be moved accordingly. The steps set out in the above method may be carried out in a different order. For example, the lower pallet 14*a* could be moved with the support member 64 still engaged.

FIG. 6*b* is a side view of rear ends of two quarter dollies 76*a*, 76*b* separated by the support member 64. Although the incorporation of load bearing features in dollies is not described in detail, it will be understood that the load bearing features described in connection with pallets are readily combinable with dollies. In particular, the load bearing features described above are readily combinable with a dolly such as a quarter dolly described in WO2017130167, which is incorporated herein by reference.

The quarter dollies 76*a*, 76*b* are in an elevated stacked arrangement 78 similar to that described above in connection with FIG. 6*a*. Due to the identical nature of the load bearing features of the quarter dollies 76*a*, 76*b* and the quarter pallets 14*a*, 14*b*, and the same support member 64 being used, the arrangement 78 and methods of stacking and unstacking are entirely equivalent and hence will not be described in detail, for the sake of brevity.

FIG. 7 is a perspective view of a front corner 80*b* of a quarter pallet 82 according to a further embodiment of the invention.

Like features which are common to both the present and the previous embodiment will have corresponding reference numerals increased by 100. Due to the similarities between the embodiments, only the different features will be described in detail.

Front corner 80*a* comprises load bearing feature 84. Like in the previous embodiment, the load bearing feature 84 comprises upper recess 146. Upper recess 146 is recessed relative to product supporting surface 86. The upper recess 146 is generally triangular. Upper recess 146 is defined at least in part by a solid face 147 which spans a diagonal of the front corner 80*a*. The generally perpendicular sides 149*a*, 149*b* of the triangle defining the upper recess 146 are each 40 mm long. Upper recess 146 is recessed relative to the product supporting surface 86 by a depth of between about 1.5 mm to about 2 mm.

A plurality of cut-outs 88*a-d* are present in a face 146*a* of the upper recess 146. These cut-outs 88*a-d* facilitate the manufacture of the quarter pallet 82 and do not provide any functionality with regard to elevated stacking. The cut-outs

88*a-d* may facilitate the drainage of surface liquids from the product supporting surface 18.

Unlike the previous embodiment, load bearing feature 84 does not include a lower recess. As such, a lower edge 81 surrounding the front corner 80*a* is not interrupted by any load bearing features.

The front corner 80*a* includes a slot array 89. Furthermore, slot array 89 comprises slots 152*a-c* like in the previous embodiment. However, slot array 89 further comprises an enlarged slot 90. The enlarged slot 90 is bigger than the slots 152*a-c*. The enlarged slot 90 may be referred to as supporting slot 90.

The supporting slot 90 is dimensionally larger than shallow slots 152*a-c*. Supporting slot 90 is similar in length and width to the upper recess 146. As such, when viewed in plan, supporting slot 90 is around 40 mm long and 40 mm wide. Supporting slot 90 is a rectangular aperture when viewed at an angle normal to the solid face 147. The supporting slot 90 is 5 mm in height.

The supporting slot 90 is defined by a lower face 90*a*, an inner face 90*b* and an upper face (hidden from view in FIG. 7). The supporting slot 90 is a load bearing feature. The supporting slot 90 is configured to receive a lateral projection of a support member. One or two of the constituent faces of the supporting slot 90 may therefore rest on lateral projection of a support member. As such, the supporting slot 90 facilitates the elevated stacking of the quarter pallet 82.

The slot array 89 is positioned beneath the upper recess 146. As such, the upper recess 146 defines an upper surface of the slot array 89.

The outer edges of the slot array 89 are, like in the first embodiment, defined by ribs. However, unlike the first embodiment, due to the presence of the supporting slot 90, a vertical rib 91 which spans between a upper rib 142 and a lower rib 144 is not a straight rib. Instead, a portion of the vertical rib 91 is offset in the regions surrounding the supporting slot 90 in order to accommodate the dimensionally larger supporting slot 90.

FIG. 8 is a close up perspective view of a rear corner 94*d* of the quarter pallet 82. The arrangement shown in FIG. 8 shares many features with that shown in FIG. 7 and so will, generally, not be described in detail.

A notable difference between the upper recess 146 of the front corner 80*a* of FIG. 7 and an upper recess 158 of the rear corner 94*d* of FIG. 8 is the arrangement of cut-outs 96*a*, 96*b*. Also, the upper recess 158 opens out into cut-out 122*d* of rear foot 120*d*. The cut-outs 96*a*, 96*b*, similar to that in FIG. 7, are present to facilitate the manufacture of the quarter pallet 82. Again, similar to that described in the first embodiment, and in particular in connection with FIG. 4, the upper recess 158 does not have a solid rear face spanning the diagonal side of the recess due to the proximity of the rear foot 120*d* and associated cut-out 122*d*. A further effect of the proximity of the rear foot 120*d* to the load bearing feature 98 is that the supporting slot 90 opens out into cavity 124*d*. This is shown more clearly in FIG. 9.

As shown in FIG. 9 an orifice 90*d* of the supporting slot 90 opens out into the cavity 124*d*. The orifice 90*d* therefore provides a cut-out through which a lateral projection can penetrate in order to more securely be received in the supporting slot 90. It is noted that the upper recess 159 in FIG. 9 only incorporates a single cut-out 159*a* in the upper face. This is due to the FIG. 9 illustration being representative of the rear corner 136*c*. The plurality of cut-outs 96*a*, 96*b* shown in FIG. 8 is a preferred arrangement over the single cut-out 159*a* of FIG. 9.

The supporting slot 90 replaces the lower recess of the previous embodiment in order to reduce the stress experienced by the feet of the pallet. Due to the comparatively larger recesses in this embodiment, the lower recess would otherwise negatively impact the structural integrity of the rear feet.

FIG. 10 is a perspective view of the rear corner 136*d* from beneath. Of note in FIG. 10, a recess 100 is defined between an inner face of a lower rib 137 of the deck 116 and a chamfered edge 162 of the rear foot 120*c*.

As will be described in connection with FIGS. 11*a* and 11*b*, the combination of the supporting slot 90 and the upper recesses 146, 158 facilitate the elevated stacking of the quarter pallet 82.

FIG. 11*a* illustrates a side view of the rear end of two quarter pallets 82*a*, 82*b* separated by a support member 64. The upper pallet 82*b* is elevated relative to the lower pallet 82*a* by the support member 64. As before, only one support member of the four (one for each corner of the pallets) is shown in the figure.

The lateral projection 72 of the first portion 68 of the support member 64 is received by the upper recess of the lower pallet 82*a*. In other words, the lateral projection 72 rests on the upper recess of the lower pallet 82*a*. The lateral projection 74 of the second portion 70 is received by the supporting slot 90 of the upper pallet 82*b*. As such, the lateral projection 74 rests on the upper face of the supporting slot 90 of the upper pallet 82*b*. Furthermore, the lateral projection 74 may penetrate the orifice 90*d* (see FIG. 9) of the supporting slot 90 of the upper pallet 82*b* to more fully engage the supporting slot 90.

The method of elevated stacking the upper pallet 82*b* onto, and subsequently removing it from, the lower pallet 82*a* using the support members 64 is similar to that described in connection with the first embodiment. The primary difference is that when the support members 64 are laterally inserted, the lateral projection 74 of each support member is received by the respective supporting slot 90 of the upper pallet 82*b*. As mentioned above, the lateral projection 74 may further penetrate the orifice of the supporting slot 90 of the pallet 82*b*.

FIG. 11*b* illustrates two quarter dollies 104*a*, 104*b* separated by support member 64. The features required to implement a method of elevated stacking the upper dolly 104*b* are largely identical to that of the arrangement illustrated and described in connection with FIG. 11*a*. As such, for the sake of brevity, FIG. 11*b* will not be described in detail.

FIG. 12 is a perspective view of a rear corner 236*c* of a of a quarter pallet 108 according to a further embodiment of the invention. The quarter pallet 108 shares many features in common with the previous two embodiments. In particular, the quarter pallet 108 comprises a load bearing feature 110 in the form of an upper recess 112. However, unlike the previous two embodiments, in the present embodiment the upper recess 112 is of the form of a trench or channel 113 which is recessed into the product support surface. The trench 113 is defined at least in part by a corner tip 114. The corner tip 114 is a body in the corner region (or apex region) of each of the corners of the deck. The corner tip 114 may be referred to as a tip support. A lateral projection in the form of a strap is received by the trench 113. The length of generally perpendicular sides forming the trench 113 and corner tip 114 is 40 mm. The trench 113 is preferably at least around 10 mm in width when viewed in plan, more preferably around 14 mm.

The corner tip 114 increases the height of an outer face of the upper recess 112 relative to the product supporting surface. In other words, the corner tip has a height which is greater than that of a base of the upper recess, and which is substantially the same as the height of the product supporting surface. It follows that an upper surface of the corner tip and the product supporting surface generally lie in the same plane. As such, any goods or products placed on the product supporting surface will not sag in the corners. The combination of the upper recess 112 and the corner tip 114 (along with the product supporting surface) thereby define the trench 113 into which a lateral projection can be received.

The corner tips 114 are beneficial because they form a separate portion of the product supporting surface in the corners of the deck. Products loaded on the pallet are supported by the corner tips 114 in the outermost points of the corners, which could otherwise sag. The presence of the corner tips 114 therefore means that the risk of products loaded on the product supporting surface sagging, or deflecting excessively, due to the presence of the upper recess is reduced.

For some POS displays, the corners are the strongest point of the assembly. As such, the corner tips 114 provide a ledge upon which the corners of the POS display can rest when the POS display is located on the pallet. This means that the display is supported in its strongest region, which improves the overall strength of the POS display on the pallet. Where corner tips 114 are not incorporated, further components or features may otherwise be required to support the corners of the POS display, or goods stacked thereon. Incorporation of the corner tips 114 is therefore preferable for reasons of improved aesthetics, simpler use, fewer components and likely reduced cost.

Because of the existence of the corner tip 114, whilst the support members are generally laterally inserted between the upper and lower pallets in the manner discussed above, it is necessary to raise the strap lateral projection such that it clears the corner tip before being received by the trench. Furthermore, being as the corner tip may support part of goods or products placed on the product supporting surface, it may be necessary for the strap to be received by the trench before goods or products are placed on the relevant part of the product supporting surface and/or corner tip.

Also shown in FIG. 12 is an orifice 190*d*. The orifice 190*d* is the point at which a supporting slot 190 opens out into a cavity 224*c*, in a manner which corresponds with the previous embodiment.

FIG. 13 is a perspective view, slightly from beneath, of a front corner 234*b* of the quarter pallet 108. The front corner 234*b* comprises a load bearing feature 116 which is similar to the load bearing feature described in connection with the previous embodiments. In particular, the load bearing feature 116 comprises a supporting slot 122, upper recess 112 and lower recess 160. All of the aforementioned constituent features of the load bearing feature 116 are configured to receive a lateral projection of a support member.

Also visible in FIG. 13 is a slot array 118 with slots 120*a-c*. Corner tip 114 is also shown in the region of the upper recess 112.

FIG. 14 is a perspective view of the rear corner 236*c* from beneath. Lower recess 162 is also shown. Similar to previous embodiments, lower recess 162 is defined in part by a chamfered edge 259 of the foot 220*d*. The lower recess 162 is generally triangular but also incorporates two end portions 162*a*, 162*b*. The two end portions 162*a*, 162*b* are generally rectangular and extend from a generally triangular portion of the lower recess 162. The end portions 162*a*, 162*b* are about 8 mm wide by about 12.5 mm in length. As such, the lower recess 162 is wing-like in geometry. The lower recess 162 is 27 mm in height and width. The lower recess 162 is recessed by a depth of about 2 mm. In alternative arrangements the lower recess 162 may be recessed by a depth of between about 1 mm to about 3 mm.

The wing-like geometry of the lower recess 162 increases the surface area available for receiving a lateral projection. That is to say, the shape of the lower recess 162, specifically the combination of the generally triangular geometry and two end portions 162*a*, 162*b*, increases the surface area available for receipt of a lateral projection. This is achieved whilst avoiding, or reducing, any potential clash or impact of the lateral projection, and so support member, with structural elements of the pallet such as the corners and/or feet.

Generally, the geometries of the load bearing features across all of the embodiments are selected to increase the surface area available for abutment by lateral projections, and to reduce the risk of the lateral projections and/or support members impacting and potentially damaging other parts of the pallet, such as the corners and/or feet.

FIG. 15*a* illustrates two quarter pallets 108*a*, 108*b* separated by support member 64 in an elevated stacked arrangement 71. As before, only one support member of the four (one for each corner of the pallets) is shown in the figure.

Support member 65 differs from the previous embodiments in that a first portion 69 incorporates two lateral projections 72, 73. The lateral projections 72, 73 are received by the upper recess 112 and the supporting slot 90 of the lower pallet 108*a* respectively. Lateral projection 74 of second portion 70 is received by the lower recess of the upper pallet 108*b*. As such, an upper face of the lateral projection 74 rests on a lower face of the lower recess of the upper pallet 108*b*.

The method of loading and unloading the upper pallet 108*b* from the stacked arrangement 71 is equivalent to that disclosed in combination with the previous embodiments. The primary difference being that when the support member 65 is laterally inserted the lateral projection 72 is received by the upper recess of the lower pallet 108*a* and the lateral projection 73 is received by the supporting slot of the lower pallet 108*a*.

FIG. 15*b* illustrates two quarter dollys 124*a*, 124*b* separated by a support member 65 in an arrangement 126. The arrangement 126 is very similar to that illustrated in 15*a* in connection with the quarter pallets 108*a*, 108*b*. As such, FIG. 15*b* will not be described in any further detail. As before, only one support member of the four (one for each corner of the pallets) is shown in the figure.

FIGS. 16*a* and 16*b* illustrate elevated stacked arrangements of quarter pallets 14*a*, 14*b* and quarter dollies 76*a*, 76*b* respectively. The quarter pallets 14*a*, 14*b* and quarter dollies 76*a*, 76*b* are separated by support members 166*a*, 166*b*.

FIGS. 16*a*, 16*b* illustrate two arrangements of securing the support members 166*a*, 166*b* in the elevated stacked arrangement. Only two support members of the four (one for each corner of the pallets) is shown in each figure.

In FIG. 16*a* a film 168 is wrapped around the support members 166*a*, 166*b*. The film 168 is wrapped around an exterior of the support members 166*a*, 166*b*. The film 168 exerts a compressive force which draws the support members 166*a*, 166*b* into contact with the load bearing features of the respective pallets 14*a*, 14*b*. The film 168 therefore secures the support members 166*a*, 166*b* in position in the elevated stacked arrangement.

In FIG. 16*b*, straps 170*a*, 170*b* are placed around end portions of the support members 166*a*, 166*b*. The straps 170*a*, 170*b* exert a compressive force which draws the support members 166*a*, 166*b* into contact with the load bearing features of the respective quarter dollies 76*a*, 76*b*.

The film 168 and straps 170*a*, 170*b* are just two ways in which the support members 166*a*, 166*b* may be secured in the elevated stacked arrangement. Other arrangements may include, for example, using wire or some other tensioning mechanism. Any arrangement which prevents the support members from moving laterally outwards and/or detaching from the upper or lower pallets may be used.

The support members 166*a*, 166*b* in FIGS. 16*a*, 16*b* differ from the support members 64, 65 described and illustrated previously in that they are not adjustable. The support members 166*a*, 166*b* are of a fixed length. Support members will be described and illustrated in more detail below.

FIGS. 57*a* to 57*c* show a preferred embodiment of a pallet 900. Specifically, FIGS. 57*a* to 57*c* are different perspective views of a front corner 902 of the pallet 900.

FIG. 57*a* is an elevated view, FIG. 57*b* is a view substantially aligned with a supporting slot 904, and FIG. 57*c* is a view from beneath the pallet 900.

The pallet 900 shares many features in common with the quarter pallet 108 shown in FIGS. 12 to 14.

Beginning with FIG. 57*a*, the pallet 900 comprises a deck 906 and front foot 908. The front corner 902 is so called because of its proximity to the front foot 908. A thickness of the deck 906 is indicated with reference numeral 910. Like the embodiment of FIGS. 12 to 14, the corner 902 incorporates a number of load bearing features. These load bearing features are configured to receive lateral projections of a support member. In this embodiment, load bearing features include the supporting slot 904, upper recess 912 and lower recess 914. Lower recess 914 is more clearly visible in FIGS. 57*b* and 57*c*.

Returning to FIG. 57*a*, the supporting slot 904 is substantially the same as that described and illustrated in connection with FIGS. 7 to 13. As such, the supporting slot 904 will not be described in detail here. However, for completeness, the supporting slot 904 is a slot which is recessed into a side wall of the pallet 900. Specifically, supporting slot 904 is recessed into two side walls 916, 918. Side wall or side walls 916, 918 may be referred to as a flank.

The upper recess 912, again like that of the previous embodiments, is in the form of a trench or channel which is recessed into a product supporting surface 920 of the deck 906. The trench is defined at least in part by a corner tip 922 which is present in the corner 902 of the product supporting surface 920. The corner tip 922 supports goods or products placed on the product supporting surface 920.

Turning to FIG. 57*b*, the pallet 900, specifically corner 902 thereof, is shown at a substantially zero angle of inclination, parallel to the supporting slot 904. This view more clearly shows the upper recess 912, or trench, through the product supporting surface 920. Also more clearly visible in FIG. 57*b* is the lower recess 914.

Like the pallet 360 shown in FIG. 36, the lower recess 914 of FIGS. 57*a* to 57*c* comprises projections 924*a*, 924*b*. The projections 924*a*, 924*b* are more clearly visible in FIG. 57*c*. Returning to FIG. 57*b*, the projections 924*a*, 924*b* project from the lower recess 914 in the direction of an underside 926 of the deck 906. That is to say, the projections 924*a*, 924*b* project away from the product supporting surface 920.

These projections 924*a*, 924*b* engage corresponding recesses or bores in a support member, or corner bracket, as shown more clearly in FIG. 36.

Also shown in FIG. 57*b* is a slot array 926 which aids the retention of shrink wrap when goods are loaded on the product supporting surface 920.

Turning to FIG. 57*c*, an underside of the front corner 902 is shown. The underside 926 of the deck is also more clearly visible in FIG. 57*c*. As mentioned above, the projections 924*a*, 924*b* of the lower recess 914 are also more clearly shown in FIG. 57*c*.

Turning to FIGS. 58*a*, 58*c*, various views of a rear corner 930 of the pallet 900 are shown. The rear corner 930 is so called because of its proximity to rear foot 932 (see FIG. 58*c*). FIG. 2 provides an overall view of a quarter pallet using the same naming convention for the feet.

FIG. 58*a* is an elevated perspective view of a rear corner 930 of the pallet 900, FIG. 58*b* is a perspective view of the rear corner 930 from below, and FIG. 58*c* shows a view of the corner 930 parallel to supporting slot 934. Many of the features of the rear corner 930 are similar to those of the front corner 902. As such, only the different features will be described in detail.

Beginning with FIG. 58*a*, the rear corner 930 also comprises upper recess 936. The upper recess 936 is again in the form of a trench which is defined at least in part by tip support 938. Also visible in FIG. 58*a* is orifice 940. The orifice 940 provides fluid communication between the supporting slot 934 (see FIGS. 58*b* and 58*c*) and cavity 942 defined by rear foot 932.

Turning to FIG. 58*b*, a lower recess 944 is illustrated, with projections 946*a*, 946*b* projecting therefrom.

FIG. 58*c* more clearly illustrates the supporting slot 934 and both upper and lower recesses 936, 944. FIG. 58*c* indicates how the supporting slot 934 opens out into the cavity 942 via orifice 940. Projections 946*a*, 946*b* are also shown more clearly. Finally, tip support 938 and a slot array 948 are also shown.

Although only one front corner 902 and one rear corner 930 are shown in FIGS. 57*a* to 58*c*, the pallet 900 is substantially symmetrical in that there are two like front corners and two like rear corners which define corners of the deck. However, in alternative arrangements, a pallet may have any combination of corner designs in accordance with either the front or rear corners described above. For example, a four-corner pallet may have corners which all correspond with the rear corner design described above. This may be particularly preferable where the pallet is a dolly, which may not have an asymmetrical arrangement of pallet supports. That is to say, there may not be a need to have different designs at the corners. A dolly, as described above, may not incorporate an equivalent feature to the orifice 940. The orifice may not be required because of the omission of rear feet (unlike that shown in FIG. 58*a*).

FIGS. 60 to 63 show assemblies of elevated stacked arrangements comprising pallets with the same corner arrangement as those shown in FIGS. 57*a* to 58*c*, and are described in detail later in this document.

FIG. 64 is a perspective view of an underside of a corner 1100 of a quarter dolly 1102 according to the first aspect of the invention. The quarter dolly 1102 is illustrated in FIG. 64 without a wheel in place, for clarity.

As discussed in connection with previous embodiments, the quarter dolly 1102, specifically the corner 1100 of a deck 1104 thereof, comprises a plurality of load bearing features. These are in the form of a lower recess 1106, supporting slot 1108 and upper recess 1110. These load bearing features are all configured to receive a lateral projection of a support member. A corner tip 1112 is also visible. The corner tip 1112 is defined, at least in part, by the upper recess 1110.

A principal difference between the corner 1100 of FIG. 64 and the corner 930 of FIG. 58*b* is the lower recess. In FIG. 58*b*, projections 946*a*, 946*b* project from the lower recess 944. The projections 946*a*, 946*b* are in a paired, and substantially symmetrical, arrangement about the corner 930. In contrast, one of the projections 1114*a* of FIG. 64 is disposed in a different position about corner 1100. That is to say, the projection 1114*b*, which is furthest from an apex of the corner 1100, is in the same position as the projection 946*a* of FIG. 58*b*.

The projections 1114*a*, 1114*b* project from the lower recess 1106 in a direction of an underside of the deck 1104. An apex projection 1114*a* is disposed nearest, or adjacent to, the apex of the corner 1100, i.e. at a corner-most edge of the lower recess 1106. There is no such apex projection 1114*a* in the previous embodiments.

The apex projection 1114*a* is utilised in this embodiment because there is insufficient space for a paired arrangement of projections like that shown in FIG. 58*b*. Specifically, an area 1116 is required in the deck 1104 for receipt of a bracket of a caster wheel (thereby forming a dolly). This use of the area 1116 means there is insufficient space for a boss to support a projection paired with the non-apex projection 1114*b*, like that shown in FIG. 58*b*. An example of such a boss is labelled 1118 in connection with the other projection 1114*b*.

The apex projection 1114*a* therefore provides an alternative projection layout which still enables the quarter dolly to be used in an elevated stacking arrangement. Specifically, the apex projection 1114*a* still provides for a "second" projection to engage a corresponding bore or recess of a corner body or support member.

The arrangement of projections 1114*a*, 1114*b* shown in FIG. 64 may be used in one or more corners of a pallet according to the invention. Preferably the arrangement of projections is used in two corners of a pallet according to the invention, and more preferably two corners of a quarter dolly.

Support Members

FIG. 17 is a perspective view of a support member 176 according to an embodiment of the invention. The support member 176 is similar, but not identical to, the support members 64, 65 of FIGS. 6*a*, 6*b*, FIGS. 11*a*, 11*b* and FIGS. 16*a* and 16*b*.

The support member 176 is formed from a first portion 178 and a second portion 180. The first portion 178 and the second portion 180 are moveable relative to another. As such, the relative movement between the first and second portions 178, 180 provides adjustability of the length of the support member 176. In the illustrated arrangement, relative movement between the first and second portions 178, 180 is constrained by a slot and pin arrangement.

The first portion 178 incorporates a slot 182. The slot 182 extends in a longitudinal direction for most of a length of the first portion 178. Slot 182 is sized to receive a pin 184. The pin 184 is therefore able to traverse the length of the slot 182. In the illustrated arrangement the pin 184 is secured to the second portion 180 via an aperture (not visible) and to the first portion 178 via the slot 182. The slot 182 therefore acts as a guide for the pin 184. The pin may comprise some form of nut and bolt arrangement which allows the pin to be secured and hence for the first portion to be secured to the second portion when the length of the support member is as desired.

The slot and pin arrangement is one way in which adjustability of the length of the support member 176 can be achieved. Another arrangement is also shown in FIG. 17. A first set of apertures 186 comprises three apertures 186*a-c* in the first portion 178. A second set of apertures 188 comprises three apertures 188*a-c* in the second portion 180. The two sets of apertures 186, 188 interact with one another to provide various discrete positions of adjustment of the first portion 178 relative to the second portion 180 (and hence various different discrete lengths of the support member. A locking pin (not depicted) placed through a pair of aligned respective apertures of each of the two sets of apertures 186, 188 provides a locking functionality to secure the respective portions 178, 180 in position relative to one another. This fixes the length of the support member 176.

The first and second portions 178, 180 each comprise a respective lateral projection 179, 181. The lateral projections 179, 181 are received by the load bearing features of the pallets/dollies already disclosed in this document in order to place said pallets/dollies in an elevated stacked arrangement.

The lateral projections 179, 181 are generally triangular in form. As such, each of the lateral projections 179, 181 has two straddling sides which are generally perpendicular to one another and a diagonal side spanning the spaced ends of the two generally perpendicular sides.

Lateral projections 179, 181 may be integrally formed with the first and second portions 178, 180 respectively. For example, the lateral projections 179, 181 may be manufactured at the same time as the rest of the first and second portions 178, 180. Alternatively, the lateral projections 179, 181 may be manufactured in a separate step. For example, the lateral projections 179, 181 may be attached to surfaces of the first and second portions 178, 180 in a separate manufacturing operation. Lateral projections 179, 181 may be between around 1 mm and around 3 mm thick. The lateral projections 179, 181 may be any suitable thickness to facilitate their receipt by respective load bearing features.

A rib 183 also forms part of the second portion 180. The rib 183 is not load bearing but is instead a locating feature to assist in the alignment of support member 176, specifically the lateral projection 181, in the corresponding load bearing feature of a pallet in an elevated stacked arrangement. The rib 183 may be received by a slot. The rib 183, or a portion thereof, may contact the underside of a pallet to align the support member 176.

The lateral projections 179, 181 and rib 183 may be secured to the first and second portions 178, 180 by adhesive, welding, an interference fit or some other securing means.

In FIG. 17, the first and second portions 178, 180 are angular portions. As such, the first and second portions 178, 180 define an internal corner which surrounds a corner of a pallet. For the first portion 178, internal faces 190, 192 define the internal corner. As such, in use, internal faces 190, 192 abut outer edges of a pallet corner. Each of the first and second portions 178, 180 can be manufactured from a sheet which is bent to some angle to define a corner. Preferably the angle is around 90°. Alternatively, each of the first and second portions 178, 180 can be formed of two sheets, or walls, which are connected about a join line to define a corner.

The lateral projection 179 depends from or is attached to the internal faces 190, 192. As such, the lateral projection 179 forms a shelf of sorts. The lateral projection 179 spans a cross sectional area between the internal faces 190, 192. The lateral projection 179 and the internal faces 190, 192 cooperate to define a vertex.

In FIG. 17 the lateral projections 179, 181 depend from the first and second potions 178, 180 respectively at two longitudinally separated positions. However, the lateral projections 179, 181 may be located at a range of other positions along the lengths of the first and second portions 178 and 180.

In a preferred arrangement, the lateral projection 181 of the second portion 180 is generally triangular. In a preferred arrangement, the lateral projection 179 of the first portion 178 is generally triangular, and a further lateral projection of the form of a strap, or bridge, is also present. The strap is preferably disposed vertically above the generally triangular projection of the first portion 178. Preferably the first portion 178 comprises the strap. The generally triangular projections may otherwise be described as wing-like, details of which are provided elsewhere in this document.

The vertical distance between the lateral projections 179, 181 is adjustable within a range of around 800 mm to 1200 mm.

The support member 176 is designed to support a quarter share of up to around 2500 Newtons. This corresponds with a supported mass of around 250 kg for the quarter pallet. As such, each support member 176 may be able to support at least around 625 Newtons of load. Alternatively, for a half pallet load of around 500 kg, each support member may be able to support a quarter share of up to around 5000 Newtons. This corresponds with a supported mass of around 500 kg for the half pallet. As such, each support member 176 may be able to support at least around 1250 Newtons.

The support member 176 may be manufactured from metal. For example, aluminium offers advantages due to its strength to weight ratio. Alternatively, the support member 176 may be manufactured from plastic. Plastic may offer advantageous cost savings and weight reduction.

The support member 176 may be reversible. That is to say, the support member 176 may be used in an elevated stacking arrangement when the first portion 178 is either the uppermost, or lowermost, portion. Reversibility of the support member 176 is advantageous for reasons of improved ergonomics. For example, a user does not need to check that the support member 176 is correctly oriented beyond the projections facing inwardly. This may improve the efficacy, and ease of use, of using the support member 176 in an elevated stacked arrangement.

As well as the adjustable support member 176 as illustrated in FIG. 17, fixed length support members are also contemplated. Fixed length support members may share many of the features of the adjustable support member 176 other than the adjustability.

Fixed length support members may be disposable. For example, a fixed length support member may be manufactured from cardboard or plastic. The cardboard may be reinforced cardboard, such as corrugated cardboard. Cardboard is lightweight, recyclable and low cost. Furthermore, the cardboard support member may be single use such that the cardboard support member need not be pooled (i.e. returned for re-use elsewhere).

Lateral projections of a fixed length support member may be manufactured from a material which is different to that of the rest of the support member. For example, a longitudinally extending portion of the support member may be manufactured from corrugated cardboard. This provides a low cost, disposable support member. The lateral projections may be manufactured from, for example, plastic. This may allow a greater load to be supported by the support member, whilst keeping the weight and cost of the overall support member to acceptable values. In addition, or alternatively, it may improve the wear-resistance properties of the lateral projections as compared to the longitudinally extending portion.

FIG. 18 is a further embodiment of an adjustable support member 200 according to an embodiment of the second aspect of the invention.

The adjustable support member 200 comprises a first portion 202 and a second portion 204. The first portion 202 and the second portion 204 are couplable at a plurality of different positions. That is to say, as before, the length of the adjustable support member 200 is adjustable.

In the illustrated embodiment, the position of the second portion 204 can be adjusted relative to the first portion 202. This means that an offset between constituent lateral projections of the first and second portions 202, 204 can be altered. This in turn means that the vertical position of an upper pallet of an elevated stacked arrangement relative to the lower pallet can be adjusted.

The first portion 202 comprises an elongate body portion 206. That is to say, the elongate body portion 206, and so first portion 202, is significantly longer in one direction than any other. The first portion 202 further comprises first and second lateral projections 208, 210.

The first and second lateral projections 208, 210 share many features in common with the first and second lateral projections 306, 308 described in connection with FIGS. 28*a*-39 below. As such, many details regarding the first and second lateral projections 208, 210 are not repeated here.

The first lateral projection 208 is generally triangular. The first lateral projection 208 comprises a recessed portion 212. The first lateral projection 208 is received by a supporting slot of an upper pallet when in an elevated stacked arrangement.

The second lateral projection 210 is of the form of a strap. In other words, the second lateral projection 210 is a diagonal portion. The second lateral projection 210 spans an included (or internal) angle of the first portion 202. The second lateral projection 210 is received by an upper recess, specifically a trench thereof, of a lower pallet when in an elevated stacked arrangement.

The position of each of the first and second lateral projections 208, 210 is fixed with respect to the elongate body portion 206. In other words, the elongate body portion 206, and first and second lateral projections 208, 210 constitute a fixed body.

The first and second portions 202, 204 are angular portions. That is to say, the first and second portions 202, 204 each define an internal corner (or have a generally L-shaped cross-section). The first and second portions 202, 204 also thereby define an included area. The included area is intended to mean the area of the triangle defined by the two sides of the portions, if outer ends of the sides are joined with an imaginary straight line.

The support member 200 is adjustable by virtue of being able to detach and reattach the second portion 204 from the first portion 202.

For reference, the second portion 204 is shown in isolation in FIG. 19.

In the illustrated embodiment, the adjustability is provided by a plurality of apertures 214 in the first portion 202. Specifically, the elongate body portion 206 thereof. Only two apertures 214 are labelled in FIG. 18. The apertures 214 are configured to receive projections (not visible in FIG. 18) of the second portion 204. As such, by altering which apertures 214 the projections engage with (or are received by), the offset or spacing between a first lateral projection 216 of the second portion 204 and the lateral projections 208, 210 of the first portion 202 can be changed. This means that the vertical position of an upper pallet in an elevated stacked arrangement relative to a lower pallet can be altered accordingly.

In other embodiments the respective portions 202, 204 of which the projections and apertures form part may be reversed. That is to say, the first portion 202 may comprise a plurality of projections, instead of or in combination with the apertures 214. Similarly, the second portion 204 may comprise a plurality of apertures, instead of or in combination with the projections.

Dimensions $D_1$-$D_8$ are indicated on FIG. 18.

$D_1$ is preferably around 500 mm. $D_2$ is preferably around 600 mm. $D_3$ is preferably around 700 mm. $D_4$ is preferably around 800 mm. $D_5$ is preferably around 900 mm. $D_6$ is preferably around 1000 mm. $D_7$ is preferably around 100 mm. $D_8$ is preferably around 40 mm.

As such, in the illustrated embodiment the apertures 214, or groups of apertures, are spaced apart by around 100 mm. This provides an incremental adjustment of around 100 mm per group of apertures. $D_1$ represents a minimum distance between the second lateral projection 210 of the first portion 206 and the first lateral projection 216 of the second portion 204. $D_6$ represents a maximum distance between the second lateral projection 210 of the first portion 206 and the first lateral projection 216 of the second portion 204. As such, and in the illustrated embodiment, the offset is adjustable between around 500 mm and around 1000 mm in 100 mm increments. However, other arrangements may have differing dimensions.

Groups of apertures is intended to refer to the arrangements of four apertures in close proximity to one another, with two on one face 218 of the first portion 202 and two on the other face 220 of the first portion 202.

In FIG. 18, the first lateral projection 216 of the second portion 204 is substantially identical to the first lateral projection 208 of the first portion 202. However, due to the orientation of the adjustable support member 200, the first lateral projection 216 of the second portion 204 is configured to be received by a lower recess of an upper pallet of an elevated stacked arrangement.

The first lateral projections 208, 216 may be said to be wing-like in geometry. The second lateral projection 210 may be of the form of a strap or bridge in geometry.

When in position, straps or hooks may be used to secure the adjustable support member 200. The straps or hooks may be disposed along a length of the adjustable support member 200. Specifically, the straps or hooks may be disposed along a length of the elongate body portion 206. The straps or hooks may attach some or all of the adjustable support members 200 together. In a cooperative arrangement, multiple adjustable support members 200 may be secured to one another, using straps or hooks, such that the adjustable support members 200 urge one another into a correct position relative to the pallet.

When the second portion 204 is positioned in an uppermost location (i.e. whereby $D_6$ represents the offset between the lateral projections 210, 216, a lip 222 exists above the second portion 204. The lip 222 is a portion of the elongate body portion 206. The lip 222 may cooperate with a corner of the upper pallet to assist in the location of the corner relative to the adjustable support member 200.

FIG. 18 is only a schematic illustration of the adjustable support member 200. Further information regarding the coupling of the first and second portions 202, 204 is provided below.

FIG. 19 is a perspective view of the second portion 204 in isolation.

The second portion 204 comprises the first lateral projection 216, as discussed above. Also visible in FIG. 19 are projections 224*a*, 224*b*, 224*c*, 224*d*. The projections 224 are indicated with dashed lines, due to the fact that these features are hidden from view in the FIG. 19 orientation.

The projections 224 are received by the apertures 214 of the first portion 202. The projections 224 are indicated schematically in FIG. 19. The projections 224 are hooked. That is to say, the second portion 204 is adjusted by slightly lifting the second portion 204 relative to the first portion 20, to disengage the hooks from the apertures 214. The second portion 204 can then be detached from the first portion 202. The vertical position of the second portion 204 can then be adjusted with respect to the first portion 202. In other words, this is how the length of the adjustable support member 200 is adjusted.

The projections 224 project away from the second portion 204. That is to say, the projections 224 extend in a direction away from an external face of the second portion 204 (i.e. a face which does not at least partly define an internal corner).

Another alternative geometry for the projections 224 is shown in FIG. 20. In FIG. 20 the body 226 comprises a plurality of locating features. A first feature 228 limits the horizontal position of the body 226 with respect to a slot 229. The second feature 230 limits the vertical position of the body 226 with respect to a further slot 232. To insert the first feature 228 through the first slot 228, the body 226 is rotated by around 90° and the first feature 228 can then be received by the first slot 228. With the first feature 228 in position, the body 226 is then returned to its original orientation (i.e. the rotation is reversed by 90°). The second feature 230 is then aligned with the further slot 232, and inserted therein.

The features 228, 230 provide alternative geometries for the projections 224. However, it is noted that some modifications would be required in order for the FIG. 20 arrangement to be compatible with the geometry of the second portion 204 in FIG. 19.

As well as the projections 224 and apertures 214 of the illustrated arrangement, a number of other ways of adjustably coupling the first and second portions 202, 204 may otherwise be used. For example, a guiding slot and pin arrangement could be used, whereby the second portion 204 can traverse some of all of the length of the first portion 202. It is expected that any way of adjustably coupling the first and second portions 202, 204 would need to allow the second portion 204 to be quickly and easily decoupled from the first portion 202. In the case of using angled (e.g. L-shaped cross-section) portions, like in the illustrated arrangement, the coupling mechanism would need to be compatible with the external geometry in order for this to occur.

The mechanism or means of coupling the first and second portions 202, 204 should allow for the portions to be disengaged in situ. That is to say, the mechanism or means should be compatible with the corner-like geometry of the portions, to allow the separation and recombination thereof. The mechanism or means should also not interfere with the supporting nature of the portions.

FIG. 21 shows an elevated stacked arrangement 250 according to an aspect of the invention.

In FIG. 21, a lower pallet 252 and an upper pallet 254 are vertically offset from one another by two adjustable support members 256, 258. In FIG. 21 one pair of wheels is omitted from each of the wheeled pallets, or dollies.

The adjustable support members 256, 258 are substantially the same as that of FIG. 18. However, in FIG. 21 the first portions and, separately, second portions, are connected along long sides of the pallets, by support bodies. In other words, instead of the first portions of the adjustable support members disposed along the same long side of the pallet being separate from one another, they form part of a single horizontal support bar. Similarly, second portions of the adjustable support members disposed along the same long side of the pallet form part of a single horizontal support bar.

Support bodies are indicated with the numerals 260, 262, and are shown in isolation in FIGS. 22 and 23. The position of the support bodies 260, 262 on the page is indicative of their relative position in the stacked arrangement 250 i.e. the uppermost support bar 262 is that which is attached to the upper pallet 254.

The support body 262, otherwise referred to as a second support body, is attached to the upper pallet 254. The support body 260, otherwise referred to as a first support body, is attached to the lower pallet 252.

The support bodies 260, 262 attach to the load bearing features of the pallet in the same way as the adjustable support members previously discussed. Namely, for the upper pallet 254, first lateral projections 264, 266 are received by a lower recess of the pallet. For the lower pallet 252, first lateral projections (not visible in FIG. 21 or 23) are received by supporting slots of the pallet, and second lateral projections 268, 270 are received by upper recesses of the pallet. In other embodiments, a variety of combinations of lateral projections are otherwise possible. For example, the lower pallet 252 may receive only the second lateral projections 268, 270, and the first lateral projections may be omitted. Each of the support bodies 260, 262 comprises at least one lateral projection of some type.

Support bodies 260, 262 also comprise laterally projecting tabs 272, 274, 276, which are not present in the previously discussed adjustable support members.

The second support body 262 comprises a first laterally projecting tab 272. This is the only tab present on the second support body 262. The purpose of the first laterally projecting tab 272 is to abut an underside of a deck of the upper pallet 254. As such, the first laterally projecting tab 272 assists in supporting the upper pallet 254.

In the illustrated embodiment, the first laterally projecting tab 272 is disposed between first and second ends of the support body 262. The laterally projecting tab 272 extends in the same direction as the lateral projections 264, 266. Namely, the laterally projecting tab 272 extends towards a centre of the pallet when in position.

The laterally projecting tab 272 provides support along the long side of the upper pallet 254. That is to say, the laterally projecting tab 272 reduces the extent to which the upper pallet 254 deflects (or bows) in the middle region when the upper pallet 254 is loaded with goods or products. By contacting the underside of the deck of the upper pallet 254, the laterally projecting tab 272 does not impact the use of any features on the product supporting surface which may need to be accessed.

The first support body 260 comprises a plurality of laterally projecting tabs. These laterally projecting tabs may be said to be off-centre, owing to their position on the first support body 260. Specifically, the first support body 260 comprises first and second laterally projecting tabs 274, 276. The first and second laterally projecting tabs 274, 276 abut the product supporting surface of the lower pallet 252. As such, the first and second laterally projecting tabs 274, 276 also support the upper pallet 254. A gap is left between the first and second laterally projecting tabs 274, 276 to provide access to connecting features in the product supporting surface. As such, these features can still be accessed and so used, even when the first support body 260 is located in position.

The first and second support bodies 260, 262 are preferably around 600 mm long, such that they conform to, or fit to, a long side of a Quarter Pallet.

Straps, hooks, film or other securing means, or a combination thereof, can be added to the support members 256, 258 to hold them in place. Specifically, the securing means can be added between opposing support members 256, 258. Preferably the connection is across the short side of the pallet. For a Quarter Pallet, this is the 400 mm side, and for a Half Pallet this is the 800 mm side.

Overall, the first and second support bodies 260, 262 provide additional side support in the elevated stacked arrangement 250.

Preferably $D_{10}$ is around 600 mm. Preferably $D_{11}$ is around 30 mm. Preferably $D_{12}$ is around 25 mm. Preferably $D_{13}$ is around 80 mm. Preferably $D_{14}$ is around 600 mm. Preferably $D_{15}$ is around 30 mm. Preferably $D_{16}$ is around 80 mm.

The first and second support bodies 260, 262 are advantageously symmetrical about planes of symmetry indicated by lines $L_1$ and $L_2$.

FIG. 24 is a perspective view of part of the second support body 262 being inserted into an upper pallet 254. As mentioned above, the laterally projecting tab 272 supports an underside of the deck 277 of the upper pallet 254.

FIG. 25 is a perspective view of part of the first support body 260 being inserted into a lower pallet 252. Also as mentioned above, the first and second laterally projecting tabs 274, 276 abut the product supporting surface 279 of the lower pallet 252.

The arrow indicates the direction of insertion of the supporting bodies 260, 262 in FIGS. 24 and 25.

FIG. 26 is the same as FIG. 21, save for an arrow indicating the vertical adjustment which is offered by the arrangement.

FIG. 27 shows a side view of a possible mechanism for being able to adjust the vertical offset between the upper and lower pallets. Specifically, the support body 262, of the first portion thereof, can be coupled to the second portion of the adjustable support member at a plurality of vertical positions. This gives rise to the adjustability of the height of the system. More details, and exemplary dimensions, are discussed above in connection with FIG. 18.

FIG. 52*a* is a perspective view of an implementation of the schematic illustration of FIGS. 21 to 27, in accordance with a third aspect of the invention.

The elevated stacked arrangement 800 comprises a lower pallet 802 and an upper pallet 804. The upper pallet 804 is elevated above the lower pallet 802 by way of a framework of support bodies, support members and side supports.

Attached to the lower pallet 802 are first support bodies 806*a*, 806*b*. These first support bodies 806*a*, 806*b* share some of the features of the first support body 260 of FIGS. 21, 23 and 24.

The following description is provided with respect to a first of the first support bodies 806*a* only. However, the features are also applicable to a second of the first support bodies 806*b*, located opposite the first of the first support bodies 806*a*. In preferred arrangements, both first support bodies 806*a*, 806*b* are substantially identical.

The first support body 806*a* comprises a plurality of lateral projections (not visible in FIG. 52*a*). These lateral projections are received by load bearing features of the lower pallet 802. The first support body 806*a* further comprises a laterally projecting tab (also not visible in FIG. 52*a*). FIG. 54 shows a support body in isolation.

Returning to FIG. 52*a*, the first support body 806*a* is generally C-shaped. That is to say, the first support body 806*a* has a long side 808, and two short sides 810, 812. The short sides 810, 812 are largely obscured in FIG. 52*a* but are again visible in FIG. 54. The geometry of the first support body 806*a* allows it to conform to a long side of the pallet 802. That is to say, the first support body 806*a* fits around the long side of the pallet 802. The first support body 806*a* also fits around at least a portion of short sides of the pallet 802.

The first support body 806*a* also comprises a plurality of hooks 814*a*, 814*b* (only some of which are numbered), which interact with apertures, or grabs, in other components to secure the first support body 806*a*. The hooks 814 are projecting features which extend from the first support body 806*a*. The hooks 814 grip or secure other components relative to the first support body 806*a*. The hooks 814 are shown more clearly in FIG. 53 (albeit forming part of a support body attached to the upper pallet 804).

Returning to FIG. 52*a*, the first support bodies 806*a*, 806*b* are coupled to one another by way of two side supports 816*a*, 816*b*. These side supports 816*a*, 816*b* are of the form of bars with apertures therein. The apertures receive the hooks 814 of the first support bodies 806*a*, 806*b*. As such, the combination of the first support bodies 806*a*, 806*b* and the side supports 816*a*, 816*b* surround a perimeter of the pallet 802.

In other words, the first support bodies 806*a*, 806*b* and the side supports 816*a*, 816*b* enclose the sides of the pallet 802, specifically the deck thereof.

The side supports 816*a*, 816*b* provide extra support for the elevated stacked arrangement 800, as discussed in more detail below.

The arrangement of surrounding framework of the upper pallet 804 is substantially identical to that of the lower pallet 802 in use. That is to say, second support bodies 818*a*, 818*b* and side supports 820*a*, 820*b* enclose sides of the upper pallet 804, like that described above.

Also illustrated are four uprights 822*a*, 822*b*, 822*c*, 822*d*. The four uprights 822 may be referred to as upright portions. It is the uprights 822 which separate the upper pallet 804 from the lower pallet 802. Specifically, the interaction between the uprights 822 and the first and second support bodies 806*a*, 806*b*, 818*a*, 818*b* separates the pallets 802, 804.

The uprights 822 are elongate. The uprights 822 each comprise a plurality of apertures therein 823*a*, 823*b* (only some of which are numbered). The apertures 824 provide adjustability of the relative elevation of the upper pallet 804 above the lower pallet 802. The apertures 824 are configured to receive hooks 814*a* of the first and second support bodies 806*a*, 806*b*, 818*a*, 818*b*.

The uprights 822 further comprise base portions 824*a*, 824*b*, 824*c*, 824*d*. The base portions 824 are wider portions than the rest of the elongate uprights 822. The base portions 824 more securely attach the uprights 822 to the first support bodies 806*a*, 806*b*. Also of note, the base portions 824 provide further apertures (826*a*, 826*b*, indicated on the first upright 822*a* only). These further apertures 826*a*, 826*b* are of importance because they receive hooks 814*b* which point upwards, or substantially upwards. In other words, the combination of the further apertures 826*a*, 826*b* and upwardly-facing hooks 814*b* can support a downward force, such as the load of the upper pallet 804.

For the purposes of this document, and for consistency of language with the description accompanying FIGS. 17 to 20, the lateral projections of the first support bodies 806*a*, 806*b* are considered to form part of first portions. The first portions further comprise a respective upright 822. Those first portions are disposed at ends, or end regions, of the first support bodies 806*a*, 806*b*. Similarly, lateral projections of the second support bodies 818*a*, 818*b* are considered to form part of second portions. Those second portions are disposed at ends, or end regions, of the second support bodies 818*a*, 818*b*. The first portions and second portions are couplable at a plurality of different positions. This functionality is provided by cooperating coupling portions of the first and second portions. The coupling portions of the first portions comprise apertures in the uprights 822. The coupling portions of the second portions comprise hooks of the second support bodies 818*a*, 818*b*. Furthermore, by virtue of the fact that second portions are adjustable relative to first portions, the FIG. 52*a* arrangement comprises four adjustable support members.

FIG. 52*b* is a perspective view, angled from below, of the arrangement 800 of FIG. 52*a*. FIG. 52*b* shows a laterally projecting tab 828*a* of the second support body 818*a*. The laterally projecting tab 828*a* is configured to abut an underside of a deck of the upper pallet 804. This provides extra support along the long side of the upper pallet 804. This is desirable for reasons of reduced deflection, and so increased strength, in use. The other of the second support bodies 818*a*, 818*b* incorporates a like laterally projecting tab, but said tab is hidden from view in FIG. 52*b*.

FIG. 53 is a close-up perspective view of an upper corner of the elevated stacked arrangement 800. The upper pallet 804 is shown, along with first support body 818*a*, and side support 820*b*. Upright 822*b* is also shown. Hooks 830*a*, 830*b* of the first support body 818*a* can be seen engaged with apertures 832*a*, 832*b* of the side support 820*b*. This provides a convenient securing means of connecting the first support bodies 818*a*, 818*b* along a short side of the pallet 804. Outer corner hooks 834*a*, 834*b* of the first support body 818*a* are shown not being used. This is due to the pallet 804 being an upper pallet 804, whereas the outer corner hooks 834*a*, 834*b* are only used to engage apertures in a base portion of an upright when the pallet is a lower pallet. Due to the downwardly directed load of the upper pallet 804, and the upwardly facing outer corner hooks 834*a*, 834*b*, it will be understood that the outer corner hooks 834*a*, 834*b* would provide little, if any, support. Hence, they are not used.

Inner corner hooks 836*a*, 836*b*, which are downwardly facing, are shown. The inner corner hooks 836*a*, 836*b* engage apertures 823*a*, 823*b* in the upright 822*b*. The various apertures of the uprights 822 provides a range of vertical positions at which the second support bodies 818*a*, 818*b*, and so upper pallet 804, can be elevated above the lower pallet 802.

Inner corner hooks 836*a*, 836*b* are disposed in close proximity to corners of the deck. Outer corner hooks 834*a*, 834*b* are disposed adjacent the inner corner hooks 836*a*, 836*b*. Outer corner hooks 834*a*, 834*b* are more distally disposed from the corners of the deck, in comparison to the inner corner hooks 836*a*, 836*b*.

FIG. 54 is a perspective view of a support body 840. The support body 840 may constitute either of a first or second support body. The first and second support bodies may be substantially identical. Alternatively, the first and second support bodies may have different geometries.

As described above, the support body 840 comprises a long side 842. This long side 842 is sized to conform to a long side of a quarter pallet, or a short side of a half pallet, i.e. around 600 mm in length. The support body 840 further comprises short sides 844, 846. The short sides 844, 846 'wrap around', or conform, to the two proximal pallet sides so as to enclose at least a portion thereof. The combination of the long side 842 and short sides 844, 846 defines the 'C', or 'U' shape of the support body 840.

A laterally projecting tab 848 is shown projecting from the long side 842. The laterally projecting tab 848 in this arrangement is configured to abut a product supporting surface of a lower pallet, to reinforce the elevated stacked arrangement. The laterally projecting tab 848 may be sized to avoid any interference with, or obstruction of, connecting features in the product supporting surface. For example, the laterally projecting tab 848 may be smaller, larger, offset, or split into multiple constituent tabs.

Various hooks, both upwardly and downwardly facing, of the support body 848 are also shown more clearly in FIG. 54.

Lateral projections 850, 852 are also visible. These lateral projections 850, 852 are configured to be received by load bearing features of a pallet. Such receipt, or engagement, connects or attaches the support body 840 to the pallet. The lateral projections 850, 852 are of the form of straps, and so may be configured to be received by an upper recess of a pallet according to a third embodiment of the first aspect of the invention. A further lateral projection is disposed beneath each of the lateral projections 850, 852, so as to engage a different load bearing feature of a pallet, preferably a lower recess, but are not visible in FIG. 54. The lateral projections shown in FIG. 54 are just some examples of possible lateral projections. Alternative lateral projections, or combinations thereof, may otherwise be used. For example, one or more of a strap and a generally triangular lateral projection may be incorporated. These may be received in one or more of an upper recess, lower recess or supporting slot of a pallet.

A further elevated stacked arrangement 854 is illustrated in FIG. 55. A first support body 840 of the variety illustrated in FIG. 54 is attached to the lower pallet 856. As such, the laterally projecting tab 848 abuts the product supporting surface 857 of the lower pallet 856. A further embodiment of the uprights 858*a*, 858*b*, 858*c*, 858*d* is also shown. These uprights 858 incorporate apertures arranged in groups of threes, so as to provide a range of adjustability around specific vertical positions.

FIG. 56 is an exploded perspective view of the FIG. 55 arrangement, showing the various interactions between the various constituent components of the elevated stacked arrangement 854.

First support bodies 840*a*, 840*b* are attached to lower pallet 856. First support bodies 840*a*, 840*b* are connected to one another by side supports 860*a*, 860*b*. Second support bodies 864*a*, 864*b* are attached to upper pallet 862. Second support bodies 864*a*, 864*b* are connected to one another by side supports 866*a*, 866*b*. Hooks of the first and second support bodies 840*a*, 840*b*, 864*a*, 864*b* engage apertures of the uprights 858*a*, 858*b*, 858*c*, 858*d*. The upper pallet 862 is thereby elevated relative to the lower pallet 856. Laterally projecting tabs 841*a*, 841*b* of the first support bodies 840*a*, 840*b* abut the product supporting surface 857 of the lower pallet 856. Laterally projecting tabs 865*a*, 865*b* of the second support bodies 864*a*, 864*b* abut an underside of the deck of the upper pallet 862.

It is expected that in preferred arrangements the framework may be constructed in two main parts. A first part comprises a first of the first and second support bodies 840*a*, 864*a*, and two uprights 858*a*, 858*b*. These may be connected to one another to form a substantially rectangular frame. Said substantially rectangular frame can then be connected to the lower and upper pallets 856, 862 respectively. Lateral projections of the first of the first and second support bodies 840*a*, 864*a* are thereby received by load bearing features of the lower and upper pallets 856, 862 respectively. A corresponding, but opposing, substantially rectangular frame is then constructed on the opposing side, and is then connected to the lower and upper pallets 856, 862 in the same way described above. Said substantially rectangular frames, or parts, or portions, are then secured to one another using side supports 860*a*, 860*b*, 866*a*, 866*b*. The side supports 860*a*, 860*b*, 866*a*, 866*b* prevent the frame portions from splaying outwards away from one another. It is expected that the lower and upper pallets 856, 862 will be loaded with goods or products before the framework is constructed, however this is not essential. The aforementioned substantially rectangular frame, or parts, or portions, may otherwise be referred to as an assembly, or a combination.

In an alternative arrangement, the order of assembly of the arrangement 854 is as follows. First support bodies 840*a*, 840*b* are attached to respective sides of the lower pallet 856. The lower pallet 856 may be loaded with goods or products before or after this step. Lateral projections of the first support bodies 840*a*, 840*b* are thereby received in load bearing features of the lower pallet 856. Side supports 860*a*, 860*b* are then attached to the first support bodies 840*a*, 840*b*. This is by way of aligning apertures of the side supports 860*a*, 860*b* with corresponding hooks of the first support bodies 840*a*, 840*b*. The side supports 860*a*, 860*b* are then urged into position such that the hooks engage with the apertures of the side supports 840*a*, 840*b*. The lower pallet 856 is thereby surrounded by the first support bodies 840*a*, 840*b* and the side supports 860*a*, 860*b*. If not loaded with goods or products already, the lower pallet 856 may be loaded at this point. The above process is then repeated with respect to the upper pallet 862 (which is, at this point, not elevated above the lower pallet 856). That is to say, second support bodies 864*a*, 864*b* are connected to the upper pallet 862. Lateral projections of the second support bodies 864, 864*b* are thereby received in corresponding load bearing features of the upper pallet 862. Side supports 866*a*, 866*b* then connect the second support bodies 864*a*, 864*b* together. At this point, both lower and upper pallets 856, 862 are enclosed by respective support bodies and side supports. If not loaded with goods or products already, it is expected that at least the lower pallet 856 will be loaded at this point.

At this point, there are two options for proceeding. The options depend upon whether the upper pallet 862 is elevated before or after the uprights 858 are connected to the first support bodies 840*a*, 840*b*.

In a first variant, uprights 858 are connected to the first support bodies 840*a*, 840*b* by aligning apertures of the uprights 858 with corresponding hooks of the first support bodies 840*a*, 840*b*. The upper pallet 862, now loaded with goods or products, is then manoeuvred into position and elevated above the lower pallet 856. Uprights 858 are then splayed outwards slightly, and the elevated upper pallet 862 is lowered into position. At the desired vertical position, the uprights 858 are urged towards the upper pallet 862. Apertures of the uprights 858 are then engaged by corresponding hooks of the second support bodies 864*a*, 864*b*. The arrangement 854 is thereby secured in place.

In a second variant, the upper pallet 862 is manoeuvred into position and elevated above the lower pallet 856 before the uprights 858 are connected. With the upper pallet 862 in position, the uprights 858 are first connected to the first support bodies 840*a*, 840*b*. The uprights 858 are then connected to the second support bodies 864*a*, 864*b*.

Side supports 860*a*, 860*b*, 866*a*, 866*b* are an optional feature, but improve the stability of the arrangement 854. Side supports 860*a*, 860*b*, 866*a*, 866*b* can be attached to, or removed from, respective support bodies 840*a*, 840*b*, 864*a*, 864*b* at any stage in the assembly process. Alternatively, the side supports 860*a*, 860*b*, 866*a*, 866*b* may be omitted entirely. Side supports 860*a*, 860*b*, 866*a*, 866*b* may otherwise be referred to as crossbeams, or tie-bars.

The support bodies may incorporate one or more laterally projecting tabs. These tabs may be configured to abut a product supporting surface of a pallet. These tabs may be configured to abut an underside of a deck of a pallet. Alternatively, the tabs may be arranged in a repeating pattern such that individual tabs of a like support body abut both the product supporting surface and the underside of the deck.

In preferred arrangements, the first support bodies comprise a laterally projecting tab which is configured to abut a product supporting surface of the lower pallet. In this arrangement, the load exerted through the uprights by the upper pallet is at least partly transmitted through the product supporting surface of the lower pallet. Also in preferred arrangements, the second support bodies comprise a laterally projecting tab which is configured to abut an underside of a deck of the upper pallet. In this arrangement, the load exerted by the upper pallet is at least partly transmitted through the second support body, specifically the tab thereof. However, variants of the above are possible and, for reasons of simpler construction and a reduced number of parts, using substantially identical support bodies for both lower and upper pallets may be preferred.

In the aforementioned arrangements, it is expected that the support bodies, side supports and uprights be manufactured from metal. For example, steel or aluminium, or a combination, between the various parts may be used. A coating may be applied, or another treatment, to improve the longevity of the metal parts.

The framework provides a reusable and adjustable solution, which is simple to assemble and disassemble, which is of a low volume for transportation when disassembled.

The framework may be used with a variety of pallet sizes but, in particular, the same framework can be used with both Quarter Pallets and Half Pallets, with only the side supports needing to be lengthened or shortened accordingly.

Corner Body

FIG. 28*a*-28*d* are views of a laterally insertable corner body 300, which is herein referred to as corner body 300, according to an aspect of the invention.

The corner body 300 comprises first and second edge sections 302, 304. The corner body 300 further comprises a first lateral projection 306 and a second lateral projection 308. The first and second lateral projections 306, 308 are configured to be received by load bearing features of a pallet.

The corner body 300 is generally triangular. The corner body 300 is configured to receive an elongate member and thereby form part of a support member. This is described in greater detail below.

The corner body 300 is symmetrical about a plane of symmetry between the first and second edge sections 302, 304. As such, the same corner body 300 can be used with either of a lower or an upper pallet in an elevated stacked arrangement.

The first and second edge sections 302, 304 co-operate to define a slot 310. The slot 310 is one example of a receiving portion. The slot 310 is configured to receive an end of an elongate member. End is intended to mean end region, rather than only a very outermost end of the elongate member. As will be discussed in more detail below, the elongate member is gripped within the slot 310 and this requires at least some length of the elongate member to be received therein.

The slot 310 comprises a plurality of ribs 312 (only two of which, and along only one side of the slot 310, are numbered in FIG. 28*a*). The ribs 312 run longitudinally within the receiving slot 310 (see FIG. 28*d* for an alternative view). The ribs 312 are disposed on long sides of the slot 310. The ribs 312 are configured to grip the elongate member, or the end or end portion thereof, when received therein. Specifically, the ribs 312 are configured to grip a portion of the elongate member which is received in the slot 310. As such, the ribs 312 secure the corner body 300 to the elongate member. In place of the ribs 312, some other securing means may instead be incorporated. For example, teeth or a ratchet-like feature could be used to grip the elongate member, or the portion thereof, received in the slot 310. The ribs 312 engage the elongate member so as to secure the elongate member in the slot 310. The ribs 312 may otherwise be considered to be ridges, or protrusions, which encroach into the slot 310.

The slot 310 only spans a portion of the overall extent of the corner body 300. That is to say, if the ribs 312 extend in a longitudinal direction, the slot 310 only spans a portion of the longitudinal extent of the corner body 300. As such, the first and second edge sections 302, 304 have a constant, or substantially constant, thickness in a first region 314 and a variable thickness in a second region 316. The constant thickness first region 314 is at least in part due to the incorporation of the slot 310. Likewise, the variable thickness in the second region 316 is able to be varied because the slot 310 does not span the second region 316. The corner body 300 tapers to a narrow tip 317 at an end of the second region 316. The variable thickness of the second region 316 may otherwise be described as a taper. Similarly, the second region 316 may be described as a tapering portion. The narrow tip 317, or taper of the second region 316, is useful when the corner body 300 is utilised in an orientation which is reversed in a line of symmetry substantially between FIGS. 28*a* and 28*b* in the plane of the paper. In other words, if the relative positions of the first and second lateral projections 306, 308 are reversed. In such an orientation, the second region 316 defines a funnel of sorts, which guides the corner body 300 into a correctly aligned position. This will be described in more detail below.

The geometry of the second region 316 may be described as self-aligning. In a specific example (see FIGS. 28*c* and 36), the second region 316 guides, or aligns, recesses 324*a*, 324*b* in the first lateral projection 306 for engagement by corresponding projections 380*a*, 380*b* in the lower recess of the pallet. The second region 316, or specifically the tapering or funnelling thereof, therefore aligns recesses 324*a*, 324*b* and projections 380*a*, 380*b* such that the projections 380*a*, 380*b* engage the recesses 324*a*, 324*b*. This alignment improves the ease with which the corner body 300 can be aligned with, and received by, an upper pallet of an elevated stacked arrangement. The engagement of the projections 380*a*, 380*b* into recesses 324*a*, 324*b* locates, and securely retains, the upper pallet, and corresponding load, in position in an elevated stacked arrangement. The engagement therefore assists in positioning the upper pallet in a position such that the corresponding load can be suitably, and effectively, supported. The angled portion of the second region 316 may otherwise be described as an inclined plane.

A plurality of reinforcing ribs 318 are incorporated in the second region 316, as shown in FIG. 28*b*. The reinforcing ribs 318 are included as a material saving measure. Were it not for the incorporation of the reinforcing ribs 318, more material would be used than would otherwise be required in the second region 316. This is due to the slot 310 not spanning the second region 316. The reinforcing ribs 318 also provide strengthening of the corner body 300.

The first and second edge sections 302, 304 are generally disposed normal to one another. That is to say, the first and second edge sections 302, 304 are generally disposed perpendicularly to one another. This gives rise to the corner shape of the corner body 300. This also allows the corner body 300 to conform more closely to a corner of the pallet, as will be discussed in greater detail below.

The first lateral projection 306 is generally triangular. As such, the first lateral projection 306 spans most of an included angle between the first and second edge sections 302, 304. The included angle is defined as the angle between internal faces 302*a*, 304*a* of the corner body 300. The first lateral projection 306 can be said to be wing-like in geometry, similar to that disclosed in connection with the lower recess of the third embodiment of the first aspect of the invention.

Although the first lateral projection 306 is generally triangular, a recessed portion 314 gives rise to the wing-like geometry. That is to say, portions 306*a*, 306*b* protrude from the generally triangular rest of the geometry 306*c* to define a shape which is wing-like. This geometry is selected so as to provide the greatest surface area which can abut the corresponding load bearing feature in the pallet, to thereby increase the strength of the elevated stacked arrangement. The recessed portion 314 is incorporated to avoid unwanted contact between the first lateral projection 306 and a foot of the pallet. That is to say, a chamfered edge of a rear foot of the pallet may be received in the recessed portion 314 (as shown most clearly in FIG. 36).

The second lateral projection 308 is strap-like in geometry. That is to say, the second lateral projection 308 diagonally spans the first and second edge sections 302, 304. The second lateral projection 308 may otherwise be described as being of the form of a band, or bridge. The second lateral projection 308 defines an outermost triangular geometry in the form of a cavity 309 (indicated with a dashed line in FIG. 28*b*) between an outermost edge of the second lateral projection 308 and an internal corner of the corner body 300. The cavity 309 is configured to receive a tip support of the pallet.

The second lateral projection 308 is configured to be received by a load bearing feature. In particular, the second lateral projection 308 is configured to be received by an upper recess in the form of a trench. Like the first lateral projection 306, the second lateral projection 308 incorporates a slightly recessed portion such that portions 308*a*, 308*b* of the strap protrude. Like for the first lateral projection 306, this increases the surface area with which the trench can be abutted.

In the illustrated embodiment, the protruding portions 308*a*, 308*b* are chamfered, or tapered. That is to say, the thickness of the protruding portions 308*a*, 308*b* reduces moving away from the internal corner of the corner body 300. The chamfer allows the corner body 300 to be laterally inserted with goods or products in situ on the pallet. In other words, the chamfer, or chamfers, provides a tip which can wedge between the product supporting surface and an underside of the goods or products, to allow easy insertion of the corner body 300. That is to say, the chamfer, or thickness thereof, can displace goods or products, such as a POS display, when the corner body 300 is inserted. The chamfer, or chamfers, also facilitates removal of the corner body 300 from a pallet. The geometry of the chamfer allows goods or products on the product supporting surface to slide over the chamfer, and the rest of the second lateral projection 308, when the corner body 300 is removed from a loaded pallet. Similarly, if goods or products are removed from a pallet with a corner body 300 inserted therein, the chamfer allows the goods or products to be slid over the corner body 300 to aid in the unloading thereof.

The second lateral projection 308, or specifically its connection to internal walls 302*a*, 304*a* of the first and second edge sections 302, 304, is reinforced by ribs 320 (only two of which are numbered in FIGS. 28*a* and 28*b*). In the Illustrated embodiment, three such ribs 320 provide additional support in connecting the second lateral projection 308 to each of the first and second edge sections 302, 304. The ribs 320 increase the strength of the overall corner body 300 by reducing the risk that the second lateral projection 308 breaks apart from the first and/or second edge sections 302, 304. As a result of the presence of the ribs 320, more load can be transmitted through the second lateral projection 308, and so the corner body 300 which incorporates said second lateral projection 308.

In order to provide space on the first and second edge sections 302, 304 to incorporate the ribs 320, a lip 322 exists above the second lateral projection 308. The lip 322 is specifically shaped so as to allow the ribs 320 to secure to the edge body 302, 304, but so as to avoid, to the extent possible, any protrusion beyond the product supporting surface of the pallet. As such, the lip 322 is not present to provide a boundary for the goods on the pallet, but is instead reduced in size, to the extent possible, so as to allow the goods to be more readily added to or removed from the product supporting surface of the pallet. In industry it is recognised that a lip of at least around 8 mm is required around a top deck to have an effective retaining capability. The lip 322 may be of the order of around 2 mm in height. Furthermore, the ribs 320 are angled such that goods can be more readily "slid" over the lip 322.

As shown in the view of FIG. 28*c*, the first lateral projection 306 incorporates a plurality of recesses 324*a*, 324*b*. The recesses 324*a*, 324*b* may be blind bores. Alternatively, the recesses 324*a*, 324*b* could be any one of a plurality of geometries such as generally square, rectangular, hexagonal or other polygonal shape. Further alternatively, the two recesses 324*a*, 324*b* could be replaced with a single slot, or other single geometry. The recesses 324*a*, 324*b* may be configured to receive corresponding projections of a lower recess of the pallet. The combination of the recesses 324*a*, 324*b* and the projections may therefore provide location features which secure the (upper) pallet in place in an elevated stacked arrangement. This is described in greater detail below. FIG. 28*c* also illustrates a wall 325 which is disposed at the end of the first region 314, between the first lateral projection 306 and the second region 314. The wall 325 can be abutted by a load bearing feature to better secure an upper elevated stacked pallet. The wall 325 therefore provides a location feature. The wall 325 may otherwise be described as a rim, or raised boundary. Outer wall 304*b* of the second edge section 304 is also indicated in FIG. 28*c*.

FIG. 28*d* is a view of the corner body 300 from above. FIG. 28*d* best illustrates the slot 310 and ribs 312. Cavity 309 is also shown, again indicated with a dashed line for ease of illustration. As mentioned above, the cavity 309 is sized to receive a tip support of a pallet.

Although there are many advantages provided by the corner body 300, one in particular is that the plane of symmetry which runs through the corner body 300 means that the corner body is reversible. That is to say, the same geometry of corner body 300 can be used in connection with both a lower and upper pallet in an elevated stacked arrangement. For example, in FIG. 34 the respective corner bodies 300 could be removed, turned 180 degrees (about a line corresponding with the direction of their insertion/removal), and then be received by lower recesses of an upper pallet in the reversed orientation. This provides the advantage that a single geometry of corner body 300, and so a single variety of corner body 300, can be received by either an upper or lower pallet. This is beneficial because a support member incorporating the corner body 300, or a plurality thereof, can be used (inserted into the pallets) in two different orientations. Furthermore, the manufacturing process for producing a support member including two corner bodies is relatively straightforward because the same corner body can be used at each end of the support member.

Returning to FIGS. 28*a*-28*d*, outer faces 302*b*, 304*b* of the first and second edge sections 302, 304, incorporate a logo in two different orientations. That is to say, a logo is in a first orientation on the outer wall 302*b* of the first edge section 302, and in a second orientation on the outer wall 304*b* of the second edge section 304. This means that one logo is in the correct orientation irrespective of the orientation of the corner body 300, to which it is incorporated. In other words, one logo will be in the correct orientation, and so legible, whether the corner body 300 is in place on an upper pallet, or a lower pallet.

The corner body 300 may be manufactured from metal or plastic. In a preferred arrangement the corner body is between around 35 mm and around 75 mm in width and length.

In some instances, the corner body 300 may be disposable. This may be owing to the fact that the corner body is made from an inexpensive material and can therefore be manufactured cheaply. However, in other instances, the corner body 300 may be reusable. This is beneficial for reasons of recycling and therefore being environmentally friendly.

The corner body 300 may be reused independently of the overall support member. That is to say, the corner body 300, or specifically the two corner bodies 300 which form a support member, may be removed and reused whilst the elongate member, which was disposed therebetween, is disposed. This has the advantage that the likely more costly but smaller corner bodies 300 can be reused whilst the comparatively cheaper and larger, and so more difficult to transport, elongate members are disposed of.

Although the Illustrated corner body 300 incorporates lateral projections 306, 308 which are intended for use with the third embodiment of the first aspect of the invention, the corner body 300 could be adapted for use with either of the first or second embodiments. This would simply involve modifying the first and second lateral projections 306, 308 accordingly.

FIGS. 59*a* to 59*d* are various views of a laterally insertable corner body 1000, herein referred to as corner body 1000.

The corner body 1000 shares many features in common with the corner body 300 (as illustrated in FIGS. 28*a* to 28*d*, and described above). Features common to both corner bodies 300, 1000 will therefore not be described in detail here. However, there are a number of differences between the two embodiments, as set out below.

The principal difference between the two embodiments is the height of a first region 1002. As described in connection with the corner body 300, the corner body 1000 has a constant thickness in the first region 1002, and a variable thickness in a second region 1004. The second region 1004 can otherwise be said to refer to a tapering region of the corner body 1000. The total height of the corner body 1000 is therefore formed of a sum of the heights of the first region 1002 and the second region 1004.

The increased height, or length, of the first region 1002 results in a larger corner body 1000. Specifically, the corner body 1000 of FIGS. 59*a* to 59*d* is taller than the corner body 300 of FIGS. 23*a* to 23*d*.

There are a number of advantages associated with the taller corner body 1000. Firstly, when the corner body 1000 is used in an elevated stacked arrangement of pallets, the taller corner body 1000 provides improved retention of the upper pallet in the stacked arrangement. This is because there is a greater surface area of first and second edge sections 1006, 1008 (i.e. the wall sections substantially perpendicular to one another forming the bulk of the corner body 1000) in contact with the side wall of the pallet. This also results in better control of the upper pallet during transportation. The increased height of the corner body 1000 also improves the tolerance of the stacked arrangement to vibration. Specifically, the corner body 1000 is less likely to disengage from the upper pallet when subjected to vibration. Finally, the increased height leads to an increased likelihood that the corner body 1000 would be realigned in the correct position on the pallet (i.e. engaged) when any of the aforementioned conditions occur. In other words, the increased height of the corner body 1000 results in an improved stability stacked arrangement during transportation and/or storage (to name two possible scenarios).

The corner body 1000 may have a height of around 65 mm.

As well as the difference in height, there are other differences between the corner body 1000 and corner body 300.

The corner body 1000 incorporates a date stamp 1010 disposed in second lateral projection 1012.

A further difference between the corner bodies 1000, 300 is that first lateral projection 1014 now incorporates an arrangement of openings 1016*a* to 1016*c*. The openings 1016*a* to 1016*c* are one example of projection-receiving features. The purpose of the openings 1016*a* to 1016*c* is better understood in view of Figures of 59*c* and 59*d* and FIG. 36. The openings 1016*a* to 1016*c* are configured to receive projections which project from a lower recess of a pallet in an elevated stacked arrangement (see, for example, FIG. 36). In the corner body 1000, the opening 1016*b* (i.e. the central opening) has been added. The central opening 1016*b* is configured to receive an apex projection, such as that labelled 1114*a* in FIG. 64. In other words, the three openings 1016*a* to 1016*c* enable the corner body 1000 to be used in combination with different arrangements of projections in the corner of a pallet. This is desirable for reasons of improved compatibility and reduced part proliferation.

Preferably only two of the three openings 1016*a* to 1016*c* actually receive a projection of an elevated stacked pallet at any one time.

The openings 1016*a* to 1016*c* are provided in a triangular arrangement. That is to say, one opening is positioned in a respective vertex of a right-angled triangle.

Figure 59A:
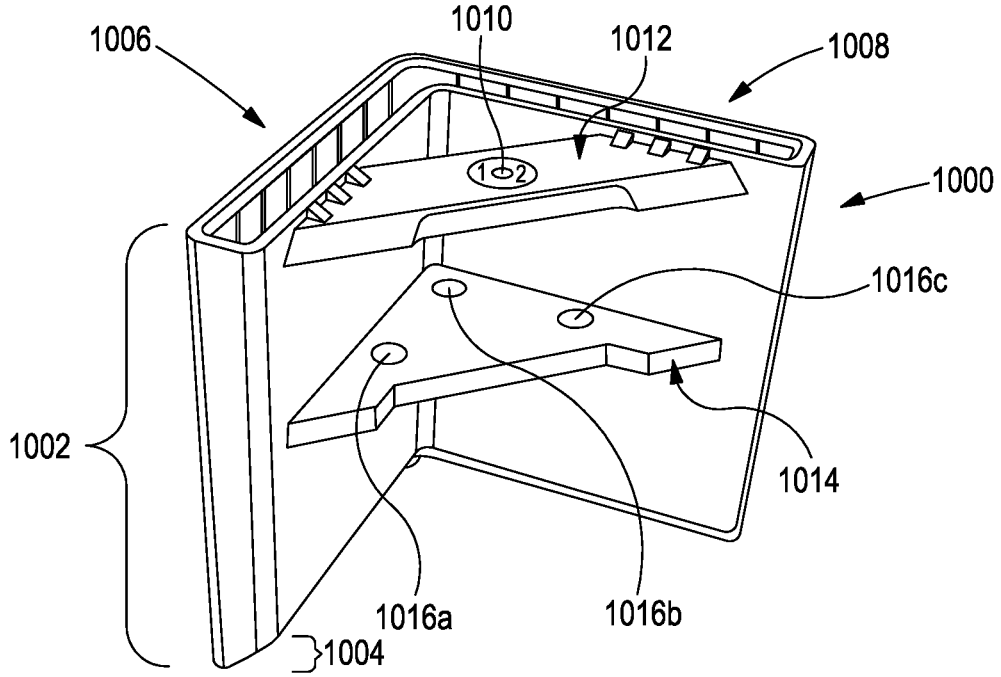
Figure 59B:
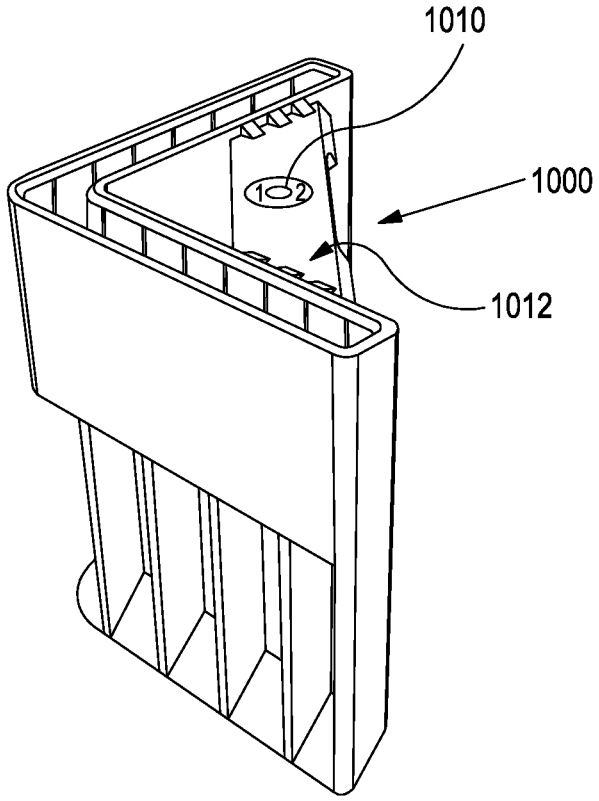
Figure 59C:
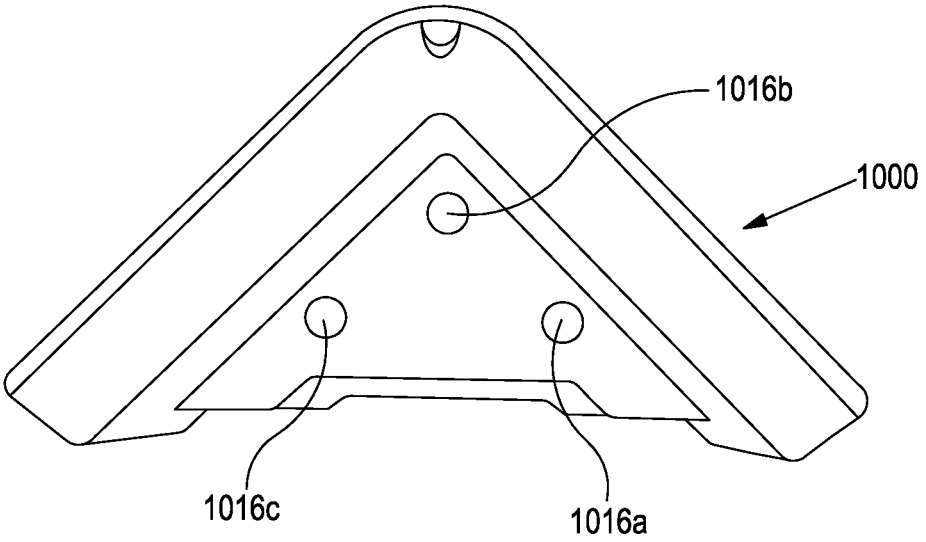
Figure 59D:
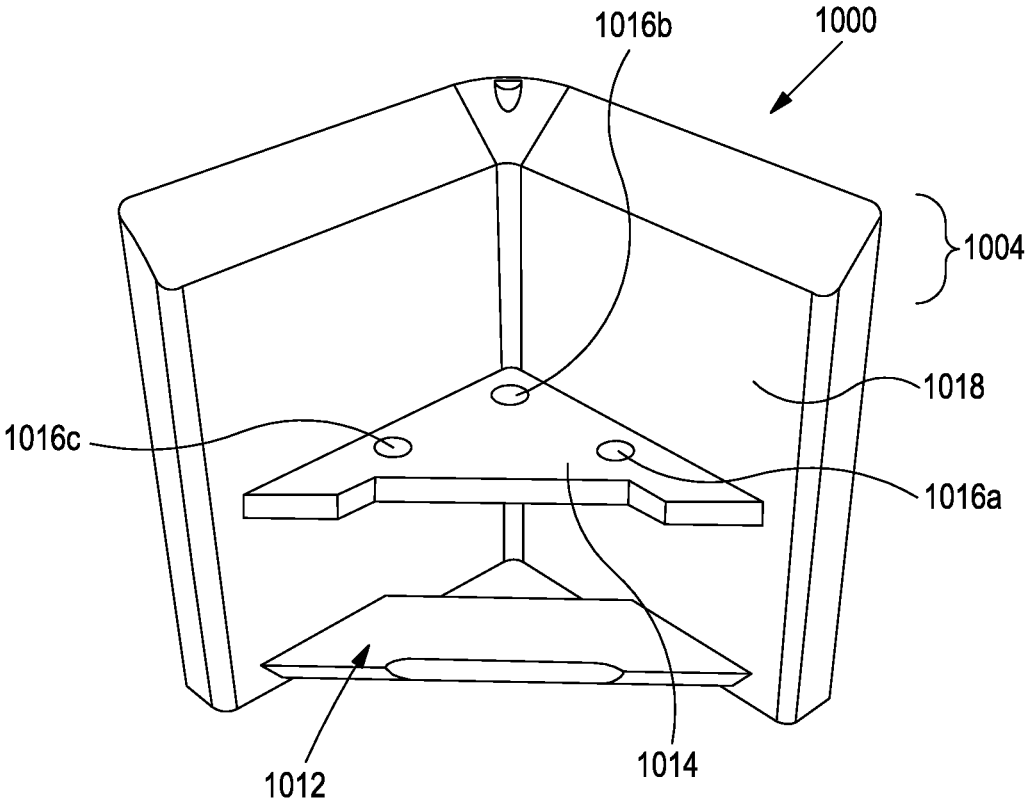

Whereas the corner body 300 of FIG. 28*c* has two recesses 324*a*, 324*b*, the openings 1016*a* to 1016*c* of FIG. 59*c* allow for a longer projection to be received therein. This improves the ability of the corner body 1000 to hold the upper pallet in an elevated stacked arrangement in the correct, engaged, position. In preferred embodiments, the projections received in the openings 1016*a* to 1016*c* do not project from the opposing side of the respective opening. That is to say, the projections are preferably concealed within the length of the bore defined by the opening. As will also be appreciated from FIG. 59*d*, the increased height of the corner body 1000 leads to an increased height of the wall 1018 which is disposed between the first lateral projection 1014 and the second region 1004 of the corner body 1000. The wall 1018, in use, engages a sidewall of an upper pallet of an elevated stacked arrangement. The openings may be referred to as bores, specifically as through bores.

The distance between a near face of the first lateral projection 1014 and an outermost end of the second region 1004 may be around 35 mm.

The use of corner bodies 1000 in an elevated stacked arrangement is shown in FIGS. 60 to 63, and is described in further detail later in this document.

In some embodiments, at least one of the lateral projections is configured to engage a pallet support. Specifically, in some embodiments at least one of the lateral projections is configured to engage a pallet skid. The lateral projection may provide a surface, or shelf, upon which the pallet skid rests. It may be an underside of the pallet skid which engages the lateral projection. In preferred embodiments it is a face of the first lateral projection proximal a tapering region of the corner body which is engaged by the skid.

Due to the geometry of the skid, one skid may engage lateral projections of a plurality of corner bodies, or support members. For example, the skid may span an entire length, or width, of the pallet, such that the skid spans two corners of the pallet. The skid may therefore engage lateral projections of two corner bodies or support members. This arrangement is particularly advantageous when at least the upper pallet of an elevated stacked arrangement is a half pallet.

FIG. 29 shows two corner bodies 300 with an elongate member 340 received therebetween. Specifically, end portions of the elongate member 340 are received in respective slots (not visible in FIG. 29) in the corner bodies 300. FIG. 29 demonstrates how end portions of the elongate member 340 are inserted in the slots of the corner bodies 300 to thereby constitute a support member 350. A majority of the length of the elongate member 340 remains outside of the slots of the corner bodies 300.

In the illustrated arrangement, the elongate member 340 is cardboard. Specifically, the elongate member 340 is a cardboard angled portion (i.e. having a generally L-shaped cross-section and which may also be referred to as a cardboard edge protector). As such, a single piece of angled cardboard generally conforms to the corner shape of the corner bodies 300. As such, like the corner bodies 300, the elongate member 340 also defines an internal corner 341. Whilst the shape of the elongate member 340, or specifically the cross section thereof, corresponds to that of the slots of the corner bodies 300, in other arrangements two straight bodies, i.e. a plurality of elongate members, could also be used—one received by each of the edge sections 302, 304. The use of an angled portion as the elongate member 340 is particularly advantageous because the cross section corner geometry has good anti-buckling properties. That is to say, more load can be transmitted through the elongate member 340 before elongate member 340 buckles.

The elongate member 340 may be between around 25 mm and around 40 mm in height and width (when viewed in plan). The elongate member 340 may be between around 2 mm and around 5 mm in thickness, preferably between around 3 mm and 4 mm thick.

Also demonstrated in FIG. 29 is the plane of symmetry through the support member 350. The plane of symmetry is indicated with the reference number 343. The plane of symmetry 343 through the support member 350 is only possible by virtue of the planes of symmetry which also exist through the corner bodies 300 and the elongate member 340 individually. The plane of symmetry 343 through the support member 350 is advantageous because this allows the support member 350 to be used in either orientation. The benefit of being able to use the support member 350 in either orientation is that the time taken to for example manufacture the support member 350 by a worker is reduced. The process is made more efficient as a result.

FIG. 29*a* is a close-up side-on view with the corner body 300 partially transparent. FIG. 29*a* indicates how an end portion of elongate member 340 is received in the slot of the corner body 300. FIG. 19*a* also indicates how the slot only spans part way through an overall length of the corner body 300, and so the end portion of the elongate body 340 is only inserted part way through an overall length of the corner body 300.

FIG. 29*b* is the same as FIG. 29*a* save for the fact that FIG. 29*b* shows a lower end of the support member 350. For the sake of completeness, FIG. 29*b* is slightly rotated in a clockwise direction relative to the view shown in FIG. 29*a*.

The corner body 300 shown in the following Figures may differ slightly from that indicated in FIGS. 18*a* and 18*b*. For example, the recesses 324*a*, 324*b* and recess 314 may be omitted.

FIG. 30 is a perspective view indicating the directions in which the support members 350 are connected to a pallet 360. In particular, the illustrated pallet 360 corresponds with the third embodiment of the first aspect of the invention i.e. FIGS. 12 to 15*b*. In particular, the front corners 362, 364 correspond with the corner illustrated in FIG. 13. As such, the front corner 362 comprises a lower recess 364, a supporting slot 366 and an upper recess 368. The upper recess 368 is in the form of a trench. The corner 362 further comprises a tip support 370. The trench 368 is defined between the tip support 370 and a product supporting surface 372 of the pallet.

Although the pallet 360, or specifically the product supporting surface 372 thereof, is not supporting any goods or products in FIG. 30, the support members 350 can also be inserted when goods or products are loaded thereon.

The lateral direction of insertion of the support members 350 is indicated by arrows 374. As such, support member 350, or specifically the corner bodies 300 thereof, are inserted generally parallel to the plane of the product supporting surface 372. This allows for the lateral projections of the corner bodies 300 to be received by the corresponding load bearing features of the pallet 360. Some rotation, or pivoting, of the support member 350 may be required in order for the lateral projections to be fully received by the load bearing features. In particular, some pivoting may be required in order for the second lateral projection 308 to be received by the trench. This is more clearly illustrated in FIG. 32.

FIG. 31 is an offset side view of one of the corners 362 of FIG. 30. Dashed lines generally indicate the load bearing features by which the lateral projections 306, 308 of the support member 350 are received. Specifically, the first lateral projection 306 is received by the supporting slot 366. The second lateral projection 308 is received by the upper recess 368. As mentioned, dashed lines generally indicate the alignment of the lateral projections 306, 308 and the respective load bearing features which receive them. Although not clearly visible in FIG. 31, the pallet 360, or specifically corner 362 thereof, does incorporate tip support 370.

FIG. 32 is a top down view of the pallet 360 with support member 350 positioned thereon. Specifically, lateral projections 306, 308 of the corner body 300 are received by corresponding load bearing features in the FIG. 32 arrangement.

Support member 350 is shown in a partly cut away view such that only one corner body 300 is visible. Specifically, support member 350 is cut part-way along the elongate member 340 which is received thereby. FIG. 32 also indicates how the elongate member 340 is received in the slot 310 of the corner body 300.

FIG. 32 illustrates how the second lateral projection 308 is received in the upper recess 368. Specifically, FIG. 32 indicates how the second lateral projection 308 is constrained by the trench defined between the product supporting surface and the tip support 370.

FIG. 32 also shows how the second lateral projection 308 defines, at least in part, a cut-out 376. The cut-out 376 is an aperture in the product supporting surface. The cut-out 376 opens out into a cavity 378. The cut-out 376 corresponds with an uppermost point of a rear foot of the pallet 360. The rear foot defines the cavity 378.

FIG. 32 demonstrates how the product supporting surface and the tip support 370 define the trench which receives, and provides lateral retention of, the second lateral projection 308. In other words, the support member 350 is more securely received by the corner 362. In practice, the second lateral projection 308 may protrude slightly above the product supporting surface. This protrusion may be of the order of, for example, between 0.2 mm and 1 mm. This protrusion is useful in that, when products or goods are placed on the product supporting surface, the weight of the products or goods will further assist in the "locking in" of the second lateral projection 308 in the trench. As described in connection with FIGS. 18*a* to 18*d*, the second lateral projection 308 incorporates features to ease the removal of the corner body 300 from the upper recess 368.

FIGS. 33*a* and 33*b* are external and internal perspective views respectively of a pallet 360 with support members 350 received thereby. Similar to FIG. 32, the interaction between the second lateral projection 308, the product supporting surface 361 and the tip support 370 (the outline of which is indicated roughly with a dashed line, and more clearly illustrated in FIG. 32) is illustrated. FIGS. 33*a* and 33*b* also show how the support member 350 is self-supporting on the pallet 360. That is to say, with the first and second lateral projections 306, 308 received by corresponding load bearing features, the support member 350 can support its own weight. The support member 350 can therefore remain in position on the pallet 360 even when the pallet 360 is unloaded.

FIG. 34 is a perspective view of a pallet 360 with four corner bodies 300 received by respective load bearing features of the deck. The FIG. 34 pallet 360 corresponds with that of a lower pallet of an elevated stacked arrangement. As such, this first orientation of the corner body 300 means that the second lateral projection 308 is received by an upper recess, and the first lateral projection 306 is received by a supporting slot.

Although there are no elongate members received in the slots of the corner bodies 300 in FIG. 34, it is expected that in normal practice the corner bodies 300 will only be inserted with the elongate member already inserted therein. In other words, it is anticipated that during normal use it will be an entire support member 350, rather than just the corner body 300, which is inserted into the pallet 360. This is advantageous in that the overall support member 350 is more easily manipulated by a user.

FIG. 34 indicates that the corner body 300 has been designed so as to avoid interrupting, where possible, the product supporting surface 361. This is achieved by reducing the height above the product supporting surface 361 by which any part of the corner body 300 protrudes. Although it is noted that the second lateral projection of the corner body may protrude slightly beyond the product supporting service 361, this will have no effect, in any way, of restraining the goods or products loaded on the product supporting service 361. In fact, as previously mentioned, there are features incorporated in the corner body 300 so as to aid in its removal from the product supporting surface 361. Similarly, there are features incorporated in the corner body 300 to aid in the removal of goods and products from the product supporting surface 361 when the corner bodies 300 are in situ. As such, it is not the purpose of the corner bodies 300 to restrain or in any way retain goods or products on the product supporting surface 361.

FIG. 35 is an offset side view of a pallet 360 with a support member 350 being aligned therewith. The pallet 360 in FIG. 35 constitutes an upper pallet in an elevated stacked arrangement. As such, it is an upper end of the support member 350 which is shown being aligned with the pallet 360. For reference, FIG. 15*a* shows part of an elevated stacked arrangement and indicates which load bearing features of the upper and lower pallets respectively co-operate with the support member 350.

Returning to FIG. 35, the arrow 374 indicates again that the support member 350 is laterally inserted. FIG. 35 also demonstrates the constant thickness first region 314 and the variable thickness second region 316 of the corner bodies 300.

Due to the pallet 360 being an upper pallet, only the first lateral projection 306 provides the pallet 360 with any support. That is to say, for the upper pallet 360, the second lateral projection 308 does not interact with the pallet 360, nor does it provide any support.

Again, with the pallet 360 being the upper pallet of an elevated stacked arrangement, the first lateral projection 306 is received by a lower recess 364. Dashed lines indicate the approximate alignment of the first lateral projection 306 with the lower recess 364.

As will also be appreciated, a wall 325 of the corner body 300 provides some support in securing the arrangement by conforming with the corner 362 of the pallet 360, more specifically the lower recess 364 thereof. Although not indicated in FIG. 35, as mentioned in connection with FIG. 28*c*, the first lateral projection 306 may incorporate recesses 324*a*, 324*b*. These recesses 324*a*, 324*b* may interact with corresponding projections of the lower recess to provide a location feature, or securing feature. This is shown in FIG. 36.

FIG. 36 is a side view of the pallet 360, angled slightly from beneath, with a corner body 300 received by the lower recess 364. Corner body 300 is shown in a part cutaway view so as to more clearly demonstrate the interaction between the first and second lateral projections 306, 308 and the pallet 360, and constituent features thereof. The elongated member is also omitted from FIG. 36 for clarity.

Beginning with the first lateral projection 306, the first lateral projection 306 is received by the lower recess 364. As such, the first lateral projection 306 generally conforms to the lower recess 364. The first lateral projection 306 abuts the lower recess 364 when received thereby.

The first lateral projection 306 comprises recesses 324*a*, 324*b* (the recess 324*a* is not visible in FIG. 36). The recesses 324*a*, 324*b* are of the form of blind bores. As such, the recess 324*a* is not visible through the first lateral projection 306 in the FIG. 36 illustration. The recesses 324*a*, 324*b* are configured to receive a corresponding projection 380*a*, 380*b* (projection 380*a* not visible in FIG. 36).

The projections 380*a*, 380*b* are of the form of pins, or pegs, which project from the lower recess 364. As such, the pins 380*a*, 380*b* are received by corresponding blind bores 324*a*, 324*b*. Although the projections and recesses in the illustrated embodiment are pins and blind bores respectively, other arrangements are contemplated. For example, a single projection and recess could alternatively be used. Further alternatively, a slot could be used in place of the recesses 324*a*, 324*b*. Alternatively, projections may be incorporated in the first lateral projection 306, and a further suitable recess may be disposed on the lower recess 364. Any retention or holding mechanism, or features suitable therefor, may therefore otherwise be applied to either of the pallet 360 and the corner body 300.

FIG. 36 also demonstrates how the recess 314 of the first lateral projection 306 conforms to a chamfer 382 of a rear foot 384. In other words, the first lateral projection 306 is shaped to receive the rear foot 384. Furthermore, the portion 306*a* which protrudes beyond the recess 314 can also be seen "wrapping around", or confirming to, the rear foot 384. The conforming of the first lateral projection 306, and the second lateral projection 308, to feet of the pallet 360 is only relevant for the rear feet of the pallet 360. This is owing to the proximity of the rear feet (i.e. the generally square feet, not the larger, rectangular feet as shown in FIG. 2) to the corners of the pallet 360, and so the corner bodies 300 received thereby.

The second lateral projection 308, or specifically a recessed portion thereof, is also illustrated as abutting, or conforming to, the chamfer 382. Like that of the first lateral projection 306, portions of the second lateral projection 308 protrude beyond the recessed portion and wrap around the chamfer 382. Various features of the first and second lateral projections 306, 308 therefore allow the corner body 300 to fit around the rear foot 384, or specifically the chamfer 382 thereof. These features also provide as much surface area as possible for receipt by the respective load bearing features of the pallet 360 (when, for the second lateral projection 308, the pallet is a lower pallet of an elevated stacked arrangement). In other words, the geometry of the first and second lateral projections 306, 308 allow them to conform to the rear feet whilst providing a surface area which is received by load bearing features.

FIG. 37 shows an elevated stacked arrangement 386 which comprises a lower pallet 360*a*, an upper pallet 360*b* and two support members 350. It will be appreciated that, typically, four support members 350 will be used, one for each corner of the pallets 360*a*, 360*b*. Furthermore, typically the pallets 360*a*, 360*b* will be loaded with goods or products before being arranged in the elevated stacked arrangement as shown in FIG. 37. However, FIG. 37 illustrates the functionality of the support members 350 in the upper pallet 360*b* when the upper pallet 360*b* is positioned in an elevated stacked arrangement above the lower pallet 360*a*. FIG. 37 shows how only two support members 350 are required in some embodiments to support the upper pallet 360*b*.

FIG. 38 is a more accurate representation of an elevated stacked arrangement 388. FIG. 38 is the same as FIG. 37 except for the incorporation of further support members 350 such that there is a support member at each corner of the pallets 360*a*, 360*b*. Furthermore, in FIG. 38 goods or products 389, 390 are schematically illustrated. As such, the elevated stacked arrangement 388 of FIG. 38 shows how loaded pallets 360*a*, 360*b* can be more efficiently stacked upon one another so as to increase the efficiency of transport and storage. That is to say, for the same pallet footprint, twice the amount of goods or products can be transported or stored. It should be noted that typically a securing means such as one or more straps and/or a film is applied around at least the lower pallet 360*a* in order to secure the support members 350 in place.

The vertical distance between a lowermost point of the lower pallet 360*a* and a lowermost point of the upper pallet 360*b* may be around 1200 mm. The vertical distance between a lowermost point of the lower pallet 360*a* and an uppermost point of the goods or products 390 of the upper pallet 360*b* may be around 2350 mm. The height of the goods or products 389, 390 may be around 1000 mm. In the illustrated arrangement, the support members 350 may be around 1200 mm in length. A gap of around 50 mm may exist between the uppermost face of the goods or products 389 of the lower pallet 360*a* and a lowermost point of the upper pallet 360*b*.

FIG. 39 is a close up perspective view of the lower pallet 360*a* of the elevated stacked arrangement 388 of FIG. 38. Shown more clearly in FIG. 39 are the corner bodies 300 of the support members 350, and their relative positions with respect to the lower pallet 360*a*. In particular, it will be observed that the corner bodies 300 are, to the extent possible, aligned with the product supporting surface so as not to protrude beyond the product supporting surface. As such, the surface area available for supporting products is at least largely unaffected by the corner bodies 300. Similarly, it will be observed that the corner bodies 300 provide no retaining of the goods or products 389 stacked on the pallet 360*a*.

FIGS. 60 to 63 show elevated stacked arrangements using pallets with the same corner arrangement as that shown in FIGS. 57*a* to 58*c*, and using the corner bodies as illustrated in FIGS. 59*a* to 59*d*.

Figure 60:
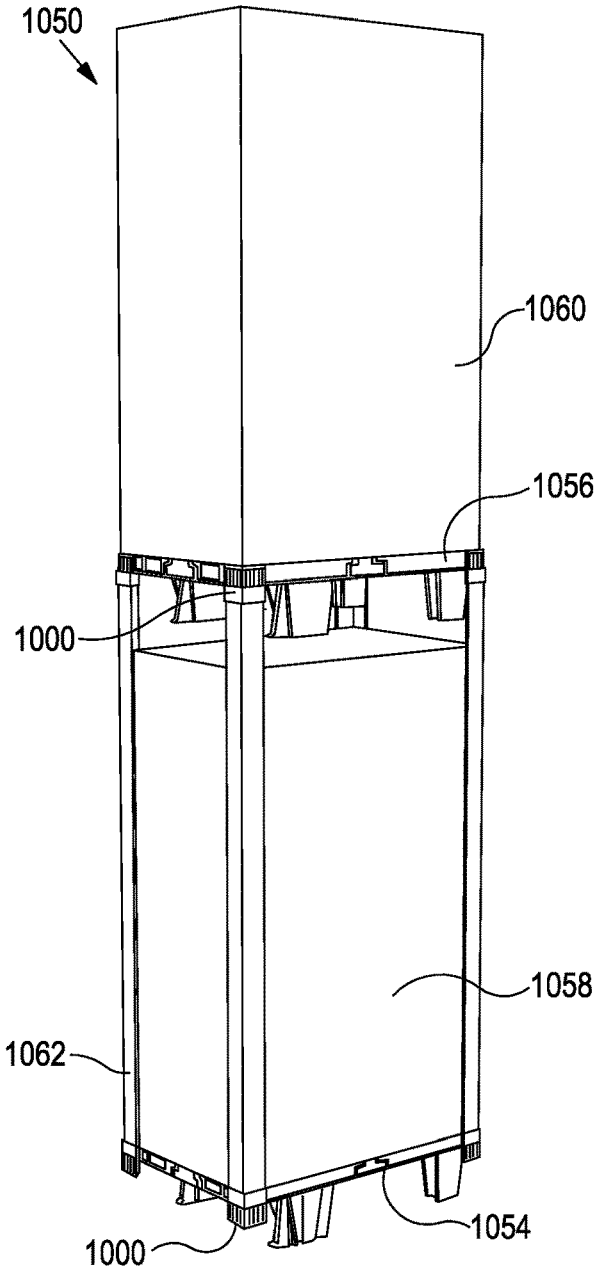
Figure 61:
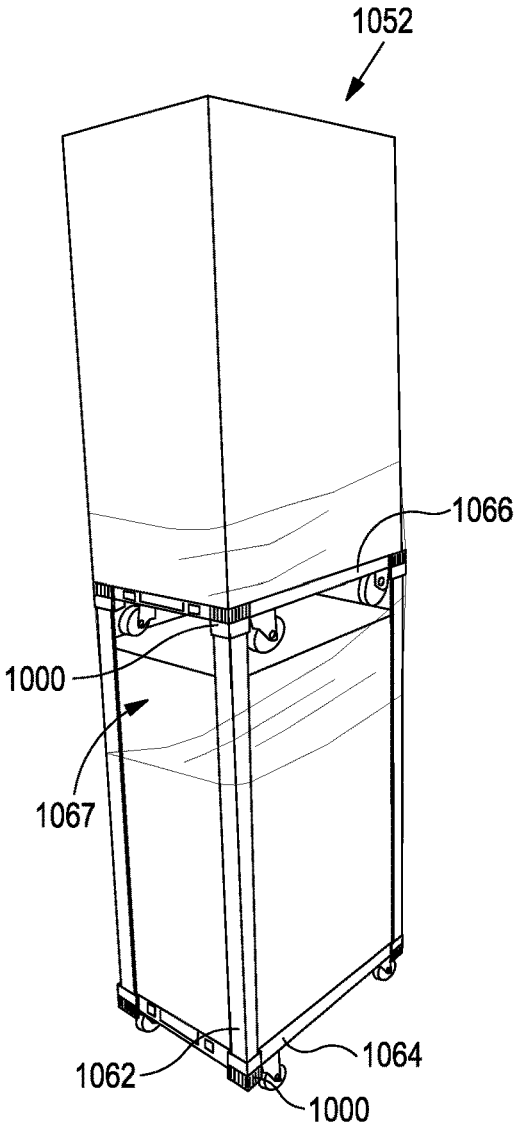

FIGS. 60 and 61 show elevated stacked arrangements 1050, 1052.

FIG. 60 shows two quarter pallets in accordance with the embodiment shown in FIGS. 57*a* to 58*c*. FIG. 61 illustrates an elevated stacked arrangement 1052 which includes two quarter dollies in accordance with the first aspect of the invention. There are many similarities between FIGS. 60 and 61, and FIG. 61 will therefore not be described in detail.

FIG. 60 shows two quarter pallets 1054, 1056. The pallet 1054 may be referred to as a first, or lower, pallet, and pallet 1056 may be referred to as a second, or upper, pallet owing to the second pallet being elevated above the first pallet 1054. Each of the first and second pallets 1054, 1056 are also shown with goods or products 1058, 1060 stacked thereon. Support members 1062 are provided at each corner of the pallets 1054, 1056. Corner bodies 1000 are provided at each end of the support member 1062, the corner bodies being the same as those illustrated in FIGS. 59*a* to 59*d*.

FIG. 60 shows a preferred elevated stacked arrangement 1050 using a preferred embodiment of both pallet 1054, 1056 and corner body 1000. As will be appreciated when considering FIG. 60 in comparison to FIG. 38, the corner bodies 1000 are in contact with the upper pallet 1056 to a greater extent than those shown in FIG. 38. This distinction gives rise to the advantages explained earlier in this document in connection with the corner body 1000. Namely, the general stability of the stacked arrangement is improved as a result of the increased height of the corner body 1000.

FIG. 61 shows the elevated stacked arrangement 1052 comprising first and second quarter dollys 1064, 1066 also separated by support members 1062 incorporating corner bodies 1000. FIG. 61 also shows shrink wrap film 1067 which secures the support members 1062 in place around the second dolly 1066.

FIG. 62 is a close up view of the elevated stacked arrangement 1050 of FIG. 60. Specific regions of interest are magnified in FIG. 62. The first pallet 1054 is shown in the lower section of the Figure, and the second pallet 1056 is shown in the upper section of the Figure. The interaction between the corner bodies 1000 and pallets 1054, 1056 can observed more clearly in FIG. 62. The line 1068 indicates a middle section of FIG. 60 has been cut away in order to allow for the magnified view.

FIG. 63 shows part of the elevated stacked arrangement 1052 of FIG. 61, but with the shrink wrap film having been removed, along with the goods or products from the second dolly 1066. FIG. 63 therefore also shows the extent to which the corner bodies 1000 engage the side wall of the quarter dolly 1066.

The elevated stacked arrangements shown in FIGS. 60 and 61 benefit from all of the advantages described in connection with the corner body 1000. Specifically, due to the increased height of the corner bodies 1000, the upper pallets are more securely retained in the elevated stacked arrangement. There is also improved control of the upper pallet during transportation of the arrangement. Finally, the risk of the stacked arrangement disengaging when subjected to vibration, such as during transport, is also reduced.

Retention Structure

FIG. 40 is a view of a pallet 600, according to another aspect of the invention, from underneath. Also shown in FIG. 40 are four corner bodies 300 according to the present aspect of the invention. It will be understood that the corner bodies 300 do not form part of the pallet 600 according to the present aspect of the invention.

As indicated in connection with the previous embodiments of the prior aspects of the invention, the pallet 600 comprises of a product supporting surface 602 (not visible in FIG. 40). The product support surface 602 forms part of a deck 604. The deck is defined by the product supporting surface 602 and four sides 606, 608, 610, 612. Features of particular importance with respect to the present aspect of the invention are those of retention features 614, 615. The specific features constituting the retention structures 614, 615 will be discussed in greater detail below. However, in particular, the retention structures 614, 615 are configured to retain electronic devices (not shown in FIG. 40). Furthermore, retention structures 614, 615 ensure a face of each of said electronic devices is aligned with an aperture 617, 620 in the respective side 606, 610 of the deck 604.

FIG. 41 is a close up view of the retention structure 614 of FIG. 40. FIG. 41 is a view which is generally from below but is angled slightly to better show the various features constituting the retention structure 614.

The retention structure 614 comprises retaining members 616, 618 in the form of clips. The retaining members 616, 618 are substantially identical. Each of the retaining members 616, 618 comprises a hooked portion 616*a*, 618*a*, a stem 616*b*, 618*b* and a base 616*c*, 618*c*. Each stem 616*b*, 618*b* interposes the respective base 616*c*, 618*c* and respective hooked portion 616*a*, 618*a*. The bases 616*c*, 618*c* are connected to an opposing underside 603 of the product supporting surface 602 of the deck 604.

The retaining members 616, 618 are biased towards a retaining configuration. That is to say, the retaining members 616, 618 are slightly flexible but, at rest, will return to a retaining configuration like that shown in FIG. 41. This is advantageous because the retaining members 616, 618 allow the electronic device to be inserted without requiring tools of any sort. Furthermore, in the case of retaining member 616, 618 being clips, as per the illustrated embodiment, feedback is provided to a user when the electronic device is inserted and is correctly received, or retained, by the retention structure 614. The feedback is in the form of the retaining members 616, 618 returning (or 'snapping back) to their at rest position, having been urged away from one another during insertion of the electronic device.

The electronic device is inserted from underneath the pallet 600. That is to say, the electronic device is pushed upwards against the hooked portions 616*a*, 618*a*. Upon insertion of the electronic device, the hooked portions 616*a*, 618*a* of the retaining member 616, 618 are urged away from one another. That is to say, the hooked portions 616*a*, 618*a* are urged towards a receiving configuration, which is away from a retaining configuration. The urging of the hooked portions 616*a*, 618*a* occurs by virtue of abutment of an outer face, or other feature, of the electronic device upon opposing faces of the hooked portions 616*a*, 618*a*.

The stems 616*b*, 618*b* are sized so as to allow some flex of the retaining members 616, 618 without comprising the structural integrity. That is to say, some bending, or deflection, of the retaining members is possible, without risking breakage, or fracture, of the retaining member 616, 618.

The electronic device is located in position once the hooked portions 616*a*, 618*a* return to their retaining configuration.

The retention structure 614 further comprises a plurality of alignment bodies 622, 624. In the illustrated embodiment the alignment bodies 622, 624 are of the form of projections. The projections extend from a rib 626. The rib 626 forms part of a structure which supports the deck 604. The rib 626 is parallel to the side 606 of the pallet 600. The alignment bodies 622, 624 extend, or project, from the rib 626 towards the side 606. The rib 626 forms part of a lattice structure underneath the product supporting surface. The combination of the rib 626, along with a portion of the side 606 and side ribs 627*a*, 627*b* define a perimeter which surrounds the retention structure 614.

The alignment bodies 622, 624 are abutted by the electronic device upon its insertion. The alignment bodies 622, 624 therefore assist in the alignment of the electronic device. Specifically, the alignment bodies 622, 624 assist in the alignment of the electronic device relative to the aperture 617 (not visible in FIG. 41). The alignment bodies 622, 624 urge the electronic device against the aperture 617. The alignment bodies 622, 624 also assist in the alignment of the electronic device in a direction perpendicular to the side 606 of the pallet 600. That is to say, in view of the orientation of the alignment bodies shown in FIG. 41, the alignment bodies 622, 624 ensure the electronic device is correctly aligned in the vertical direction. In practice, this is a direction parallel to the product supporting surface, and perpendicular to long sides 606, 610 of the pallet 600. The geometry of a window 629 in the product supporting surface prevents the electronic device from being inserted any further. The window 629 geometry therefore ensures that the electronic device does not pass through, or project from, the window 629 in the product supporting surface.

In the illustrated arrangement, the alignment bodies 622, 624 are elongate. That is to say, they are longer than they are wide. In other arrangements, the alignment bodies may not be elongate. For example, the elongate bodies 622, 624 may be wider, so as to define more square geometries. Furthermore, a single alignment body may replace the plurality of alignment bodies 622, 624 in the illustrated arrangement. However, the plurality of alignment bodies 622, 624 is advantageous for reasons of reduced material usage and so reduced cost and weight. Furthermore, in contrast to, for example, a thickened rib, the plurality of alignment bodies 622, 624 do not significantly affect the thickness of the rib from which they project. A significant change in thickness could otherwise affect the uniformness of the cooling of the pallet, when the pallet is injection moulded. This could lead to warping and other undesirable side-effects. The alignment bodies 622, 624 project to the same extent. That is to say, a face of the alignment bodies 622, 624 closest to the side 606 is offset from the rib 626 to the same extent. In other words, the alignment bodies 622, 624 are the same height. The alignment bodies 622, 624 generally have a constant height.

The retention structures 614, 615 of the illustrated arrangement are integrally formed with the pallet 600. That is to say, the retention structures 614, 615 and rest of the pallet 600 form a homogenous structure.

FIG. 42 is a side view of a portion of the pallet 600. The view is taken perpendicular to the side 606. FIG. 42 shows more clearly the aperture 617. The aperture 617, as mentioned above, is what the electronic device aligns with. The retention structure 614 (not visible in FIG. 42) assists in the alignment and retention of the electronic device. FIG. 38 indicates how the retention structure 614 is not visible from the side.

FIG. 43 is a plan view of a portion of the pallet 600. FIG. 43 shows the product supporting surface 602, or a part thereof, and the window 629 cut therein. Through the window 629 the retention structure 614 is visible. In particular, the retaining members 616, 618 and the alignment bodies 622, 624 are visible. The visibility of the electronic device 630 through the window 629 is useful for reasons of a user being able to identify whether the electronic device 630 is present from above the pallet 600 (when the pallet 600 is not loaded with goods or products).

FIG. 44 is a view of a portion of the pallet 600 from below. FIG. 44 is similar to FIG. 41, save for the fact that FIG. 44 is a more direct view from below, as opposed to the slightly angled view of FIG. 41. FIG. 44 again shows the retaining members 616, 618 and the alignment bodies 622, 624.

FIG. 45 is a view of a portion of the pallet 600 from below, with electronic device 630 retained thereby.

The electronic device 630 is of the form of a beacon. The beacon is an RFID identifier of the pallet 600. However, alternative varieties of electronic device 630 are contemplated, such as sensors and other tags. Geometrically, the electronic device 630 is of the form of a disc. The illustrated electronic device 630 therefore resembles a short cylinder in appearance, and is generally disc-like. The electronic device 630 may be waterproof. The electronic device 630 may be reusable. The electronic device 630 may have a finite life and require replacing intermittently i.e. in the case where an incorporated battery runs out.

As indicated in FIG. 45, a first surface 630*a* of the electronic device 630 abuts an inwardly facing surface 606*a* of the side 606. The inwardly facing surface 606*a* is not a continuous surface, owing to the aperture 617 (not visible in FIG. 45) cut therein. A second surface 630*b* of the electronic device 630 abuts the alignment bodies 622, 624. As such, the electronic device 630 is sandwiched between the alignment bodies 622, 624 and the side 606, or the inwardly facing surface 606*a* thereof. In the orientation shown in FIG. 45, these features determine the vertical position of the electronic device 630. The first and second surfaces 630*a*, 630*b* are generally flat. As such, the first and second surfaces 630*a*, 630*b* may otherwise be referred to as first and second faces. The first and/or second surfaces 630*a*, 630*b* may also have some form of information, or identification, printed or applied thereon. The information may be machine readable and/or readable by a user. For example, a QR code, or a text code may be applied thereto. The aperture 417 can therefore allow the information applied to the first surface 606*a* to be read by a user/scanner when the electronic device 630 is in situ. Furthermore, the information can be read from a side of the pallet 600.

A third surface 630*c* of the electronic device 630 is a curved surface which extends between the first and second surfaces 630*a*, 630*b* respectively. The third surface 630*c*, or specifically portions thereof, is contacted by the retaining members 616, 618 to retain and align the electronic device 630. Specifically, the hooked portions 616*a*, 618*a* conform, at least in part, to the third surface 630*c* to grip the electronic device 630. In other words, the retaining members 616, 618 grip and thereby retain the electronic device 630.

FIG. 45 demonstrates the overall interaction between the retention structure 614 and the electronic device 630, in use. The various features of the retention structure 614 cooperate with the electronic device 630, or features thereof, to align and retain the electronic device 630 relative to, and with respect to, the pallet 600. The retention structure 614, along with the ribs 626, 627*a*, 627*b* and side 606 also provide some protection to the electronic device 630. For example, if the pallet 600 is dropped, the electronic device 630 is protected (save for the exposure through the aperture 617, which is described below).

FIG. 46 is a side view of a portion of the pallet 600, like that of FIG. 42, with the electronic device 630 shown. The Figure illustrates how the first surface 630*a* of the electronic device 630 is aligned such that it is visible through the aperture 617. This provides a number of advantages. Firstly, the electronic device 630 is externally visible and so it is possible to see whether or not the electronic device 630 is present. Secondly, the aperture 617 provides a direct exposure of the electronic device 630 from the side of the pallet 600. As such, if piece of equipment, such as a scanner, for example, needs to be in closer proximity to the electronic device 630, this can be achieved by using the aperture 617. Also shown in FIG. 46 are indicators 632 around the aperture 617. The indicators 632 indicate that the electronic device 630 is an RFID device. The exact workings and functionality of the electronic device 630 are not of relevance to the invention, and so are discussed in any detail in this document. The indicators protrude from the side 606 of the pallet 600. The indicators 632 serve as a visual indication as to the presence, and type, of the electronic device 630.

Although the above description focuses on the retention structure indicated with reference numeral 614, the above description is also equally relevant to the other retention structure indicated with numeral 615. Furthermore, the pallet 600 may comprise a quantity of retention structures 614, 615 which differs from the illustrated two. For example, a single retention structure may otherwise be provided.

Alternatively, more retention structures may be provided. For example, a retention structure may be provided on each side of the pallet 600. The position of the retention structures 614, 615 may also vary. For example, the retention structures may be disposed at short ends 608, 612 of the pallet.

Overall, the retention structures 614, 615 provide a convenient means of aligning and retaining an electronic device 630. No tools are required for insertion of the electronic device 630, owing to the use of clips. Furthermore, the retention structure 614 being accessible from underneath the pallet 600 means that a user can quickly and easily insert the electronic device 600 by simply turning the pallet 600 over. Alternatively, a user can quickly and easily insert the electronic device 600 from underneath the pallet whilst the pallet is loaded with goods. The aperture 617 provides a window through which the electronic device 630 is readily visible. For a pooled arrangement of pallets (as is typical in industry), whereby the electronic device 630 may be gradually added to pallets of differing versions, the aperture 617 allows a user to easily see whether or not an electronic device 630 is already retained by the retention structure 630 (and so present in the pallet 600). Alignment bodies 622, 624 correctly align the vertical position of the electronic device 630. Retention members 616, 618 align and retain the electronic device 630, particularly in a direction parallel to the side 606. The retention members 622, 624 also provide a user with a positive "snap" feedback when the electronic device 630 is correctly retained by the retention structure 614, or specifically retention members 616, 618 thereof. The surrounding geometry provides some protection for the electronic device 630 from external impacts. The integrally formed nature of the retention structures 614, 616 is advantageous because the retention structures 614, 616 can be manufactured with the pallet 600. That is to say, no further manufacturing or assembly steps are required after the pallet 600 is manufactured. This is desirable for reasons of stock control, the speed of manufacture and the reduction of cost.

Pallet Rib Apertures

FIG. 47 is an angled view of a central portion of a pallet 600, from underneath, according to an embodiment of an aspect of the invention.

As previously described, the pallet 600 comprises a deck 604. The deck 604 comprises a product supporting surface (not visible in FIG. 47). The opposing underside 603 of the product supporting surface is also shown.

The deck 604 further comprises a plurality of ribs 640*a*, 640*b* (many further ribs not numbered). The ribs, generally referred to with the numeral 640, span at least part of the opposing underside 603. Some ribs 640 span an entire length of the opposing underside 603 i.e. from one short side to another, or from one long side to another. Other ribs 640 only span some of a length, or other dimension, of the opposing underside 603. Furthermore, some ribs 640 are a constant height (i.e. the distance by which they project from the opposing underside 603). Other ribs 640 are variable height i.e. are triangular, or similar, in appearance.

The ribs 640 reinforce the deck 604 so as to reduce the extent to which the deck 604 deflects when goods or products are loaded on the product supporting surface.

In accordance with the present embodiment, specific ribs 640*a*, 640*b* are of interest. Although these are constant height ribs, which span an entire width of the opposing underside 603, this may not necessarily be the case. That is to say, these features are not essential to the invention.

The ribs 640*a*, 640*b* are the two ribs which span a short length of the pallet 600, adjacent the hand access hole 639, underneath a largely solid portion of the product supporting surface. That is to say, the ribs 640*a*, 640*b* are disposed adjacent the hand access hole 639 and underneath a portion of the product supporting surface with comparatively fewer apertures therein. FIG. 2 also shows the portion of the product supporting surface beneath which the ribs 604*a*, 604*b* are located.

The ribs 640*a*, 640*b* incorporate apertures 642*a*, 642*b*, 644*a*, 644*b*. These apertures 642*a*, 642*b*, 644*a*, 644*b* are configured to be engaged by a retention mechanism of a detachable enclosure. The detachable enclosure, and the relevant interaction with the pallet 600, will be described in detail below.

The apertures 642*a*, 642*b*, 644*a*, 644*b* are disposed at outer ends of two long sides of a rectangle partly defined by the ribs 640*a*, 640*b*. It is in the rectangle, or specifically the cuboid defined by the rectangle, that the detachable enclosure is received.

The apertures 642*a*, 642*b*, 644*a*, 644*b* are generally rectangular. The apertures 642*a*, 642*b*, 644*a*, 644*b* are vertically arranged in that they are cut into the vertically disposed ribs 640*a*, 640*b*. A face (not visible) of each of the apertures 642*a*, 642*b*, 644*a*, 644*b* is abutted by an abutment of a clip, when the retention mechanism comprises a plurality of clips, and when the detachable enclosure is connected to the pallet 600. The faces are those which are disposed distal to the opposing underside 603. That is to say, when the pallet 600 is in a normal orientation, with the product supporting surface pointing upwards, the faces are the lowermost point of the apertures 642*a*, 642*b*, 644*a*, 644*b*. In use, the apertures 642*a*, 642*b*, 644*a*, 644*b* cooperate with features of the detachable enclosure, specifically the retention mechanism thereof, to releasably connect the detachable enclosure to the pallet 600.

Detachable Enclosure

FIG. 48 is a perspective view of a detachable enclosure 700 according to an embodiment of another aspect of the invention.

The detachable enclosure 700 comprises a base 702 and a lid 704. The base 702 may be referred to as a first portion, and the lid 704 may be referred to as a second portion. Although not clearly illustrated in FIG. 48, FIG. 49 shows the base 702 and lid 704 more clearly. Returning to FIG. 48, the detachable enclosure 700 comprises a retention mechanism, which is indicated generally by the reference numeral 706. The retention mechanism 706 is configured to releasably connect the detachable enclosure 700 to a pallet 600. That is to say, the detachable enclosure 700 can be detached, or disconnected, from the pallet 600, and then reattached, or reconnected, to the pallet 600 afterwards. This is described in greater detail below.

In the illustrated embodiment, the retention mechanism 706 is of the form of a plurality of clips 708, 710, 712, 714. It is the lid 704 which incorporates the clips 708, 710, 712, 714. However, in other embodiments, the base 702 may incorporate the clips 708, 710, 712, 714, but means of securing the lid 704 to the base 702 will also then be required.

The clips 708, 710, 712, 714 each comprise a curved portion 708*a* (these features only numbered with reference to one of the clips), an abutment 708*b* and a release tab 708*c*.

The curved portion 708*a* is connected to the lid 704. Specifically, the curved portion 708*a* extends from a lower portion of the lid 704 (in the orientation shown in FIG. 49). The curved portion 708*a* provides a pivot arm by which the clip 708 can flex. This is of particular relevance to the abutment 708*b* and release tab 708*c*.

The abutment 708*b* may otherwise be referred to as a projection, protrusion or growth. The abutment 708*b* is the feature which interacts with the aforementioned faces of the apertures 642*a*, 642*b*, 644*a*, 644*b* when the detachable enclosure 700 is connected to the pallet 600. The abutment 708*b* projects away from the detachable enclosure 700. The outward projection provides a cooperating face which interacts with the face of the apertures 642*a*, 642*b*, 644*a*, 644*b*. As such, it is the flexing of the clip 708 which determines whether or not the abutment 708*b*, and so clip 708, engages the corresponding aperture 642*a*, 642*b*, 644*a*, 644*b*. It therefore follows that it is the flexing of the clip 708 which determines whether or not the detachable enclosure 700 is connected to the pallet 600.

The geometry of the abutment 708*b* also allows the lid 704 to be urged towards the pallet 600 (as shown in FIG. 49) without needing to flex the clips 708, 710, 712, 714. This is because an external face of the abutment 708*b* tapers outwardly, so as to urge the abutment 708*b* towards the lid 704 and away from the respective aperture 642*a*, 642*b*, 644*a*, 644*b* during insertion. This is advantageous for the reason of easier insertion of the detachable enclosure 700.

The release tab 708*c* is disposed at an end of the clip 708. That is to say, the release tab 708*c* is positioned at a distal end with respect to the curved portion 708*a*. This is advantageous because the release tab 708*c*, which may be urged inwards by a user, is at the end of a comparatively long moment arm. In other words, the clip 708 will flex to a greater extent when the release tab 708*c* is disposed further away from the curved portion 708*a*. This is because the curved portion 708*a* defines the fulcrum, or pivot point, of the clip 708. The release tab 708*c* provides a generally flat surface which the user can press in order to urge the clip 708 to flex.

To insert or remove the lid 704 from the pallet 600, the user pinches, or urges, respective release tabs 708*c* towards one another. This flexes the clip 708, and moves the abutment 708*b* inwardly. The inward movement of the abutment 708*b* thereby disengages the abutment 708*b* from the respective aperture 642*a*, 642*b*, 644*a*, 644*b*. This releases, or disconnects, the lid 704, and so the detachable enclosure 700, from the pallet 600.

The clips 708, 710, 712, 714 project from the lid 704 from recessed portions 716, 718, 720, 722 thereof. That is to say, whilst the lid 704 is generally cuboidal when viewed in plan, there are recessed portions 716, 718, 720, 722 at outer ends of the long sides thereof. These recessed portions 716, 718, 720, 722 enable the lid 704, specifically the clips 708, 710, 712, 714 thereof, to be received in a cuboidal cavity 650 in the pallet 600 (see FIG. 49).

The lid 704 also comprises gripping members 724*a*, 724*b*, which can be grasped by a user. The gripping members 724*a*, 724*b* therefore define a handle, or tabs. This can enable a user to remove the lid 704. The gripping members 724*a*, 724*b* are useful because, when connected to the pallet 600, no other part of the detachable enclosure 700, nor the lid 704 thereof, projects beyond the ribs of the pallet 600. As such, were it not for the gripping members 724*a*, 724*b*, the lid 704 would be difficult to remove from the pallet 600. The gripping members 724*a*, 724*b* project beyond an outermost face of the lid 704. The gripping members 724*a*, 724*b* may otherwise be replaced with some other projection or handling feature.

Although not visible in any Figures, an interior of the lid 704 defines a cavity. It is within the cavity that the component is housed.

As shown in FIG. 48, the lid 704 is separable from the base 702 about a join line (not visible). The component may be secured in or to either of the lid 704 or the base 702, or a combination thereof. Furthermore, other locating bodies may interpose the component and the base 702 or lid 704. For example, a small tray may be secured to the base 702, the component in turn being secured to the tray.

FIG. 49 shows the lid 704, base 702 and a portion of the pallet 600 during insertion or removal of the detachable enclosure 700.

As shown in FIG. 49, the base 702 interposes the lid 704 and the pallet 600. As such, if the lid 704 is secured in position, the base 702 is sandwiched between the pallet 600 and the lid 704 and is thereby secured in position.

The nature of the connection between the base 702 and the lid 704 is also shown. The base 702 has a geometry, or shape, which conforms to that of a lower part of the lid 704. Furthermore, the base 702 incorporates a lip 726 which traverses the perimeter of the base 702. However, the lip 726 is inwardly offset from the outer perimeter. As such, in the illustrated embodiment the lip 726 provides an interference fit between the base 702 and the lid 704. This loosely secures the lid 704 to the base 702. However, other embodiments may not incorporate an interference fit. Furthermore, the lip 726 provides a sealing functionality between the base 702 and the lid 704. As such, in some embodiments, the detachable enclosure 700 may be waterproof. This can be useful in preventing the ingress of moisture within the cavity, and so in the proximity of the component which is housed therein. Although no component is illustrated, in practice the component will interpose the base 702 and the lid 704. In other words, the base 702 and lid 704 will enclose the component.

In other embodiments, the detachable enclosure 700 may not be entirely waterproof per se. Specifically, it may be desirable to allow the ingress of some moisture for reasons of, for example, humidity sampling. This may be achieved by incorporating one or more features into the detachable enclosure 700. For example, a grill and/or aperture may be incorporated into the base 702, lid 704, or both. The grill and/or aperture may permit fluid communication between the cavity of the detachable enclosure 700 and the external atmosphere. Other features which also provide fluid communication could otherwise be used. Alternatively, instead of permitting fluid communication between the cavity and the external atmosphere, there may be a separate chamber, within the detachable enclosure 700, which can fluidly communicate with the external atmosphere.

In a preferred arrangement, the base 702 and lid 704 are secured to one another in a first step, and the overall detachable enclosure 700 formed thereby is then connected to the pallet 600 in a second step. That is to say, the base 702 and lid 704 are connected independently of the pallet 600. The detachable enclosure 700, formed from the base 702 and the lid 704, then forms a subassembly. The detachable enclosure 700 is then connected to the pallet 600.

It will be appreciated that any component housed within the detachable enclosure 700 will be inserted before the base 702 and lid 704 are secured to one another. That is to say, the detachable enclosure 700, with a component housed therein, is connected to the pallet 600.

The base 702 and lid 704 may be secured to one another by way of an interference fit, fastener or clip. Fasteners may include screws. Plastic welding, an adhesive, or pressure, or any other joining technique or method may otherwise be employed.

FIG. 49 also demonstrates how the clips 708, 710, 712, 714 align with respective apertures 642*a*, 642*b*, 644*a*, 644*b*.

FIG. 50 shows the detachable enclosure 700 when connected to the pallet 600.

The gripping members 724*a*, 724*b* can be seen protruding beyond an outer face of the surrounding ribs of the pallet 600. As mentioned above, this provides a convenient means of the user being able to remove, or withdraw, the detachable enclosure 700 from the pallet 600. An external face 700*a* of the detachable enclosure 700 is also shown recessed beneath an outermost extent of the surrounding ribs. This is advantageous because the detachable enclosure 700 and component therein, is protected from lateral impacts.

Clips 708, 710 are shown engaged with the apertures 644*a*, 644*b*. Specifically, abutments 708*b* engage the apertures 644*a*, 644*b*, or faces thereof. The detachable enclosure 700 is therefore releasably connected to the pallet 600.

FIG. 51 is a rotated view of the FIG. 50 arrangement. FIG. 51 better illustrates the abutments 708*b* engaging the apertures 644*a*, 644*b*. FIG. 51 also shows apertures 728*a*, 728*b*, 728*c*, 728*d* in the product supporting surface 602. It can be seen that, due to the alignment of the apertures 728*a*, 728*b* in the product supporting surface 602 with the apertures 644*a*, 644*b* in the ribs, the detachable enclosure 700, or at least a portion thereof, is visible through the product supporting surface 602. This is useful for a user who can see whether the detachable enclosure 700 is attached when the pallet 600 is in an upright orientation, as is typical during use. That is to say, when the product supporting surface 602 is facing upwards.

It is recognised that many details regarding the component, or the attachment or securing thereof, have not been provided. This is because it is not the component itself, but the detachable enclosure within which a component can be supported which the applicant considers to be the invention.

For completeness, the component may be, or include, an electronic device. The electronic device may be any one of a sensor, QR reader, RFID tag, battery, PCB or other device which provides some useful functionality in combination with a pallet. The component may be a component which is damaged by water, or moisture, exposure.

The component may be a component which is damaged by exposure to contaminants, such as dirt.

General

Rectangular plan dimensions of load bearing platforms (commonly known as pallets) including but not limited to those that conform to ISO 6780:2003(E) have lengths and widths of 1200×800 mm (commonly known as Euro size), 1200×1000 mm (commonly known as full size), and 1219×1016 mm. Other standard sizes may be used in other regions of the world. The term "Half Pallet" is half of the size of the standard pallet according to the particular standard being used. Similarly, the term "Quarter Pallet" is a quarter of the size of the standard pallet according to the particular standard being used. For example, if the standard used in one region is 1200×800 mm, then a Half Pallet will have dimensions of 800×600 mm, and a Quarter Pallet will have dimensions of 600×400 mm. These standard dimensions are also applied to wheeled pallets commonly known as dollies, and also referred to as pallets on wheels or wheeled pallets.

The illustrated pallets, and dollies, are Quarter Pallets. However, the invention may also be used with any appropriate size of pallet, including a dolly, such as with Half Pallets, or full size pallets, to name but two specific examples of pallet size.

Given the above information, regarding both Half and Quarter Pallets having a 600 mm side, it is preferable that a horizontal solution, such as the support bodies, be compatible with the 600 mm side. In such instances, the support bodies would be compatible with both Half and Quarter pallets.

Although for the adjustable support member an example of 100 mm increments for the adjustability is provided, this is not intended to be limiting. Many other increments may be considered and otherwise implemented. For example, adjustable increments of 50 mm, 150 mm, 200 mm and 300 mm may instead be used. Furthermore, the upper and lower limits of adjustability may vary.

Plastic, metal and cardboard, or a combination thereof, may be used to manufacture the support members and constituent parts. Preferred metal choices include aluminium and steel.

The corner geometries provided by the corner body and support members are advantageous in reducing any overhang or protrusion beyond the pallet footprint. That is to say, by conforming these components to the external geometry of the pallet, which may be a corner, any overhang is reduced. This increases the efficiency of transportation and storage of the stacked arrangements utilising these components.

The combination of the first and second lateral projections in a corner body or support member may mean that the corner body or support member is self supporting when attached to a pallet. That is to say, the two projections being received by corresponding load bearing features may be enough to prevent the corner body or support member from disengaging or toppling over. Regardless, in use, it is expected that securing means by way of one or more of a stretch film, straps, and hooks be used to properly secure the assembly.

Throughout this document, upwards is used to define a direction from the feet of the pallet towards the product supporting surface. Downwards is used to define a direction from the product supporting surface towards the feet. Inwards is used to define a direction from an exterior face of the deck towards the hand access hole. Outwards is used to define a direction from the hand access hole towards the exterior face of the deck. Lateral is used to define a sideways direction. That is to say, lateral is a direction generally parallel to the product supporting surface. Upper is intended to mean upwards of, and so forth.

The lateral projections preferably extend perpendicularly from the surface to which they are connected. In other words, the lateral projections may be cantilevers. The lateral projections may be reinforced. For example, the lateral projections may have a reinforcing support either above or below the lateral projections. This will be dependent upon the lateral projection still being receivable by the load bearing features of the pallet. For example, if a support is added below the lateral projection which is received by a lower recess of an upper pallet, the lateral projection can still be received by the lower recess.

In order to be considered to be load bearing, a contact surface area between a lateral projection and a corresponding load bearing feature may be at least around 10 $mm^2$, and preferably at least around 20 $mm^2$. For the purpose of this document, the product supporting surface is not considered to be a load bearing feature configured to receive a lateral projection.

The terms goods and products are used interchangeably throughout this document. Both are intended to refer to items loaded on the pallet. Goods and products also includes a POS display.

Cross-section is intended to mean a cross-section taken normal to a direction in which an elongate body extends.

End portion is intended to mean a portion at an end of a member, the portion extending from an outermost end towards a middle of the member.

The elevated stacking arrangements, and modifications to facilitate the use thereof, may be for manual use i.e. by a worker, or by automatic means i.e. in an automated product line.

It is preferred that any modifications to the pallet do not interfere with existing features, particularly connectivity features disposed on the product supporting surface.

Various combinations of lateral projections of corner bodies and support members are possible. Details disclosed across this document are equally applicable to other embodiments, and aspects of the invention, where appropriate.

Combinations of components may otherwise be referred to as assemblies.

The described and illustrated embodiments are to be considered as illustrative and not restrictive in character, it being understood that only preferred embodiments have been shown and described and that all changes and modifications that come within the scope of the inventions as defined in the claims are desired to be protected. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

Optional and/or preferred features as set out herein may be used either individually or in combination with each other where appropriate and particularly in the combinations as set out in the accompanying claims. The optional and/or preferred features for each aspect of the invention set out herein are also applicable to any other aspects of the invention, where appropriate. In particular, any features discussed in connection with the corner body, and laterally insertable support member are equally applicable to the adjustable support member. This includes dimensions, features, geometries, methods of use, and so on.

The invention claimed is:

1. A pallet comprising:

a deck comprising a product supporting surface and one or more load bearing features, wherein:

the one or more load bearing features are configured to receive lateral projections of support members, at least one of the one or more load bearing features is positioned at a corner of the deck, and the at least one of the one or more load bearing features is an upper recess.

2. The pallet according to claim 1, wherein the deck is generally cuboidal and the one or more load bearing features, which are configured to receive the lateral projections of support members, are each positioned at a respective corner of the deck.

3. The pallet according to claim 2, wherein at least one of the one or more load bearing features is a supporting slot.

4. The pallet according to claim 3, wherein the supporting slots of at least two rear corners open into cavities defined by two rear feet.

5. The pallet according to claim 2, wherein each of the corners include a corresponding upper recess, and wherein each of the corners further includes another load bearing feature configured as a lower recess.

6. The pallet according to claim 5, wherein each of the lower recesses comprises one or more projections which extend therefrom, with the one or more projections being configured to engage a corresponding recess of the support member.

7. The pallet according to claim 5, wherein each of the corners further comprises a tip support.

8. The pallet according to claim 5, wherein each of the lower recesses is configured as a triangular recess defined by an inner face of a lowermost rib of the respective corner and a chamfered edge of a foot of the pallet.

9. The pallet according to claim 1, wherein the at least one of the one or more load bearing features comprises a cut-out.

10. The pallet according to claim 1, wherein the pallet is a fractional pallet, in particular a half pallet or a quarter pallet.

11. A laterally insertable elevated stacking pallet support member corner body having a longitudinal height and comprising:

a first edge section;

a second edge section;

one or more lateral projections, wherein at least one of the one or more lateral projections extend from the first edge section to the second edge section; and a receiving portion configured to receive an end portion of an elongate member, wherein the receiving portion spans only a portion of the longitudinal height of the support member corner body.

12. The laterally insertable corner body according to claim 11, wherein at least one of the one or more lateral projections are generally triangular.

13. The laterally insertable corner body according to claim 11, wherein at least one of the one or more lateral projections is configured as a bridge.

14. The laterally insertable corner body according to claim 11, wherein the receiving portion is configured as a slot.

15. The laterally insertable corner body according to claim 11, wherein the first edge section and the second edge section are approximately perpendicular to one another.

16. The laterally insertable corner body according to claim 15, wherein the one or more lateral projections span at least some of an included area between the first and second edge sections.

17. A laterally insertable elevated stacking pallet support member comprising:

an elongate member comprising a first end portion and a second end portion; and first and second laterally insertable corner bodies each having a longitudinal height and comprising one or more lateral projections, and a receiving portion configured to receive an end portion of an elongate member, wherein:

each of the receiving portions span only a portion of the longitudinal height of the corresponding laterally insertable corner body, and the first and second end portions are received in the receiving portions of the first and second laterally insertable corner bodies respectively.

18. The laterally insertable support member according to claim 17, wherein the elongate member is made from cardboard.

19. An elevated stacked pallet arrangement comprising:

first and second pallets, with the second pallet being positioned above the first pallet, and with each pallet comprising a deck comprising a product supporting surface and one or more load bearing features, with the one or more load bearing features being configured to receive lateral projections of support members; and a plurality of support members, with each support member comprising:

an elongate member comprising a first end portion and a second end portion, and first and second laterally insertable corner bodies comprising one or more lateral projections, and a receiving portion configured to receive an end portion of an elongate member, wherein the first and second end portions are received in the receiving portions of the first and second laterally insertable corner bodies respectively.

* * * * *